US009719311B2

(12) United States Patent
Tunget

(10) Patent No.: US 9,719,311 B2
(45) Date of Patent: Aug. 1, 2017

(54) MANIFOLD STRING FOR SELECTIVITY CONTROLLING FLOWING FLUID STREAMS OF VARYING VELOCITIES IN WELLS FROM A SINGLE MAIN BORE

(76) Inventor: Bruce A. Tunget, Westhill (GB)

( * ) Notice: Subject to any disclaimer, the term of this patent is extended or adjusted under 35 U.S.C. 154(b) by 494 days.

(21) Appl. No.: 13/261,448

(22) PCT Filed: Mar. 1, 2011

(86) PCT No.: PCT/US2011/000377
§ 371 (c)(1),
(2), (4) Date: Sep. 25, 2012

(87) PCT Pub. No.: WO2011/119198
PCT Pub. Date: Sep. 29, 2011

(65) Prior Publication Data

US 2013/0043031 A1 Feb. 21, 2013

(30) Foreign Application Priority Data

Mar. 25, 2010 (GB) ..... GB1004961.7
Jun. 22, 2010 (GB) ..... GB1010480.0
Jul. 5, 2010 (GB) ..... GB1011290.2

(51) Int. Cl.

| | |
|---|---|
| ***E21B 17/18*** | (2006.01) |
| ***E21B 21/12*** | (2006.01) |
| ***E21B 43/00*** | (2006.01) |
| ***E21B 43/29*** | (2006.01) |
| ***E21F 17/16*** | (2006.01) |
| ***E21B 43/28*** | (2006.01) |

(52) U.S. Cl.
CPC ..... *E21B 17/18* (2013.01); *E21B 21/12* (2013.01); *E21B 43/006* (2013.01); *E21B 43/28* (2013.01); *E21B 43/29* (2013.01); *E21F 17/16* (2013.01)

(58) Field of Classification Search
CPC ..... E21B 17/18; E21B 21/002; E21B 21/08; E21B 21/10; E21B 21/12; E21B 43/122; E21B 43/123; E21B 43/38; E21B 43/28; E21B 43/29; E21B 43/006
See application file for complete search history.

(56) References Cited

U.S. PATENT DOCUMENTS 2,975,836 A 6/1958 Brown
3,448,803 A * 6/1969 Sizer ..... 166/115
4,453,599 A 6/1984 Fredd
(Continued)

*Primary Examiner* — Shane Bomar
*Assistant Examiner* — Christopher Sebesta

(57) ABSTRACT

A set of manifold string members usable to selectively control separate flowing fluid streams of varying velocities for operations of well construction, injection or production of fluid mixtures of liquids, gases and/or solids, that can be injected into, or taken from, one or more proximal regions of a subterranean passageway, underground cavern, hydrocarbon or geothermal reservoir. Fluid communicated through a manifold string radial passageway of a manifold crossover, between conduit strings and at least one other conduit, can be controlled with at least one flow controlling member, communicating with a passageway member from an innermost, concentric, and/or annular passageway. Fluid communication can be selectively controlled for various configurations of one or more substantially hydrocarbon and/or substantially water wells, below a single main bore and wellhead.

20 Claims, 16 Drawing Sheets

(56) References Cited

U.S. PATENT DOCUMENTS

| | | | | |
|---|---|---|---|---|
| 5,129,459 | A | 7/1992 | Breese et al. | |
| 5,462,120 | A * | 10/1995 | Gondouin | E21B 7/061 166/117.6 |
| 6,170,578 | B1 | 1/2001 | Edwards et al. | |
| 6,298,919 | B1 | 10/2001 | Browne et al. | |
| 6,388,353 | B1 * | 5/2002 | Liu | F04B 13/00 310/114 |
| 6,394,182 | B1 * | 5/2002 | Fadel | 166/265 |
| 6,547,003 | B1 * | 4/2003 | Bangash et al. | 166/106 |
| 7,147,058 | B1 * | 12/2006 | Shaposhnikov et al. | 166/370 |
| 7,395,877 | B2 * | 7/2008 | Hosie et al. | 175/25 |
| 7,445,429 | B2 | 11/2008 | Wilson et al. | |
| 7,461,692 | B1 * | 12/2008 | Wang | 166/105.5 |
| 2004/0168572 | A1 * | 9/2004 | Hopper | E21B 43/38 95/261 |
| 2005/0126775 | A1 * | 6/2005 | Van Nguy | E21B 17/06 166/125 |
| 2009/0056939 | A1 * | 3/2009 | Hackworth et al. | 166/265 |

* cited by examiner

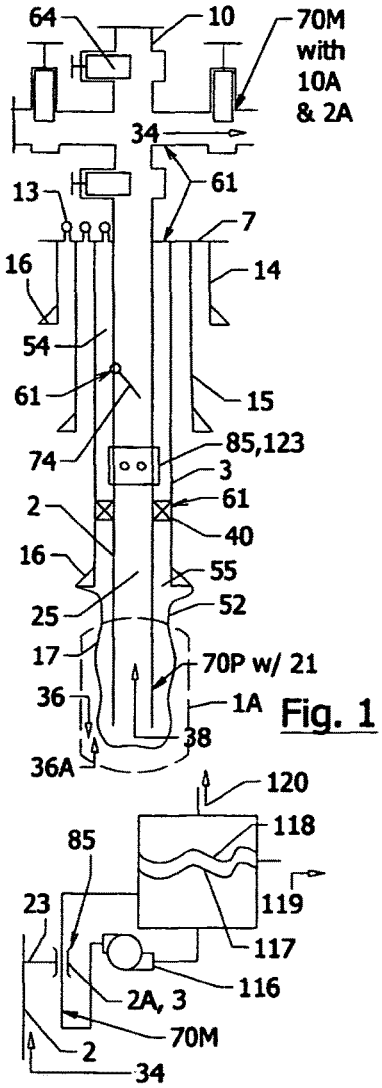
Fig. 1
Fig. 3
Prior Art
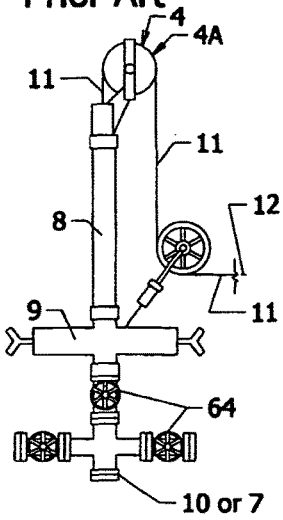
Fig. 2
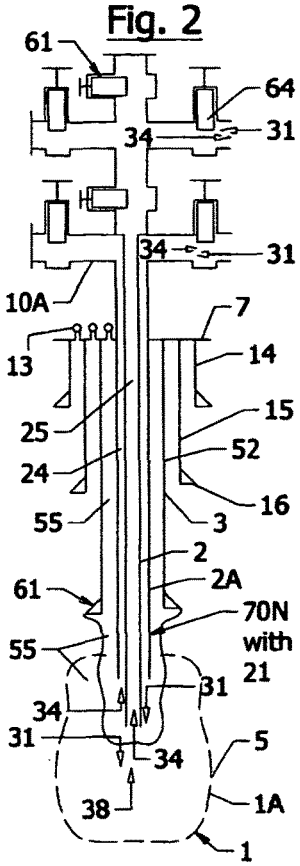
Fig. 5A
Prior Art
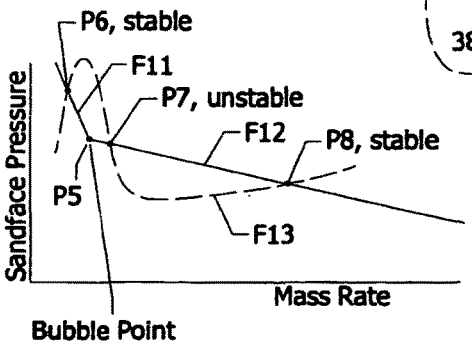
Fig. 4
Prior Art
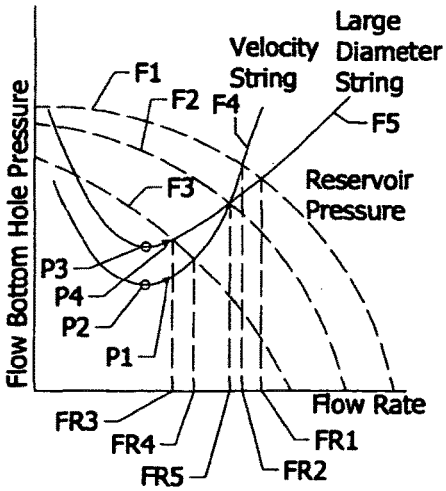
Fig. 5
Prior Art
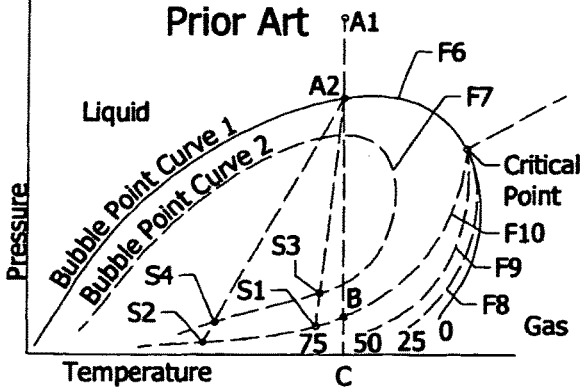

Fig. 6
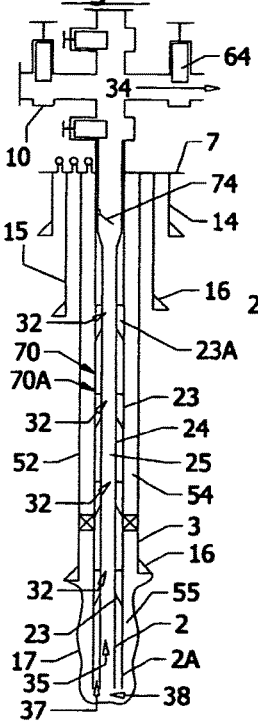
Fig. 7
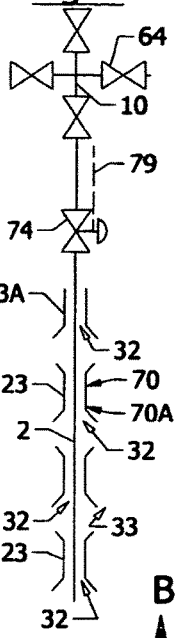
Fig. 17
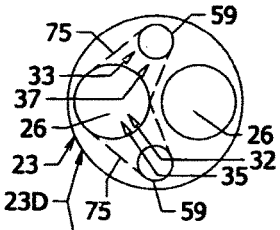
Fig. 18
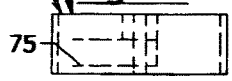
Fig. 19
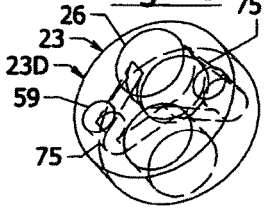
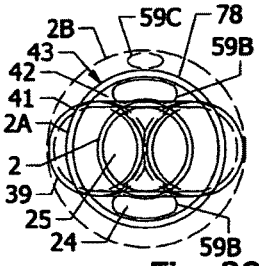
Fig. 20
Fig. 8
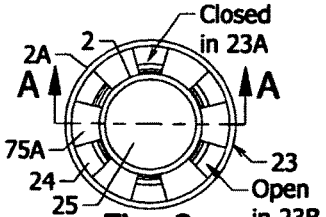
Fig. 9 Section A-A
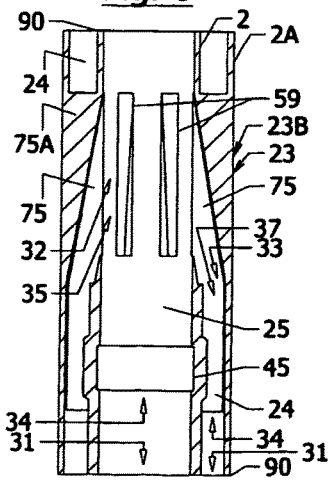
Fig. 10
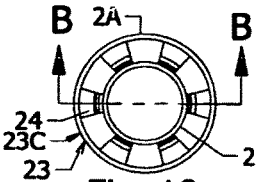
Fig. 11 Section B-B
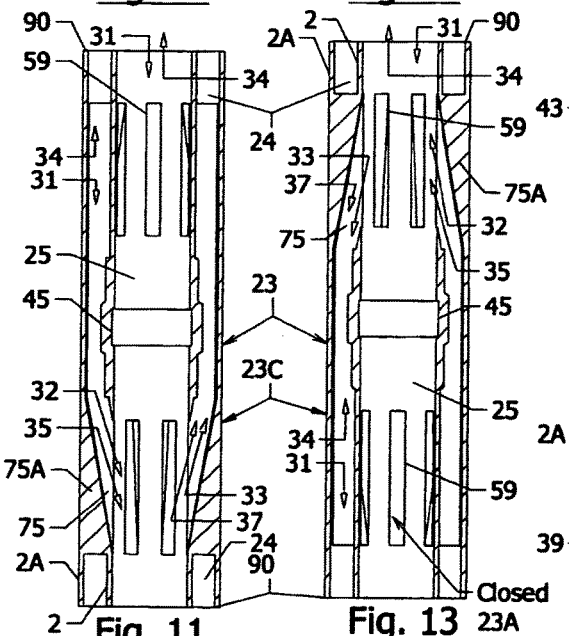
Fig. 12
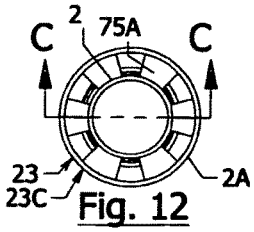
Fig. 13 Section C-C
Fig. 21
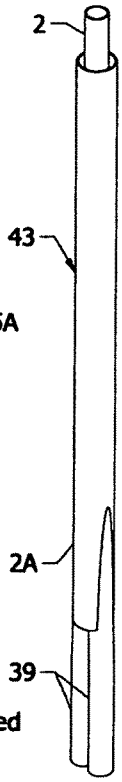

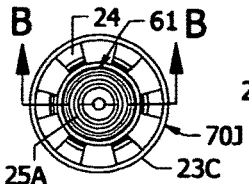
Fig. 22
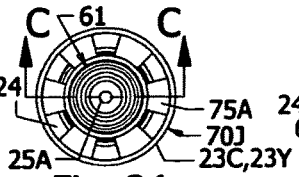
Fig. 24
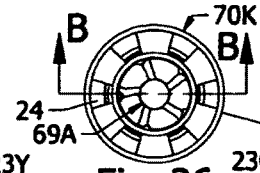
Fig. 26
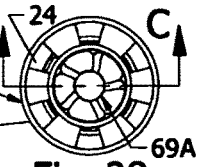
Fig. 28
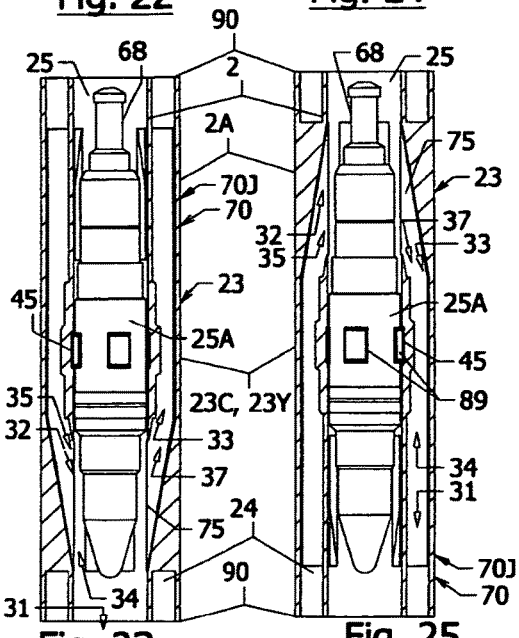
Fig. 23
Section B-B
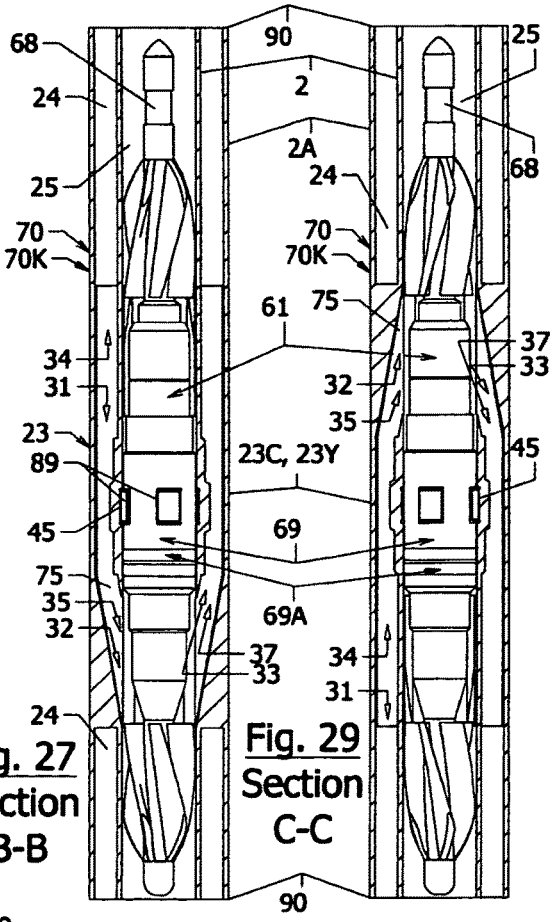
Fig. 27
Section B-B
Fig. 29
Section C-C
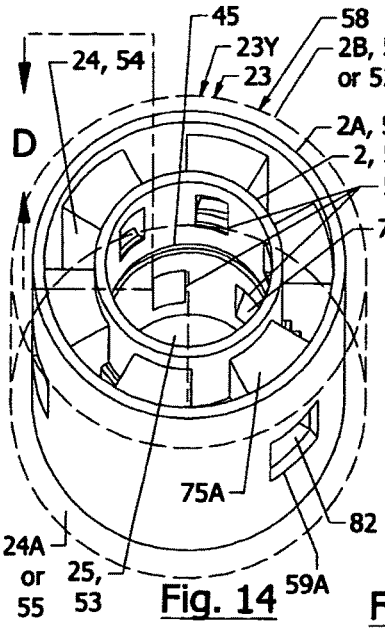
Fig. 14
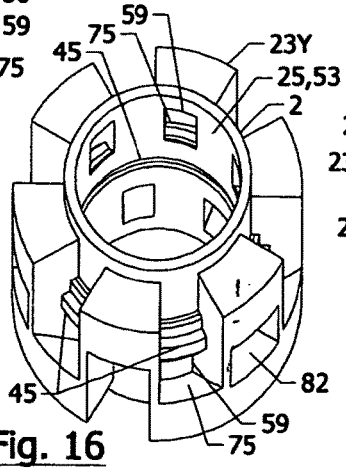
Fig. 16
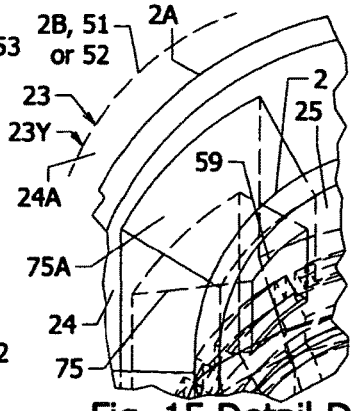
Fig. 15 Detail D

F
F
G
70G
23
69B

Section F-F
2
25
90
2A
24
34
31

25
2
2A
34
31
70G
24
68
70
69
23
23E
69B
H
75
89
23E
I
90
25A
75

Detail G
2
75
59
2A
70G
70
75
61
69B
34
31
34
31
23E
23
59

Detail H
69B
89
45
75
34
31
61
66

Detail I
112
25
69B
34
31
59
75
72
66
61
34
31
23E
45A
25A
90
59
34
31
25
2

110A
2
112
34
66
69
110
111
69D 61
69
J
69B
112
J
89

34
31
109
69
108
69C

Section J-J
69
69B
68
61
112
113
114
151
89
66
112
66
25A
72

Fig. 40 Prior Art
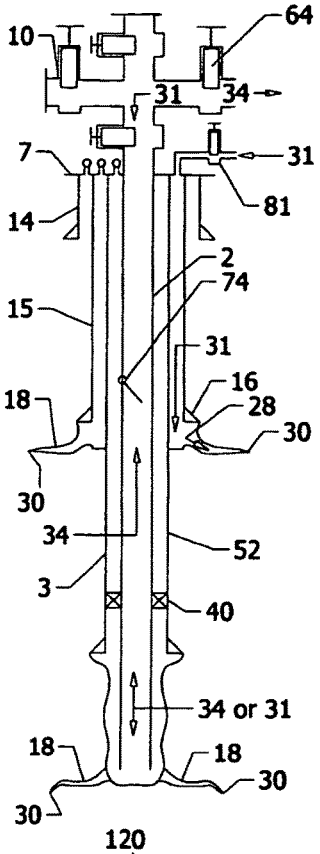
Fig. 42
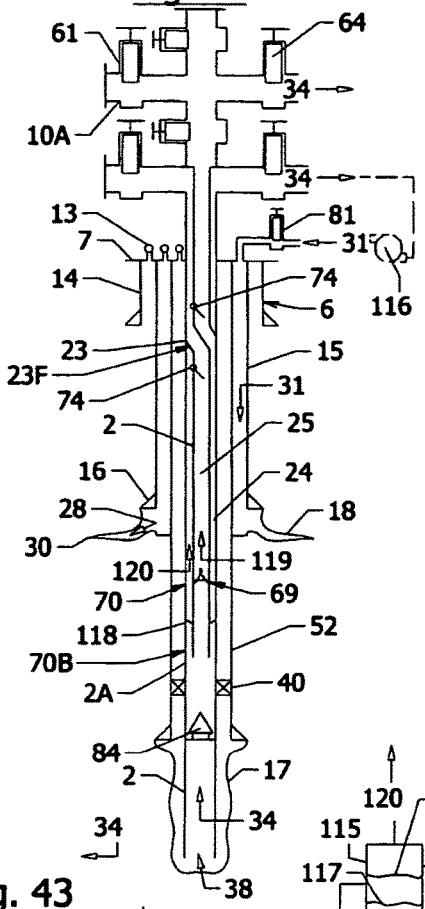
Fig. 44
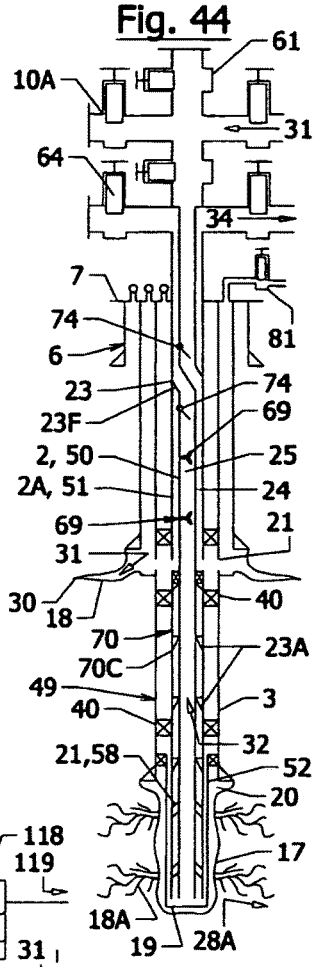
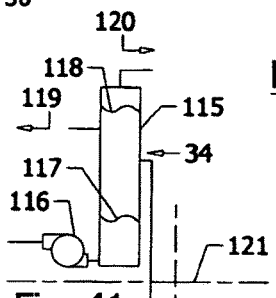
Fig. 41
Prior Art
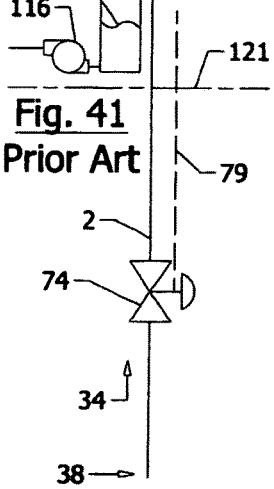
Fig. 43
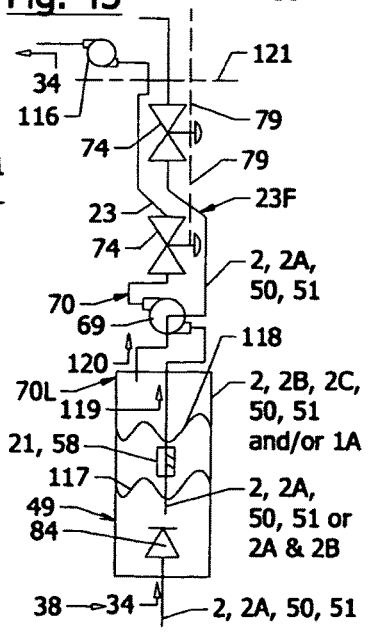
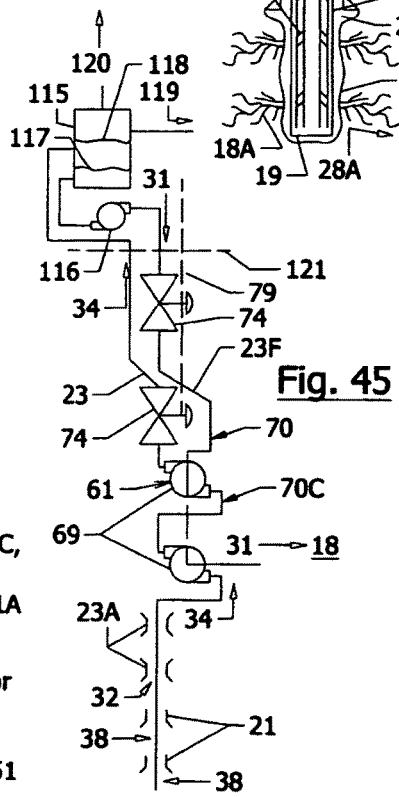
Fig. 45

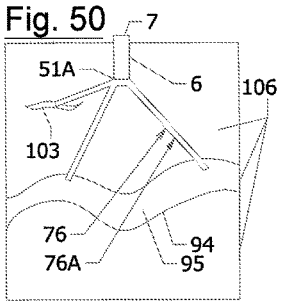
Fig. 50
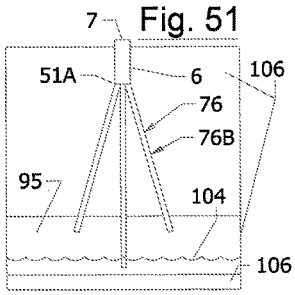
Fig. 51
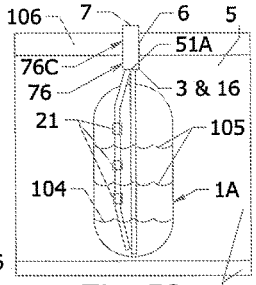
Fig. 52
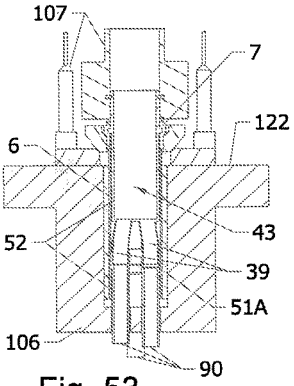
Fig. 53
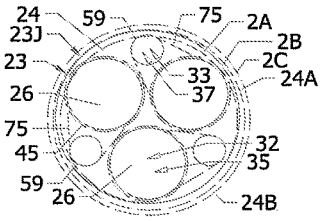
Fig. 54
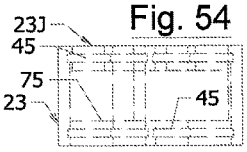
Fig. 55
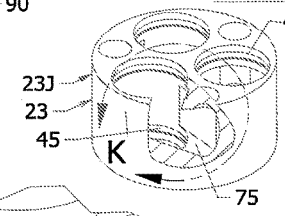
Fig. 56
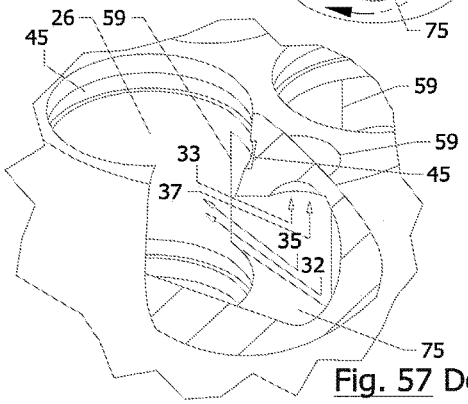
Fig. 57 Detail K
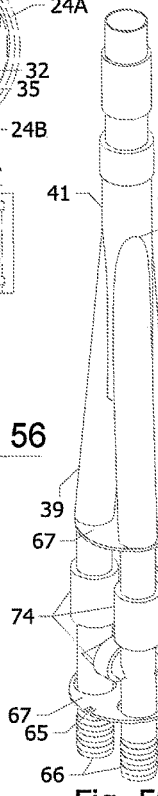
Fig. 58
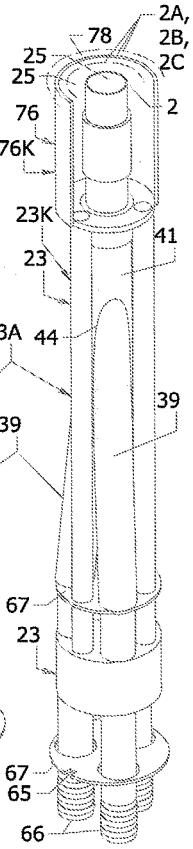
Fig. 59

87
71
43
78

78
71
23
23L
43A
39
74
66

71
2
2A
78
90A
24
59A
2B
25
41
44
76J
76
39
23X
65
50
90

23X
45
59
87
76J
83
23L
25,
26
39
75
24
2, 71
2A
78
23
43A
32
35
37
33
76
90
2
90A
23
23L
39
45
23X
75
26
65
2
25
90

87
25
L
L
2A
24
76J 2
90
41
23
23L
44
43
42
43A
45C
39
34
31
76J
76
25A
61
45
23X
32
35
33
37
75
45
34
31
50
50
90
Fig. 66 Section L-L

Fig.78 Detail P

M
N
P

Q
R
AK 90
41
43
39
90

Detail S
44
42
S
39

45B
47
87
65
88

T
T
74
79

90
50
40
60
61
U
97
60
90
90
50
79
45
61
74
127
90
60
92
97

68
25A
89
61

V
V
90
50
91
45
61
50
90

61
87
48
47

45B
87
48

AE
AF
39

Detail AE
23
26
59
43
42
24
41
39

Detail AF
124
125
59

49
AG
AG
70
70F

Section AG-AG
72
50
58
45
70F
70
2
50
49
2A
51
41
42
39
124
125
59

Section AG-AG
AH
AI
AJ
58
126
2
2A
41
50
51
23U
23
75
42
39
49
51
124

Detail AH
72
50
53
25
49
58
89
45
51

Detail AI
25
50
2
53
23U
2A
23
51
34
31
58
32
35
75
33
2437
54
24

Detail AJ
125
124
59
125

Section X-X

Section X-X

Section X-X

Section X-X

Section X-X

Fig. 113 Detail Y
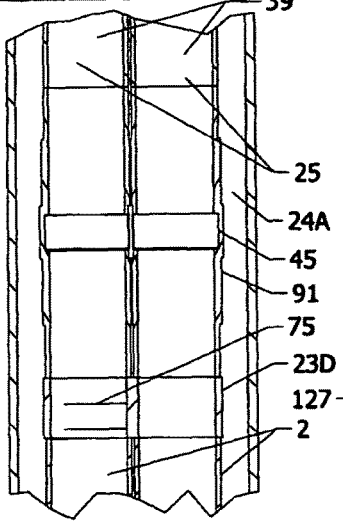
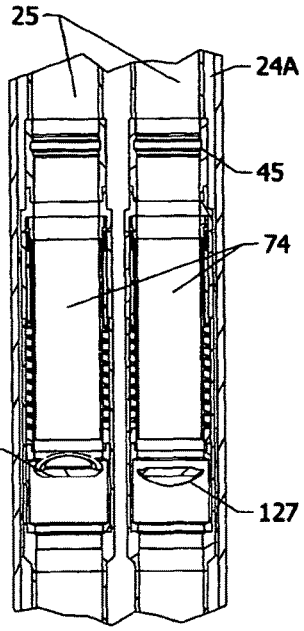
Fig. 114
Detail Z
Fig. 116 Detail AB
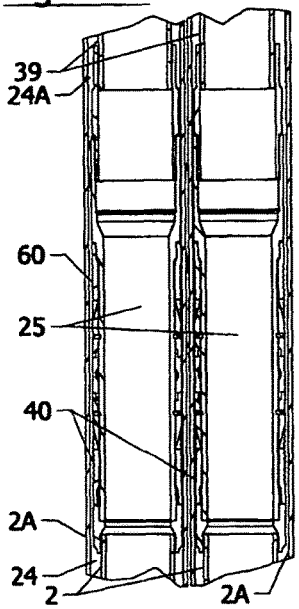
Fig. 115 Detail AA
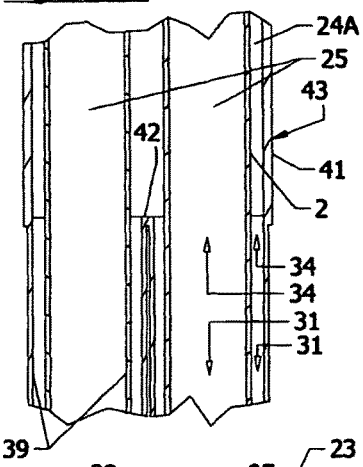
Fig. 123
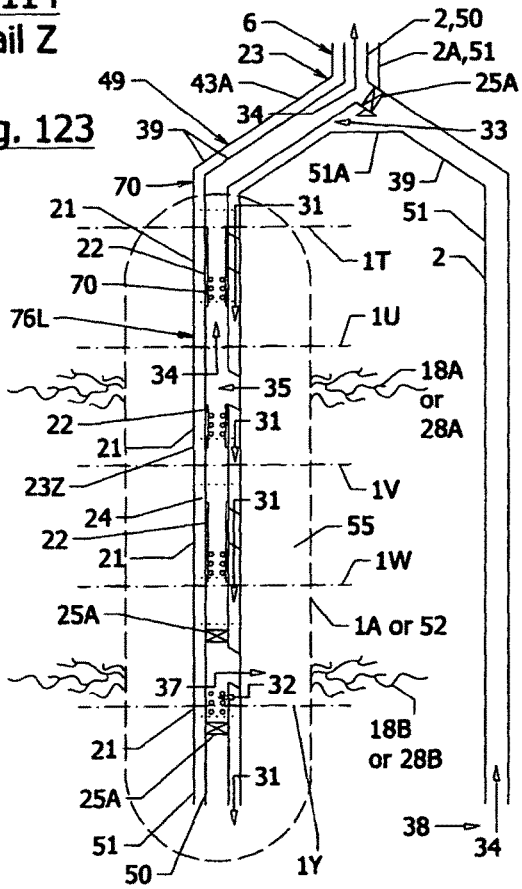
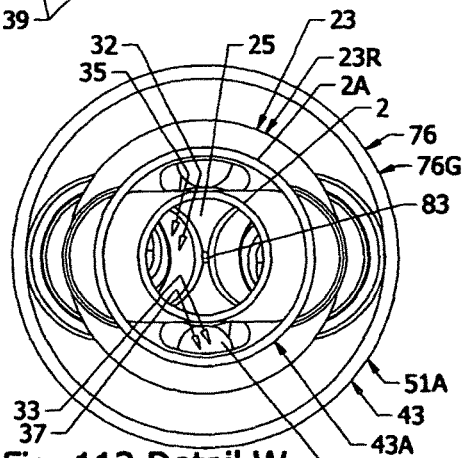
Fig. 112 Detail W

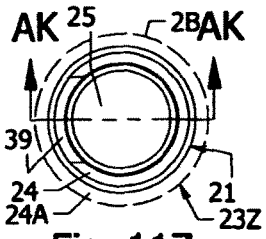
Fig. 117
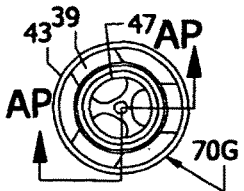
Fig. 119
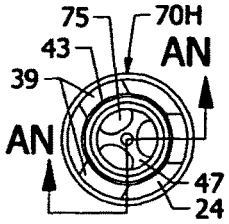
Fig. 121
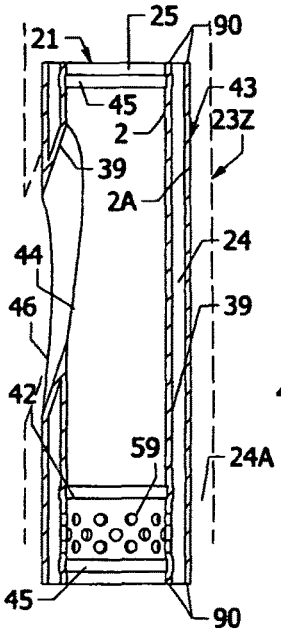
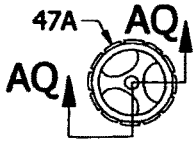
Fig. 118
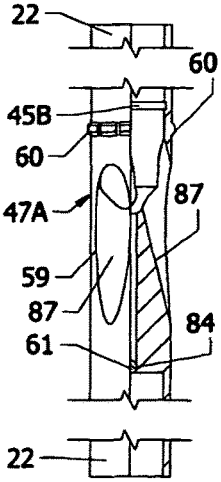
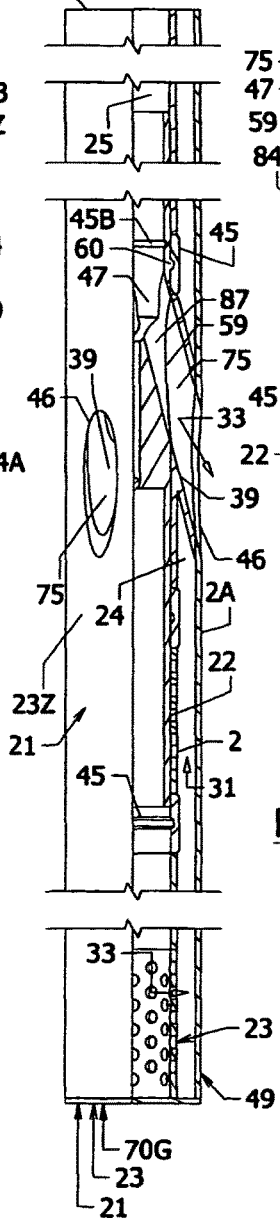
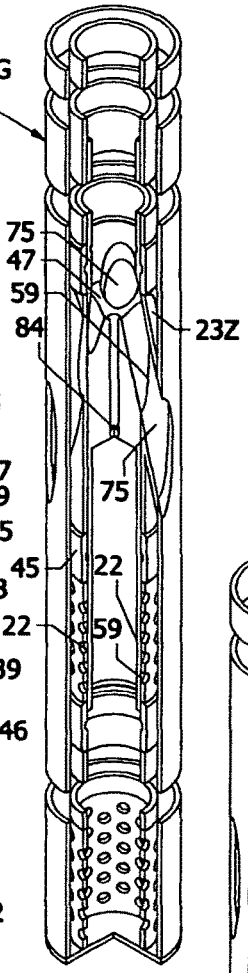
Fig. 120
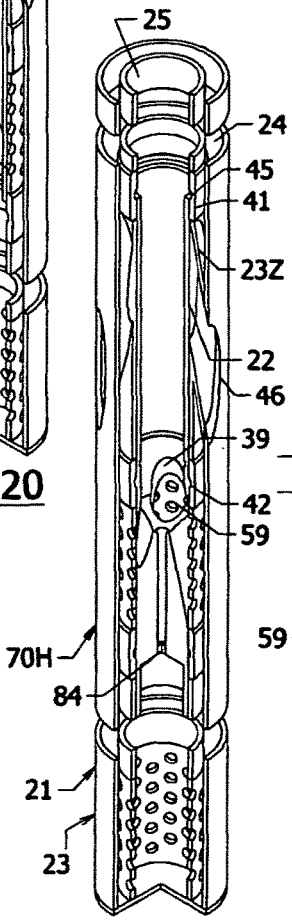
Fig. 122
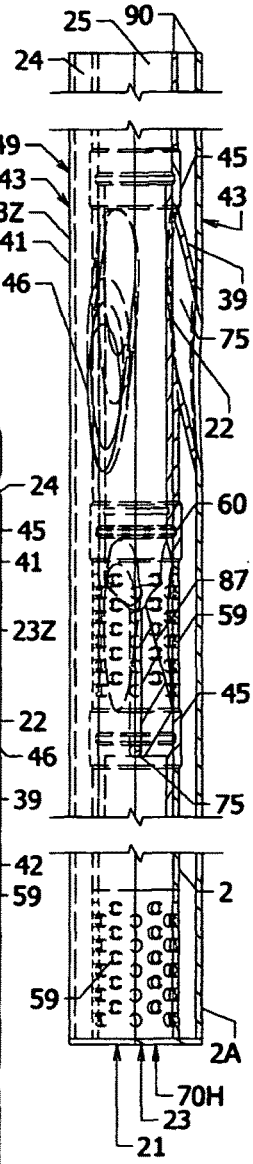

MANIFOLD STRING FOR SELECTIVITY CONTROLLING FLOWING FLUID STREAMS OF VARYING VELOCITIES IN WELLS FROM A SINGLE MAIN BORE

CROSS REFERENCE TO RELATED APPLICATIONS

The present application claims priority to patent cooperation treaty (PCT) application having PCT Application Number PCT/US2011/000377, entitled "Manifold String For Selectively Controlling Flowing Fluid Streams Of Varying Velocities In Wells From A Single Main Bore," filed Mar. 1, 2011, which claims priority to United Kingdom patent application having Patent Application Number GB1004961.7, entitled "Apparatus And Methods For Operating One Or More Solution Mined Storage Wells Through A Single Bore," filed Mar. 25, 2010, U.S. patent application Ser. No. 12/803,283, entitled "Apparatus And Methods For Forming And Using Subterranean Salt Caverns," filed on Jun. 22, 2010, GB1010480.0, entitled "Apparatus And Methods For Forming Subterranean Salt Caverns," filed Jun. 22, 2010, U.S. patent application Ser. No. 12/803,775, entitled "Through Tubing Cable Rotary System," filed on Jul. 6, 2010, GB1011290.2, entitled "Apparatus And Methods For A Sealing Subterranean Borehole And Performing Other Cable Downhole Rotary Operations," filed Jul. 5, 2010, all of which are incorporated herein in their entirety by reference.

FIELD

The present invention relates, generally, to systems, apparatus and methods usable to perform operations selectively within a passageway, formed through subterranean strata, for one or more wells operating from a single main bore, for the construction and operation of injection and/or production wells of a substantially hydrocarbon or substantially water nature.

BACKGROUND

Hydrocarbons are produced from subterranean regions and reservoirs that also contain water and other related fluids. In many wells, the volume of water and other well fluids can substantially exceed the relative volume of hydrocarbons, which are being produced from the wells, such that the hydrocarbon production rates can be reduced or limited by the volume of water and other fluids handled by the well fluids production systems. Traditionally, the separation of hydrocarbons from water and other well fluids has occurred at the surface, for hydrocarbon production. In addition to surface separation systems, downhole well fluids production systems have been used which include the use of electric powered centrifugal separators or permeable filtering systems and/or hydraulic or mechanical separators for separating the hydrocarbons, being produced, from other fluids downhole. However, these existing downhole systems require power, moving components, and/or periodic replacement of devices or parts, such that these existing systems will not work effectively during the entire life of the well. In addition, these traditional systems do not provide for the separation and selective control of simultaneous flow streams, including the selectively-controlled urging of substantially hydrocarbon or substantially water injection and/or production streams, within a single main wellbore.

Embodiments of the present invention can selectively control simultaneous fluid streams of varying velocities by using flow controlling members. The flow controlling members can be selectively placed between conduits of a plurality of concentric conduit string members or, alternatively, placed through the innermost passageway members and engaged to one or more receptacle members of a subterranean disposed manifold string, using at least one manifold crossover member with a radial passageway fluidly communicating between concentric passageway members and one or more downward extending conduits. The manifold string can be usable for fluid injection into, and/or fluid extraction from, one or more wells, vertically and/or laterally disposed within the subterranean strata regions, through a single main bore and wellhead, thus minimizing space requirements, rig movements and/or surface facilities.

Embodiments of the present invention can use flow controlling members to selectively extract and/or inject substantially hydrocarbon or substantially water fluid mixtures, comprising gases, liquids, and/or solids, for example cuttings disposal or salt-saturated brine removal, through the crossover member of a manifold string, located between two or more subterranean features at the lower end of one or more wells, which can be comprised within a single main wellbore. The fluid mixtures can be selectively controlled produced and injected from a single main wellbore, for example, injected water producing steam generated in a deep geothermal subterranean region, or injected into shallow tar sands or a cold arctic reservoir for heating and producing viscous hydrocarbons. The fluid mixtures can be selectively injected into, or extracted from a single main wellbore to dispose of waste fluid or oily water without surface processing, or to pressure drive a hydrocarbon reservoir with a water flood or water sweep directly from a deeper higher pressure subterranean water source. Alternatively, the fluid mixtures can be selectively injected into, or extracted from, a single main wellbore to feed a geothermal heat source from another subterranean well, under a junction of wells while producing steam, or recycling water condensation during steam production. In addition, the fluid mixtures can be selectively injected into, or extracted from, a single main wellbore to selectively extract gravity-segregated, underground stored fluids at two different salt cavern depths, to dissolve salt with water at the lower end of a cavern while using the upper end for storage operations, or to separate hydrocarbon flow streams produced from a sandstone reservoir while solution mining a cavern with produced water in an overburden salt deposit.

Embodiments of the present invention can further include systems, apparatus and methods usable to operate a large variety of well types for urging substantially hydrocarbon and/or substantially water injection or production. Examples of products produced or injected include subterranean liquid hydrocarbons, gaseous hydrocarbons, subterranean steam, subterranean salt saturated fluid, bored subterranean strata debris fluid mixtures, and fluids usable in well construction or stimulation, such as proppant fracs from, or to, vertically or laterally separated conduit entry or exit orifices. The conduits, having entry or exit orifices for use in urging injection and/or production operations, can extend to subterranean regions from a single main bore, positioned below a single wellhead. The systems and methods for urging substantially hydrocarbon and/or substantially water injection or production operations can be used during, for example, well or underground storage cavern construction, and/or during production from a reservoir, underground cavern, and/or solution-mined salt dissolution region. The application across a diverse set of well types and uses provides economics of scale for standardizing member systems, methods and apparatus, which can be configurable in various arrangements, e.g., for widespread off-the-shelf deployment.

In a further aspect, embodiments the present invention can provide member systems, methods and apparatus for controlling fluid mixtures containing solids. Examples of such fluid mixtures can include proppants for fracturing shale gas, low permeability reservoirs, or gravel packs located in unconsolidated reservoirs. Conventional, off-the-shelf solids placement technologies use a two flow streams approach, that does not effectively address the impermeable geologic properties of shale using apparatuses designed for sandstone reservoirs or the ability to remove solids from the wellbore after screen out occurs. However, embodiments of the present invention enable placement and removal of excess solids to vertically and/or laterally separated subterranean regions, from one or more wells from a single main bore, for increasing the efficiency of less productive, substantially impermeable, shale reservoirs or tight sandstone or unconsolidated reservoirs, through improved placement and retrieval of fluid mixtures containing solids.

Embodiments of the present invention can further use fluid rotatable apparatuses placeable with a cable, such as boring, cutting and pumping devices. These devices are usable to establish flow control within a well, during construction, intervention, operation and/or abandonment of various well types, using cable engagable downhole assemblies that can be selectively placeable, suspendable and/or retrievable within and from manifold string members, via a cable using a wireline rig.

Embodiments of the present invention can provide a fluid-pump, flow controlling member, that can be usable within hydrocarbon, water and/or underground storage wells with an electric or fluid motor. The motor can be driven from the injection of a water stream or the expansion of a higher velocity fluid stream, such as an expanding gas stream or fluid from a deeper, higher pressure formation that can be usable to pump a lower velocity fluid stream, further urging it from or into the well.

Flow controlling members can selectively control one or more manifold crossover members to provide fluid stream velocity changes, which can be usable to selectively emulate a velocity string, jet pump and/or a venturi arrangement during production, injection and/or downhole processing.

Embodiments of the present invention can also provide a means of selectively separating a fluid mixture flow stream into a plurality of substantially gaseous, liquid and/or water flow streams of varying velocities and the associated extraction or injection stream. The separation of the flow streams can be selectively reconfigurable with a cable using a wireline rig or other rig and can be usable during or over the life of the one or more substantially hydrocarbon and/or substantially water wells, operating through a single main bore and wellhead. Manifold string members, can be used to control flow through member passageways and spaces located between conduit string members across one or more subterranean regions, by using, for example, the spaces within the passageways through subterranean strata and/or cavern walls for subterranean processing of production and/or injection before or after passing through the wellhead, to reduce surface processing facility needs.

Embodiments of the present invention are also usable during subterranean separation of a first substantially gaseous fluid stream and second substantially liquid fluid stream from a producing fluid stream, to selectively control the gas lifting of the second fluid stream. This subterranean separation and selective control can be accomplished by controlling the injection of at least a portion of the first flow stream into the second flow stream, before either stream exits the wellhead or valve tree at the upper end of the single main bore, to selectively optimize the extraction process and the resulting produced flow stream.

Embodiments of the present invention can further provide a means to thermally affect flow streams by selectively controlling the flow stream of the adjacent passageway member or the laterally separated well, that can extend downward from a junction of wells to, for example, prevent heat exchange between flowing fluid streams during solution mining, or to thermally exchange heat to thick tar sand or cold artic production by using an adjacent passageway member through the single main bore and/or junction of wells for the injection of steam to a vertically and/or laterally separated point beneath the junction of wells. In addition, selective control of the flow streams enables thermal insulation of a flow stream by, for example, using waste water produced from hot fluids, such as hydrocarbon separation or steam condensation during electrical generation processes, which can be injected through a passageway of a single main bore axially downward to insulate product being extracted axially upward from the cooling effects of the strata and/or ocean. Another example includes using cooler wastewater injection through a concentric passageway member to insulate equipment from a high temperature production caused from a deep hydrocarbon or geothermal source. Other examples include the thermal insulation of flow controlling members, such as the final cemented casing shoe of a gas storage salt cavern during simultaneous underground gas storage extraction and solution mining operations.

An economic need exists for systems, methods and apparatus usable to minimize the quantity of equipment and space necessary to construct and operate a diverse variety of wells located in environmentally sensitive and remote locations, including for example in urban, jungle, arctic or offshore regions.

A need exists for the economies of scale necessary to develop compatible systems, methods and apparatus usable across a variety of well types including, for example, hydrocarbon, geothermal, water production, underground waste disposal, underground storage and solution mined wells, wherein broad application across the variety of wells provides an economically-efficient standardization and off-the-shelf supply.

The scale and economic needs of recently discovered impermeable shale gas hydrocarbon reserves, worldwide, and/or reserves in marginal unconsolidated reservoirs creates the need for systems and methods for improving control of fluids carrying solids for unconsolidated strata screening or fracture initiation and propagation in reservoirs where solids production and/or fracture length is limited, to increase the relative permeability of, for example, shale gas reservoirs or to, for example, improve gravel packing of unconsolidated reservoirs, beyond what is currently possible and/or economically obtainable with the use of conventional technology, which is generally designed for permeable or prolific reservoirs.

A need exists for systems and methods for reducing waste by-products of strip mining tar sands and reducing the surface facilities impact on permafrost regions above arctic reservoirs, wherein heat and/or pressure from geothermal and/or deeper subterranean source wells may be directed through a junction of the wells' member passageways to heat and extract viscous hydrocarbons without intermediate surface handling of the heat source fluids.

A need exists for improved systems, apparatus and methods usable to better carry solids within a completion string for placement of fracture proppant or gravel packs in shale gas or unconsolidated reservoirs, respectively, with an associated need for flowing gases, liquids and/or solids for more effective production during removal of solid screen outs or sand production.

A need exists for systems and methods for operating one or more wells using less surface equipment and less labour intensive wireline or cable operations over a subterranean well's useful life through abandonment, wherein selectively controlling fluid streams from a plurality of wells extending downward from a single main bore improves the overall economics of production, injection and/or ultimately abandonment, for a wide variety of well types to improve the economics of marginal subterranean developments, such as shale gas, tar sands, stranded offshore reserves, offshore underground storage facilities, and/or various other developments requiring technological improvements for development.

Needs exist for systems and methods usable for producing from a single main bore while simultaneously injecting water through the single main bore to a plurality of wells to, for example: dispose of waste fluids and/or to perform water floods for maintaining pressure, reducing subsidence or sweeping a reservoir. In addition, a need exists for systems and methods usable for producing from a single main bore while simultaneously injecting water through a single main bore to a plurality of wells to supply feed water to underground steam generation reservoirs, to provide heat to viscous hydrocarbon reservoirs, and/or to store and extract storage from a cavern while using the stored product as a leaching cushion during solution mining of the same cavern.

A need also exists for systems and methods usable for using the energy, from for example, water injection, subterranean fluid expansion, electrical and/or subterranean pressure sources, to drive pumps placed between conduits or selectively placed through conduit passageways into receptacles, wherein such subterranean submersible pumps are usable with a manifold string for simultaneous injection and/or production operations. These injection and/or production operations can be usable to aid, for example: placing water feed stock using steam expansion or recycling steam condensation in a geothermal well; using waste fluid injection to drive submersible pumps lifting produced fluids; using expanding gas from production or a subterranean separation process to drive a turbine used to pump liquids from a well; expanding gas from underground storage caverns to drive a turbine pumping water into a pressurized storage space for maintaining cavern pressure and/or solution mining (with subsequent injection of compressed gas reversing the pump to aid the pumping of brine from an underground storage space); or using a deep water source to drive a turbine or positive displacement motor and/or pump to produce a depleted hydrocarbon reservoir, after which the deeper high pressure is naturally injected into a weaker shallow formation for disposal.

A further needs exists for reconfigurable subterranean velocity strings, and subterranean separation and/or gas lift systems, methods and apparatus usable to selectively control subterranean processing prior to passing through a wellhead or exiting a valve tree. These systems and methods can provide selective control by using flow controlling members of a manifold string to, for example, operate subsea or marginal developments, where surface processing may be impractical and where members of a manifold string are reconfigurable over the life of a well, without the need to remove the production string thus potentially extending the economic life of one or more wells under a single main bore.

Finally, a need also exists for systems and methods usable for thermally affecting wells by, for example: isolating flow streams by means of separating well bores and flow streams below a junction of wells. The thermal effects of these systems and methods can include retaining the heat of injected fluids during salt dissolution for improving salt saturation levels of brine removed, reducing condensation during steam production with the use of an insulating warm wastewater injection stream as geothermal reservoir feed stock to reduce the water recycle time, or insulating hydrocarbon production streams by using the heat of injected waste water to increase heat retention and flow assurance in cold ocean and arctic environments.

Various embodiments of the present invention address these needs.

SUMMARY

The present invention relates, generally, to systems, apparatus and methods usable to selectively perform operations within a passageway, formed through subterranean strata, of one or more wells operating from a single main bore, for the controlled construction and operation of injection and/or production wells of a substantially hydrocarbon or substantially water nature. As an example, the injection or production wells can include hydrocarbon, geothermal, water production, waste disposal, underground storage and/or solution mining wells. The systems, methods and apparatus can be adapted to provide member embodiments, that can be arranged and configured in any combination or orientation to form a manifold string, usable to selectively control simultaneously flowing fluid streams of varying velocities. The selective control of the fluid streams can be usable to urge subterranean fluid mixtures, including liquids, gases and/or solids, within member passageways and to from one or more vertically and/or laterally separated subterranean regions of one or more substantially hydrocarbon and/or substantially water wells, which can extend downward from a single main bore and wellhead.

Accordingly, embodiments of the present invention can include a set of adaptable systems, methods and apparatus members usable to form any configuration of one or more substantially hydrocarbon and/or substantially water subterranean wells, which can be operable for production, injection and/or underground storage through a single main bore and which use flow controlling members located within a plurality of passageways to selectively control simultaneously flowing fluid mixture streams of varying velocities, between a wellhead and the vertically and/or laterally separated subterranean regions.

Adaptable systems, methods and apparatus can include members with managed pressure conduit assemblies (49 of FIGS. 100-105), which can be usable to place other members within the subterranean strata, including for example chamber junction (43 of FIG. 97) members that can be usable with bore selector (47 of FIG. 90) members and flow diverting string members. Managed pressure conduit assemblies (49 of FIGS. 100-105) with slurry passageway tools (58), functioning as manifold crossovers with radial passageways selectively controlling simultaneously flowing fluid streams, can be similar to manifold strings until the internal components are removed.

Preferred embodiments of the present invention provide a set of methods and apparatus usable to form a manifold string (49, 70 and/or 76 of FIGS. 1-2, 6-7, 22-35, 42-45, 48-49, 68, 50-52, 59, 62-67, 67A, 82-87, 100-116 and 119-123) for urging a fluid mixture (38 of FIG. 1) of liquid, gases, and/or solids within one or more subterranean wells, extending axially downward from a single main bore (6) and wellhead (7 of FIG. 1), by using simultaneously flowing fluid streams (31-37 of FIGS. 1-2) of varying velocities between one or more vertically and/or laterally separated subterranean regions and the wellhead (7). Embodiments can further include providing a plurality of concentric conduit strings (2, 2A, 2B, 2C, 50, 51, 71, 78), that can be located between the wellhead, at the upper end of the subterranean well, and at least one manifold crossover member and member embodiments (23 of FIGS. 6-35, 42-44, 48-49, 54-57, 59, 62-67, 67A, 68-74, 82-87, 106-109, 112, 102, 104, 106-109, 117 and 119-123), with at least one radial passageway (75 of FIG. 9) member for controlling fluid flow from at least one concentric passageway (24, 24A, 24B, 25, 53, 54, 55) member, formed by the plurality of concentric conduit strings, to another concentric passageway member, of at least one conduit string (2, 2A, 2B, 2C, 39, 50, 51), and extending axially downward from one or more manifold crossover members (23) to at least one proximal region of at least one passageway through subterranean strata (52 of FIG. 1), for forming at least part of said subterranean well.

Manifold string members can selectively control a plurality of simultaneously flowing fluid streams (31-38), between the wellhead and at least one proximal region of a passageway through subterranean strata, by using flow controlling members (61) engaged between conduits of string members or placed through the innermost passageway (25) member or innermost passageway connector (26) member of a manifold crossover (23). The flow controlling members (61) can be engaged between conduits of member strings or engaged to at least one receptacle (45, 45A, 45B) member of the manifold string or crossover (23, 58) controlling the separate simultaneously flowing fluid streams of varying velocity in the same or contradictory flow orientations, which can be communicated through passageway members to urge the fluid mixture (38) of liquids, gases, and/or solids to or from at least one proximal region of one or more passageways through subterranean strata (52), to or from other proximal regions, to or from the single main bore (6) and wellhead (7), or combinations thereof.

A manifold string, comprising a set of members or a member in another manifold string, can be configurable, using any combination of component or flow controlling members (61), and usable to control a flow stream orientation into (31) and/or out of (34) a subterranean well. By using flow controlling members (21, 23, 43, 43A, 47, 47A, 49, 51A, 58, 69, 70, 76, 7, 10, 16, 22, 25A, 63, 64, 66, 74, 77, 84, 85, 91, 96, 97, 108-112, 115, 116, 123), separate simultaneous flow streams of varying velocities can be selectively controlled and can be usable to urge a fluid mix (38), such as hydrocarbons, water, waste fluids, cement, proppants, salts or other gases, liquids or solids used for forming or operating substantially hydrocarbon and/or substantially water wells through a wellhead or valve tree, that is engaged to a wellhead, during production or injection. Any axial orientation (31, 34) or contradictory passageway orientation (32, 33, 35, 37) for a plurality of flow streams (31, 34, 38) and/or flow stream velocities can be usable in the systems, methods and apparatus of the present invention.

Embodiments are combinable with conventional flow controlling members (61), which can include, for example, a: wellhead (7), valve tree (10, 10A), casing shoe (16), chamber junction crossover (21), straddle (22), manifold crossover (23), plug (25A), chamber junction (43), chamber junction manifold (43A), bore selector (47, 47A), slurry passageway tool (58), pressure activated valve (63), surface valve (64), seal stack (66), motor and fluid pump (69), subsurface valve (74), choke (77), one-way valve (84), venturi or jet pump (85), connectors (96) and seals (97).

Manifold strings are usable to connect two or more vertically and/or laterally separated proximal regions, within the subterranean strata, using a single well or a plurality of wells (51A) located below a single main bore and wellhead (7).

In various preferred embodiments of a manifold string (49, 70, 76), the fluid mixture (38) is substantially hydrocarbon fluid or substantially water fluid. For example, mixtures which are substantially water can include: a mixture of proppant and water used for fracture stimulation, water and cement used for well construction, water steam produced from a geothermal well, water and waste substances injected into a disposal well, and/or a saline solution of water and salt during solution mining of a cavern. Examples of mixtures that are substantially hydrocarbon include: produced hydrocarbon liquid and gases and/or a mixture of two gravity segregated hydrocarbon liquids in a storage cavern accessible through a well (for example 70P and 70M of FIG. 1).

Any combination of liquid, gas and/or solids may flow in fluid streams that can be controlled with flow controlling members, such as, a surface valve tree (10, 10A) engaged to the upper end of the wellhead (7) with other flow controlling members (61). Other flow controlling members can include a fluid motor and fluid pump (69), engaged to a receptacle (45) within a manifold string (49, 70, 76), to selectively communicate fluid mixtures within the innermost passageway (25, 26, 53) members and/or annular or concentric passageway (24, 24A, 24B, 54, 55) members, which are formed by the plurality of conduit strings (2, 2A, 2B, 2C, 39, 50, 51, 71, 78), and the passageway through subterranean strata (52), above and below a manifold crossover (23) member with at least one radial passageway member (75).

Embodiments of the manifold crossover (23) members can include flow mixing devices. Examples of flow mixing devices can include a venturi (85) or jet pump, a sliding side door (125) or gas lift valve, a chamber junction crossover (21), a chamber junction manifold (43A), a junction of wells (51A), a slurry passageway apparatus (58), and/or manifold crossover embodiments (23A to 23Z) with at least one radial passageway (75), that can be usable through conduit string members (2, 2A, 2B, 2C, 39, 50, 51, 71, 78) to fluidly communicate between member passageways, and which can be combinable with additional apparatuses, for engaging or communicating with the passageway through subterranean strata (52), other manifold crossover members, chamber junctions (43), and/or one or more junctions of wells (51A) to form fluid communication passageway members (24, 24A, 24B, 25, 26, 53, 54, 55, 75) of a manifold string (49, 70, 76), which can be usable with flow controlling members (61) to selectively control and/or separate, simultaneously flowing fluid mixture streams of varying velocity.

Various preferred manifold string (70 of FIGS. 1-2, 6-7, 22-29, 31-35, 42-45, 48-49, 100-105 and 119-123) embodiments (70M and 70P of FIG. 1, 70N of FIG. 2, 70A of FIGS. 6-7, 70G of FIGS. 31-35, 70J of FIGS. 22-25, 70K of FIGS. 26-29, 70B of FIG. 42, 70L of FIG. 43, 70C of FIGS. 44-45, 70D of FIGS. 48-49, 70E of FIGS. 68 and 70F of FIGS.

100-105, 70G of FIGS. 119-120, 70H of FIGS. 121-122) are usable in applications accessing vertically separated and/or laterally separated subterranean regions from a single vertical or deviated passageway through subterranean strata (52).

One or more preferred manifold strings (70) and/or conduit string members are combinable below a wellhead, single main bore, and/or junction of wells (51A). Other preferred manifold string (76 of FIGS. 50-52, 59, 62-67, 67A, 82-87, 106-116 and 123) embodiments (76A of FIG. 50, 76B of FIG. 51, 76C of FIG. 52, 76K of FIG. 59, 76J of FIGS. 62-66, 76D of FIG. 67, 76E of FIG. 67A, 76F of FIG. 82, 76H of FIGS. 83-87 and 76G of FIGS. 106-116, 76L of FIG. 123) are usable to access subterranean regions of greater vertical and/or lateral separation, relative to a single passageway through subterranean strata (52), or to selectively provide fluid communication between two or more vertically and/or laterally separated proximal regions (1T, 1U, 1V, 1W and 1Y of FIG. 123) within a passageway through the subterranean strata (52) or within the subterranean strata (106 of FIGS. 50-52).

For example, manifold strings (49 of FIGS. 100-105, 70M of FIG. 1, 70A of FIGS. 6-7, 70G of FIGS. 31-35, 70J of FIGS. 22-25, 70K of FIGS. 26-29, 70B of FIGS. 42-43, 70C of FIGS. 44-45, 70D of FIGS. 48-49, 70E of FIGS. 68 and 70F of FIGS. 100-105, 70G of FIGS. 119-120, 70H of FIGS. 121-122 and 76 of FIGS. 50-52, 59, 62-67, 67A, 82-87, 106-116 and 123) are combinable with crossovers (23) and/or other manifold string member embodiments to form still other manifold string members (for example 70E of FIG. 68, 76D of FIG. 67, 76E of FIG. 67A, 76G of FIGS. 106-116 and 76L of FIG. 123).

Various preferred manifold crossover member embodiments (23A of FIGS. 6-7 and 44-45, 23B of FIGS. 8-9, 23C of FIGS. 10-13 and 22-29, 23Y of FIGS. 14-16 and 22-29, 23D of FIGS. 17-19, 75 and 82, 23E of FIGS. 30-35, 23F of FIGS. 42-44 and 67, 23G of FIGS. 48-49, 23H of FIGS. 48-49, 23J of FIGS. 54-57, 23K of FIG. 59, 23L of FIGS. 62-66, 23M of FIGS. 67A and 68, 23N of FIGS. 71-72, 23P of FIGS. 69-70, 23Q of FIGS. 73-74, 23R of FIGS. 82, 106-109, 112, 23T of FIGS. 83-87, 58 and 23U of FIGS. 102 and 104, 23W of FIGS. 48-49, 23X of FIGS. 62-66 and 23Z of FIG. 117, 119-123), slurry passageway tools (58), chamber junction crossovers (21 of FIGS. 117, 119-123), and additional apparatuses can communicate between passageway members, which comprise manifold crossover members, any fluid controlling members, and/or conduit string members, that can be combinable to provide fluid communication between passageway members (24, 24A, 24B, 25, 26, 53, 54, 55, 75) of a manifold string member.

Various preferred manifold crossover member embodiments (23K of FIG. 59, 23L of FIGS. 62-66, 23F of FIG. 67, 23M of FIGS. 67A and 68, 23R of FIG. 82, and 23T of FIGS. 83-87) are formed by adapting chamber junctions (21, 43) with at least one radial passageway (75) to communication fluid within passageway members, which can be formed between conduit string members (2, 2A, 2B, 2C. 39, 50, 51, 71, 78) and the passageway through subterranean strata (52). A bore selector (47, 47A) may be urged with fluid flow and/or used to selectively communicate fluid and/or flow controlling members through the innermost passageway members (25, 26, 53) of a subterranean manifold string (49, 70, 76), between one or more subterranean regions, a wellhead (7), and/or valve tree (10, 10A).

Managed pressure conduit assemblies (for example 49 of FIGS. 100-105) can be usable as a manifold string embodiment (70F of FIGS. 100-105) for subsequent placement of other manifold string members. The managed pressure conduit assembly (49), innermost concentric conduit string (50) and concentric string (51) located above the slurry passageway apparatus (58) functioning as a manifold crossover (23U) and fluidly communicating through radial-extending passageways (75) with conduit strings (39) extending downward can be used to form a junction of wells further usable by other manifold strings (70, 76) engaged with the innermost conduit strings (39) and concentric conduit strings (2A) once the installation manifold crossover (23U) with radial passageway (75) is removed for engagement of the other manifold string conduits extending downward from a wellhead (7) and/or valve tree (10, 10A).

In other preferred manifold string member (70L of FIG. 43, 70C of FIGS. 44, 48 and 70F of FIGS. 100-105, 70G of FIGS. 119-120, 70H of FIGS. 121-122 and 76L of FIG. 123) embodiments usable for well construction, the fluid mixtures (38), for example foam cement, reservoir cleanup fluids, proppant fracture fluids, or fresh water for salt dissolution, are placeable with a managed pressure conduit assembly (49) with one or more slurry passageway apparatuses (58), functioning as a manifold crossovers (23), left in place. In addition, the innermost concentric conduit string (50) and other conduit strings (39, 51) are engagable with an adapted chamber junction crossover (21 of FIGS. 43-44, 117-123) member, which controls separate simultaneously flowing streams of varying velocity with bore selector (47, 47A) members. Various managed pressure conduit assembly (49) with one or more slurry passageway apparatuses (58), functioning as a manifold crossovers (23), are combinable with various other member apparatus and can become manifold string members once engaged with the wellhead (7) and/or valve tree (10, 10A), and the well formation phase ends.

Any fluid mixture (38) of liquid, gas and/or solids, that is capable of being transported through simultaneously flowing fluid streams within subterranean conduits at various velocities, can be usable within passageway members of a manifold string. For example, subterranean fluid mixtures (38), produced fluids, and injected waste fluid mixtures (38), can pass through the upper end of a wellhead (7) and flow through a manifold string (70, 76) in the same, or contrary, directional orientation. Such orientations can include axially upward (34) flow for production and axially downward (31) flow for processing or injected disposal through concentric passageways (24, 24A, 25, 26) and/or through (32, 33, 35, 37) a radial passageway (75) at varying velocities. Flow controlling members can control flow through the innermost passageway (25), innermost passageway connector (26), and/or at least one concentric passageway (24, 24A, 24B) for urging the fluid mixture (38) from, or to, a proximal region of one or more subterranean wells, through a single main bore (6).

Manifold crossovers (23, 58) can have at least one radial passageway (75) to divert at least a portion of a fluid stream directly (32), or indirectly (35) through another integral or commingled stream passageway, to the innermost passageway (25, 26, 53). Alternatively, the manifold crossovers can have at least one radial passageway (75) to divert at least a portion of the fluid stream directly (33), or indirectly (37) through another integral or commingled passageway, to at least one concentric passageway (24, 24A, 24B, 54, 55), while blocking all or allowing a portion of a flow stream to continue axially upward (34) and/or downward (31), dependent on the use and the fluid mixture being urged, for example simultaneous injection of a water flood and production from the water flooded reservoir.

Fluid streams flowing toward (32, 35) the innermost passageway (25, 26, 53) may originate directly (32) from another first passageway (24, 24A, 24B, 25, 26, 53, 54, 55) or indirectly (35) from a first passageway through a secondary integral passageway. The secondary integral passageway can comprise, for example, a manifold crossover (23Y of FIGS. 14-16 and 22-29) that comprises a divided concentric passageway, or a manifold crossover (23Z of FIGS. 117 and 118-123) that comprises an exit bore conduit (39) radial passageway (75) through the concentric passageway (24) of a chamber junction crossover (21), or a commingled chamber of a chamber junction and/or a series of manifold crossovers (23), which are oriented to commingle passageway (24, 24A, 24B, 25, 26, 53, 54) members and/or the first annular passageway (55) located between a manifold string (49, 70, 76) and the passageway through subterranean strata (52), wherein flow passes through at least one radial passageway (75) of a manifold crossover (21, 23, 58).

Fluid streams flowing toward (33, 37) a concentric passageway (24, 24A, 24B, 54) or the first annular passageway (55), may originate directly (33) from a first passageway (24, 24A, 24B, 25, 26, 53, 54, 55), or indirectly (37) from a first passageway through another secondary integral passageway or a commingled passageway (24, 24A, 24B, 25, 26, 53, 54, 55).

The velocities of continuous, blocked and/or diverted fluid streams can be selectively controlled with flow controlling members (61), which can be placed between conduits of conduit strings (2, 2A, 2B, 50, 51), for example a valve (74), or within at least one receptacle (45, 45A). The flow controlling members can be placed within a receptacle by, for example: placement of straddles (22) within a manifold crossover (23) to form velocity strings or to block a radial passageway; placement of gas lift valves (23G of FIGS. 48-49) in crossovers or side pocket mandrels to form gas lifted strings; placement of a valve tree (10, 10A) and/or one way (84) or pressure activated valves (32W of FIGS. 48-49) at the wellhead (7) or within crossovers to control larger effective diameter passageway strings usable for separation of liquids and gases; casing shoes (16) to block the first annular passageway (55) from injection (31) of a waste slurry into a strata fracture (18); and/or fluid (69 of FIGS. 26-38 and 42-45) or electric (69 of FIGS. 39, 42 and 44) motors and fluid pumps (69) that can be placeable through the innermost passageway of a manifold string.

Various preferred embodiments of a manifold string (70 of FIGS. 31 to 35 and 42 to 45) can be usable with electric or fluid driven motor and pump member (69 of FIGS. 26-29, 31-37, 38-39 and 44-45) embodiments (69A of FIGS. 26-29, 69B of FIGS. 31-37, 69C of FIGS. 38 and 69D of FIG. 39) for engagement with one or more receptacles (45, 45A), or between conduits of the manifold string (49, 70, 76), to use electrical energy and/or energy of a higher flow stream velocity or pressure to pump another lower flow velocity or pressure stream. For example, the fluid from a first flow stream (31, 32, 33, 34, 35, 36, 36A, 37) can be usable to drive a fluid turbine motor and/or positive displacement fluid motor to rotate a shaft, thus driving an associated fluid impellor pump and/or positive displacement pump to urge a second flow stream.

Various preferred embodiments of manifold string (70 of FIGS. 22-35, 42 and 44, 76 of FIG. 50-52, 76 of FIG. 123) members can be usable with a substantially water fluid mixture, that is injected axially downwards (31), while another fluid travels axially upwards (34); with examples including production during: wastewater disposal, water floods, feed water injection to subterranean steam generation, fracture propagation stimulation, brine displacement to underground storage and/or water for dissolution during solution mining.

In other preferred embodiments, manifold string (70 of FIGS. 22-35, 42-43 and 48-49, 76 of FIG. 123) members can be usable with substantially liquid fluid streams that are communicated axially upward and/or downward through a passageway member, while a substantially gas fluid stream is communicated axially upward through other passageway members. Exemplary uses include: gas lift with or without subterranean gas-liquid separation or simultaneous geothermal steam production with water injection and/or recycling of condensed steam during production.

Various preferred embodiments (70B of FIG. 42, 70D of FIGS. 48-49) can be usable with electrical, pressure activated, pulse or acoustically activated subterranean disposed flow controlling members (63, 84, 85), wherein a valve tree is usable to selectively control surface production (34), or injection (31), while passing electrical or acoustic signals through its body or annular passageways to remotely operate flow controlling members and/or for remotely activating pressure sensitive devices with pressure pulses associated with opening and closing valves of the valve tree, to selectively control at least one passageway member.

Other preferred embodiments include manifold string (70 of FIGS. 6-7, 22-35, 44-45 and 48-49) members that can be usable, for example, to separate or commingle flow streams and effectively reduce the diameter of the stream for forming a velocity string of selectable length, that can be usable to increase velocity and associated pressure in a venturi arrangement to, for example, increase production in a hydrocarbon well by using the fluid mixture's bubble point or to operate a venturi (85) or jet pump flow controlling member.

Still other preferred manifold string embodiment (70B of FIGS. 42-43 and 70D of FIGS. 48-49) members can be usable, for example, in subterranean fluid processing for reducing the pressure affecting at least one flow stream with a flow controlling member (61), or the valve tree (10, 10A), to form a higher velocity flow stream. For example, a substantially gaseous fluid mixture, comprising a higher velocity flow stream, can separate from a substantially liquid fluid mixture, comprising a lower velocity flow stream, to create a separation of liquids, gases, or combinations thereof, in hydrocarbon or geothermal wells.

In related embodiments, manifold string (70B of FIGS. 42-43 and 70D of FIGS. 48-49) members, for example, can form gas lift arrangements, for a hydrocarbon fluid mixtures of multi-phase flow, from subterranean processing which then forms a higher velocity substantially gaseous flow stream and a lower velocity substantially liquid flow stream. A portion of the higher velocity substantially gaseous flow stream can be injected into a lower velocity substantially liquid flow stream, through one or more gas lift valve flow controlling members engaged in one or more receptacles (45, 45A) at selectively controllable depths and pressures, to further urge the lower velocity fluid mixture of subterranean fluids from a subterranean reservoir than would otherwise be possible with uncontrolled multi-phase flow.

In other embodiments, waste water, from hydrocarbon or steam processing, can be injected axially downward (31) through a valve tree (10A) and into the subterranean strata through fractures, wherein energy from injection of the waste water is used to, for example, operate preferred fluid driven motor and pump (69 of FIGS. 26-29, 31-37 and 44-45) member embodiments. Alternatively, a hydrocarbon gas or a steam fluid stream can, for example, be communicated axially upward at a higher velocity, within a manifold string (70, 76), from a reservoir space or gas storage cavern, wherein the energy of the higher velocity of fluid gas expansion can be used to operate the fluid driven motor and pump (69 of FIGS. 26-29, 31-37 and 44-45) to aid the injection of fluids or to aid the extraction of lower velocity substantially liquid fluid mixtures.

Other preferred manifold string member (70C of FIG. 44, 76L of FIG. 123) embodiments are usable, for example, to place proppants during fracture propagation and for cleanout of proppants after screening out of fracture propagation, using chamber junction crossovers (21) and bore selectors (47).

Still in another embodiments, the manifold string members (76L of FIG. 123) can be usable, for example, to connect a plurality of laterally and/or vertically separated proximal subterranean regions, prior to or after passing through a single main bore and wellhead to, for example, provide a plurality of wells from a single main bore to increase the number of proppant fracture stimulations in, for example, a shale gas deposit.

Embodiments of the present invention can use any combination of conduit string (2, 2A, 2B, 39, 50, 51) members, which can extend downward through a single main bore (6) from a wellhead (7), with a main bore first conduit (71) member, comprising an inner conduit string (2, 39, 50) with an innermost passageway (25, 53), and at least a main bore second conduit (78) comprising at least another conduit string (2A, 2B, 2C, 39, 51). The other conduit string (2A, 2B, 2C, 39, 51) can be surrounded by a first annular passageway (55) with one or more intermediate annular passageways or concentric conduit passageways (24, 24A, 24B, 54) located between the innermost (25, 53) and first annular passageway (55), within a passageway through subterranean strata (52). Concentric conduit members forming the concentric passageway members or other conduits with passageways can be connected to a manifold crossover (23) member, with at least one radial-extending or radial passageway (75) member, and an innermost passageway connector (26). The innermost passageway connector (26) can communicate between passageways above (24, 24A, 24B, 25, 53, 54) and below (24, 24A, 24B, 25, 53, 54), formed by at least one conduit string (2, 2A, 2B, 39, 50, 51) member extending axially downward from the manifold crossover (23) and formable from a chamber junction (43), a chamber junction manifold (43A), a junction of wells (51A), a slurry passageway apparatus (58), and/or a combination of manifold crossover members (23 and 23A-23Z) combinable with flow controlling member(s) (61), which can be usable in combination for urging a fluid mixture (38) within a subterranean well by using simultaneously flowing fluid streams (31, 32, 33, 34, 35, 36, 36A, 37) of various velocities, to and/or from a wellhead (7).

Embodiments of a manifold string (49, 70, 76) can include a combination of member apparatuses, taken from a set of flow controlling members and configured and arranged for selectively controlling one or more fluid streams of varying velocities. Functions of the various manifold string embodiments can include selective control of one or more fluid streams of varying velocities for the construction or production of fluid mixtures of liquids, gases and/or solids, which can be injected into (31, 36), or removed from (34, 36A), one of the following: one or more proximal regions of a subterranean passageway (52) comprising a strata bore (17) and/or lined bores (3, 14, 15, 19), a storage space within underground cavern walls (1A), pore spaces of a subterranean formation or reservoir, fracture spaces of a subterranean formation or reservoir, or a member passageway and/or processing spaces within a manifold string member or containing annulus. The flow of fluid mixtures (38) through a radial passageway (75) of a manifold crossover (23), between concentric conduit strings (2, 2A, 2B, 2C, 50, 51) and at least one conduit string (2, 2A, 2B, 2C, 39, 50, 51), can be controlled with at least one flow controlling member (61) placed between the conduits of said string members. Alternatively, the flow controlling member (61) can be placed through the innermost passageway members (25, 26, 53) communicating directly to (32) said innermost passageway members from another passageway member (24, 24A, 24B, 25, 26, 53, 54, 55), or indirectly (35) from a first concentric passageway through another secondary concentric passageway. In another alternative, the flow controlling members (61) can be placed through the innermost passageway members (25, 26, 53) communicating directly to (33) a concentric passageway (24, 24A, 54, 55) from a first passageway member, or indirectly (37) from a secondary passageway member through a first passageway member. The concentric passageways can be formed within and between concentric conduit string members (2, 2A, 2B, 2C, 39, 50, 51) and/or between the manifold string and the passageway through subterranean strata (52). The fluid communication can be controlled by the arrangement of the string, manifold crossover (23) and flow controlling (61) members, which can be configurable from a set of various members for various configurations of one or more substantially hydrocarbon or substantially water wells formed from a single main bore (6) and single wellhead (7) or valve tree (10, 10A), that is engaged to the wellhead.

BRIEF DESCRIPTION OF THE DRAWINGS

Preferred embodiments of the invention are described below by way of example only, with reference to the accompanying drawings, in which:

FIGS. 1, 2 and 3 depict conventional hydrocarbon/water, solution mining/underground storage wells and a wireline rig, respectively, with a reconfigured arrangement forming an embodiment of the present invention shown under FIG. 1.

FIGS. 4, 5 and 5A depict prior art diagrams of hydrocarbon pressure flow rate, bubble point, and sandface pressure versus mass rate functions, respectively.

FIGS. 6 to 7 illustrate an embodiment of a manifold string arranged to selectively vary the length of an internal velocity string.

FIGS. 8 to 19 and 20 to 21, depict various embodiments of a manifold crossover and adapted chamber junction usable with manifold crossovers, respectively.

FIGS. 22 to 25 show the manifold crossover members of FIG. 10 to 13 or 14-16 with a blocking flow controlling member installed within an internal receptacle.

FIGS. 26 to 29 illustrate an embodiment of a fluid motor and pump flow controlling member engaged within the manifold crossover of FIGS. 10 to 16.

FIGS. 40, 41 and 46-47 depict a conventional waste disposal well, hydrocarbon separation and gas lift arrangements, respectively.

FIGS. 42 to 45 and 48 to 52 depict various embodiments within a manifold string member set.

FIG. 53 shows a subsea wellhead and chamber junction arrangement usable with the manifold string of FIG. 59.

FIGS. 54 to 57 illustrate embodiments of a manifold crossover with radial passageways usable to convert the chamber junction of FIG. 58 to the manifold string of FIG. 59.

FIGS. 58 to 59 depict a chamber junction and a manifold string member embodiment, respectively, formed by adapting the chamber junction of FIG. 58 with the manifold crossover member of FIGS. 54 to 57.

FIGS. 60 to 61 and FIGS. 62 to 66, show a chamber junction and manifold string member embodiment adapted from said chamber junction, respectively, and usable for simultaneous injection and production.

FIGS. 67, 67A and 68 illustrate various valve flow controlling member and crossover member arrangement embodiments, used in various manifold string members, usable with still other members of the set of manifold string members.

FIGS. 69 to 75 depict various embodiments of manifold crossover members usable with adapted chamber junctions to form manifold siring members.

FIGS. 76 to 80 show an adapted chamber junction member usable with the manifold crossover member of FIGS. 73 to 75.

FIG. 81 illustrates a conduit member usable between the manifold crossover of FIGS. 73 to 75 and the adapted chamber junction of FIGS. 76 to 80.

FIG. 82 depicts an embodiment of a manifold string member, formed by combining the member parts of FIGS. 73 to 81, usable with other members to form the embodiment of FIGS. 106-116.

FIGS. 106 to 116, illustrate an embodiment of a junction of wells manifold string for a plurality of wells from a single main bore.

FIGS. 117, 118 and 119 to 122 illustrate a chamber junction crossover, bore selector and various manifold string member embodiments, respectively, usable for accessing different concentric passageways from the innermost passageway.

FIG. 123 shows an embodiment of a diagrammatic manifold string member, with a plurality of wells extending from a junction of wells, configurable to control flow streams in hydrocarbon, water and/or underground storage wells simultaneously to perform various well formation, operation and/or processing functions.

Figures 30, 31, 32, 33, 34, 35, 36, 37, 38, 39:
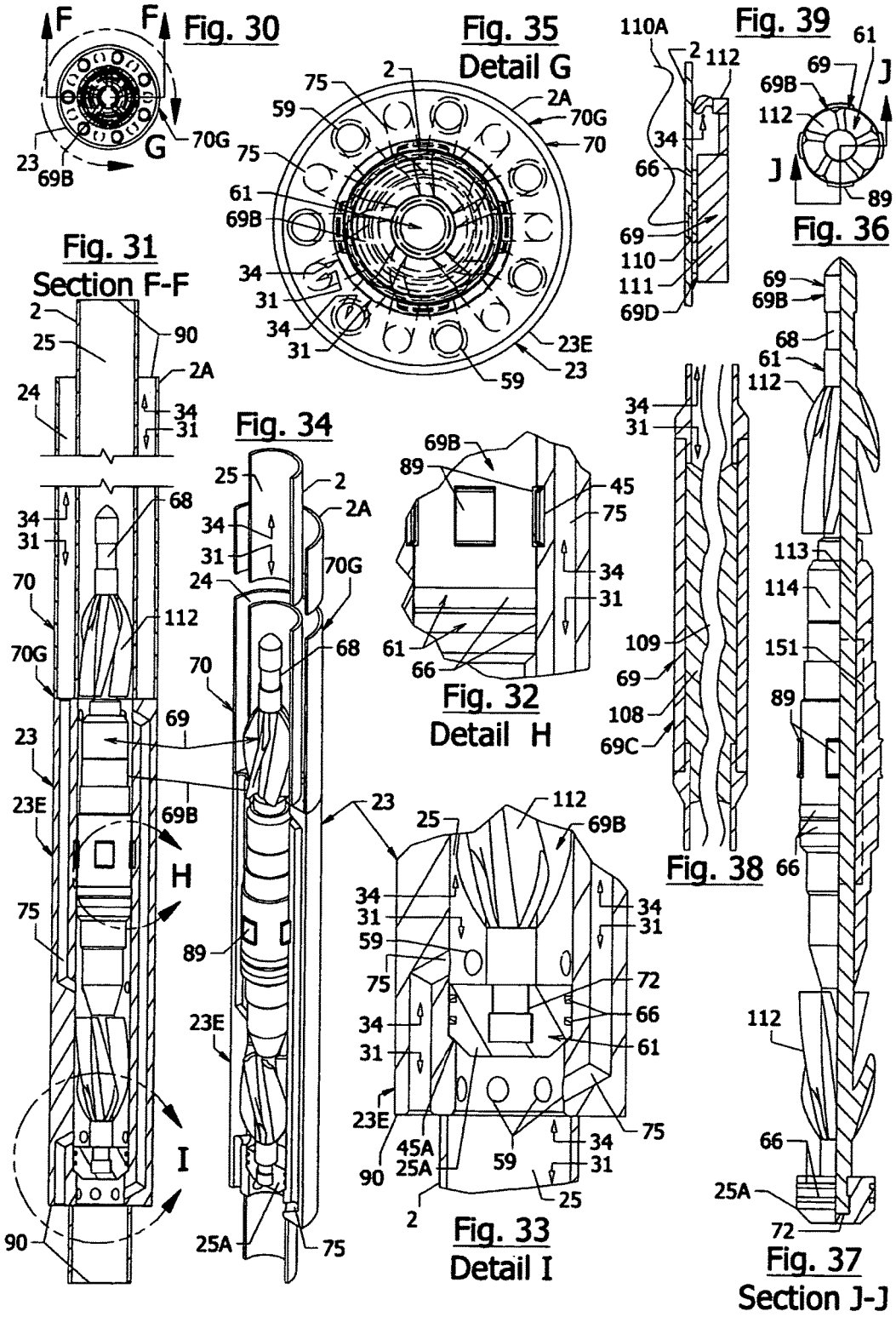
FIGS. 30 to 35 depict the fluid motor and pump flow controlling member of FIGS. 36 to 37 disposed within an embodiment of a manifold crossover.
FIGS. 36 to 37 show an embodiment of a fluid motor and pump flow controlling member.
FIGS. 38 to 39 illustrate alternative motor and pump member arrangements usable in an embodiment of a fluid motor and pump flow controlling member.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Referring now to FIGS. 1 to 5, various conventional well configurations and fluid dynamic methodical functions for substantially hydrocarbons and/or substantially water fluid mixtures that can be injected into or produced from a reservoir, are depicted. The fluid mixtures also can be injected into or produced from underground storage or salt dissolution spaces using conventional single flow systems in addition to simultaneously flowing fluid streams and various well configurations.

Despite the use of conventional apparatus between hydrocarbon, water and under storage wells, very few practical applications relating to the use of simultaneously flowing fluids, used during solution mining and/or operation of an underground storage cavern, have been adopted by hydrocarbon well artisans.

Growth in demand and decreases in the economic return and size of conventional discoveries have increased the need for new technologies, which are usable to increase the volume of hydrocarbons recovered from both conventional and unconventional reservoirs, for example tar sands and shale gas reservoirs. Innovations in the use of separately and simultaneously flowing fluid streams, of varying velocity, to enhance production, dispose of wastes, and/or to perform underground storage are becoming more economically applicable to hydrocarbons, thereby increasing the applicability of developing off-the-shelf well construction, production, injection and processing members of a compatible set, which are analogous to building blocks and combinable in various arrangements, configurations, and/or orientations to enhance substantially hydrocarbon and substantially water operations, such as geothermal, waste disposal, solution mining, and storage, well operations.

Additionally, large scale hydrocarbon tar sands and shale gas reservoirs are currently considered unconventional sources, due to the difficulties in developing such reserves with current technology. However, embodiments of the present invention provide technologies for increasing the efficiency of heat transfer and fracture propagation, below a single main bore, to decrease the viscosity or to increase the effective permeability of unconventional tar sand and shale gas reservoirs, thereby further justifying development of off-the-shelf simultaneous flow stream technology to transition such reserves into a conventional reserves category.

FIGS. 1 and 2 depict an elevation diagrammatic cross section view of a conventional subterranean well, that can be usable for hydrocarbon/water/storage and solution mining wells, respectively. The Figures illustrate conventional flow control devices in addition to presenting flow controlling members of a manifold string member set, comprising a wellhead (7) and valve tree (10) with surface valves (64) engaged to casings (3, 14, 15) that extend through a bore through strata (17) and, together, comprise a passageway through subterranean strata (52). A manifold string embodiment (70M of FIG. 1) can be formed by adapting the conventional well depicted at the top of FIG. 1 and is illustrated with a process diagram at the bottom of FIG. 1.

Manifold string embodiments (70P of FIGS. 1 and 70N of FIG. 2) can be formed by adapting the conventional wells of FIG. 1 and FIG. 2 with the addition of a flow controlling member (21 of FIGS. 117-122). A similar completion (2, 40, 61, 10) to FIG. 1 is commonly used after the solution mining (1) configuration of FIG. 2 is removed for underground storage within the walls of a salt cavern (1A).

Where conventional practice for applications involving apparatus, such as sliding side doors (123), jet pumps (85), frac sleeves and gas lift valves, may form simultaneously flowing fluid streams, the applications of such practices across various well types are limited; and therefore, prevent standardization of a member set of apparatus and methods, usable to form readily available off-the-shelf applications that are coveted by well construction practitioners and operators.

Embodiments of the present invention can be combined with conventional apparatus. For example, a valve tree (10A of FIG. 2), jet pump (85) and concentric conduit (2A or 3), that is suited for simultaneously flowing fluid mixtures (38) and circulating water with a pump (116), are usable to form the member embodiment (70M) of FIG. 1 or the member embodiment (70N) of FIG. 2, along with the addition of a chamber junction manifold crossover (21) embodiment to the well.

Generally, for the hydrocarbon, water, and storage wells depicted in FIGS. 1 and 2, flow streams of approximately the same velocity, using mono-bore strings and/or completions of approximately the same internal diameter, that are conducive with common flow stream velocities, occur through the innermost tubing string (2) passageway (25), controlled by a subterranean valve (74) in instances where escape of subterranean pressures is a risk, as shown in FIG. 1.

FIG. 1, shows the subterranean valve (74) and packer (40) flow controlling members (61) controlling the adjacent concentric passageways (24, 54) with a sliding side door (123) or a jet pump (85) controlling communication between the passageways (24, 54) and the casing shoes (16). The sealed annular spaces can be monitored with annuli gauges (13) to confirm well pressure integrity, between a fluid mixture (38) entering or exiting the tubing at the well's lower end and exiting (34) or being injected (31) into the valve tree (10) at the well upper end. The concentric passageways (54) are not generally designed for continuous flow of production or injected fluids, except in special instances, such as the using of a sliding side door (123) to change annulus fluids, the supply of jet pump (85) water, or in instances later described in FIGS. 40-41 and 46-47.

The conventional jet pump reconfiguration of the FIG. 1 well, uses the annulus between the tubing (2) and the final cemented casing (3) to provide water for a venturi (85) (referred to as a jet pump), that is placed within the tubing. When using a conventional jet pump, the utility of this approach may be limited as, water combined with the produced fluid mixture (38) stream and must later be removed. However, the depicted embodiments (70M, 70P) form separate flow stream velocities in singular flow stream applications, such as velocity strings of selectively controllable length, and/or forms a plurality of separate flow streams, for example in jet pump applications and downhole processing.

Embodiments of the present invention include, jet pump applications that form separate simultaneously flowing fluid streams of varying velocity to urge production. For example, the manifold string member (70M) embodiment, depicted at the bottom of FIG. 1, is formed using the final cemented casing (3) and valve tree (10) of FIG. 1, or the valve tree (10A) of FIG. 2 and associated wellhead (7), for inclusion of a concentric string (2A) between the tubing (2) and the final cemented casing (3). This forms a circulation pathway between the concentric string member (2A), or final cemented casing member (3) and the inner string (2) member, to form a pumped (116) closed system with a high-velocity, continuously-circulated, flow stream connected, via a venturi (85), to the tubing (2). A portion of the production is sucked from the tubing (2) to create a vacuum venturi effect for removing hydrostatic pressure from a first produced fluid mixture flow stream to further urge its production (34), while urging a second flow stream produced with pumped (116) water and separated at a circulating system tank. The circulating tank separates the portion of second flow stream produced fluid mixture into a liquid stream (119), that is taken from between the water contact (117) and the liquid contact (118). In addition, a gas stream (120) can be taken from the circulation tank upper end. The circulating fluid may be reused or replaced, with the circulated liquid typically being treated water, other mixtures of liquids, gases and/or solids as applicable.

Traditionally, jet pumps are generally used in water flooded or sweep reservoir applications with high water cuts, wherein water handling facilities limit their application. However, embodiments of the present invention can include vacuuming the hydrocarbon portion of the production with a device, such as the venturi, so that later separation of the fluids within the circulating tank will be generally small, as will be the impact of limited water handling facilities.

The arrangement of apparatus in FIG. 1 can also be applicable to underground storage wells, wherein the final cemented casing (3) shoe (16) can be a flow controlling member for products stored within the cavern walls (1A). A manifold string member (70P) embodiment can be formed with the addition of a chamber junction crossover (21) member and associated conduit (2, 2A) members, that can be usable to selectively access and flow separate, simultaneous fluid streams of gravity-separated products, such as crude oil and liquid natural gas (LNG), that is floating above the oil and brine within a salt cavern walls (1A). The separate and simultaneous flow streams can be used to selectively displace the gravity-separated products within the cavern by selectively placing a bore selector within a selected chamber junction crossover (21) coinciding with the depth of the selected gravity-separated product.

As depicted in FIG. 2, conventional solution mining configurations are not capable of performing a subterranean manifold function of selective control of simultaneously flowing fluid streams, as an innermost leaching string (2) freely hangs within an outer leaching string (2A) without a crossover radial passageway or the ability to selectively direct and/or re-direct flow streams. Simultaneous flow streams for the conventional configuration shown consist of injecting (31) water and extracting (34) brine, wherein the injection (31) or extraction (34) may occur through the innermost string (2) passageway (25) with contrary flow orientations within the concentric passageway (24), or vice versa. A leaching cushion or blanket of hydrocarbons or inert gases, such as nitrogen or diesel, is generally communicated through the first annular passageway (55) to control salt dissolution axially upward.

In conventional applications, simultaneously flowing streams within the subterranean cavern space, that is being solution mined using a salt dissolution process, are restricted to injection (31) of a salt inert cushion fluid and water with production (34) of salt saturated brine from, and into, the innermost passageway (25) and concentric passageway (24, 54). Flow into the innermost passageway (25) from the concentric passageway (24), and vice versa, is not possible without first passing through the first annular passageway (55).

Conventional practice does not provide communication between concentric passageways (24, 25) without first entering the first annular passageway, and only innermost string (2) depth may be adjusted with a large hoisting capacity rig being required to remove and rearrange both conduit strings (2, 2A) to affect water exit and brine entry depths. Conversely, a manifold string member (70N) embodiment, having one or more manifold crossovers (for example 21 of FIGS. 117-122), can be usable to selectively control simultaneously flowing fluid streams, between the innermost and concentric passageways, by placing straddles and plugs to isolate and divert fluid through one or more radial passageways without cutting or removing conduit strings with a large hoisting capacity rig.

After solution mining the well, a completion (2, 40, 74 and 10 of FIG. 1) can be installed to form an underground storage well through the final cemented casing (3), once the dual string (2 and 2A) arrangement used to enlarge the space within the cavern walls (dashed lines 1A of FIGS. 1 and 2) using a salt dissolution process, is removed. This salt dissolution process includes the use of a leaching valve tree (10A) to inject (31) water for producing (34) a substantially water brine, that comprises liquid water and solid salt dissolved within a fluid mixture (38), to enlarge the space within the cavern walls (1A), formed in the salt deposits (5) that are disposed within the subterranean regions. A member embodiment manifold string (70N) with free hanging conduit string members (2, 2A), that are engaged with chamber junction crossovers (21) can be usable to prevent the need to remove the outer leaching string for adjustment of solution mining operations. A valve tree (10A) with associated wellhead (7), that can support concentric conduit string members (2, 2A), together with a chamber junction manifold crossover (21), can be usable to access different specific gravity products stored in a cavern and naturally separated by gravity where the manifold string (70P of FIG. 1) with a production packer (40 of FIG. 1) and subsurface valve (74 of FIG. 1) replaces the conventional solution mining configuration or manifold string (70N).

Referring now to FIG. 3, a conventional wireline rig (4A) is shown, that can be usable to selectively place flow controlling members, for reconfiguring a manifold string member arrangement, or to physically reconfigure a manifold string member using rotary cable tools. The rotary cable tools can be conveyed, for example, through a valve tree (10) and wellhead (7) for placement within the innermost passageway or innermost passageway connector of a manifold string. In addition, FIG. 3 shows closable surface valves (64) engagable to a blow out preventer (9) and lubricator (8), that can be separated to place flow controlling members within the lubricator. Then, the valves can be opened while a wire or cable (11), that is passing through a pressure containing stuffing box or grease injector head at the upper end of the lubricator provides pressure containment, with flow controlling apparatuses lowered or hoisted (12) with a winching apparatus for placement within the passageways through subterranean strata (52 of FIGS. 1-2).

Any form of rig (4), comprising, for example, a coiled tubing unit or drilling rig, using continuous or jointed conduit-in-conduit operations, are usable to convey flow-controlling members within a manifold string. During well construction, when, for example, a managed pressure conduit assembly (49 of FIGS. 100-105) functions as a manifold string member, placed through a drilling rig blow out preventer, that can be used to control the first annular passageway (55 of FIGS. 1-2), until the manifold string may be engaged to the wellhead (7), for controlling the annular passageways (24, 24A of FIGS. 1-2), with a surface valve (64) tree installed later for controlling inner passageways and engagement with a slickline rig (4A). A fluid mixture, referred to as drilling mud, can pass through a drilling rig riser to a bell nipple where circulated drilling mud returns after passing through the string and drilling rig blow out preventer. A drilling rig diverter may perform a similar fluid control function as a stuff box, should the drilling mud fail to contain subterranean pressures. Similar to the wireline rig (4A), a drilling rig (4) can be usable to place a manifold string or flow controlling device by using a drawworks to hoist (12) a cable (11), passing through the crown block of a derrick for placement within the passageway through subterranean strata (52). The manifold string can be used to selectively control a fluid mixture of drilling mud, cement and proppant fracture liquids and solids or other construction fluid mixtures, that are simultaneously flowing through an innermost passageway and concentric passageway.

Embodiments of the present invention provide at least one direct crossover through a radial passageway, between the innermost passageway (25) and one of concentric passageways (24, 24A, 54), with or without first passing through an adjacent concentric passageway (24, 24A, 54) or the first annular passageway (55), wherein a flow controlling member selectively affects fluid communication through the radial passageway using, for example, a valve tree (10A) or standpipe manifold to affect fluid velocity and associated pressure within one or more of the passageways (24, 25). This selective control of the velocities and associated pressures within the passageways can be used to, for example, construct a well and/or provide production simulation similar to a velocity string or subterranean processing, for the purpose of separating hydrocarbon gas so that such gas may be used to gas lift one or more the remaining passageways of a substantially liquid flow stream at selected depths and pressures, thus further enhancing production.

FIG. 4, shows a chart depicting exemplary relationships present within a prior art velocity string, explanatory of a flowing bottom hole pressure versus a flow rate method function chart for hydrocarbon flow. The bottom hole pressure increases upward along the vertical axis of the chart, and flow rate increases to the right along the horizontal axis of the chart. Over the life of a hydrocarbon reservoir, the pressure function (F1, F2, F3) of flow rate versus flowing bottom-hole pressure decreases from F1 to F3 as the reservoir pressure depletes. The diameter of a production string (2 of FIG. 1) affects the velocity and the associated frictional resistance and pressure, determining where the minimum unaided flow rate (P1, P4) occurs, which can be compared to the critical flow rate (P2, P3), that is associated with the bubble point of gas within the hydrocarbon fluid mixture, described by functions F4 and F5.

When a well is initially constructed, the economic decision between installation of a larger diameter string (F5) and a smaller diameter velocity string (F4) must be made by comparing the initial flow rate (FR1) and final flow rate (FR3) of the larger diameter string to the lower initial flow rate (F2) and higher final flow rate (F4) of the velocity string, relative to reservoir pressure depletion and natural flow.

As the economics of replacing the larger diameter production string (F5) with a smaller diameter production string (F4) for a depleted reservoir are often unfavourable, the lower flow rates of the larger string (FR3) may be accepted over the higher potential flow rates (FR4) of a velocity string.

Manifold string members usable within the scope of the present disclosure can provide a means to follow the flow rates from FR1 to FR2 with a large diameter string, followed by wireline rig (4A of FIG. 3) intervention to selectively place flow controlling members to adjust the effective diameter of the producing string at the flow rate FR5, by diverting all or a portion of production through one or more manifold crossovers. Through repeated wireline intervention, the velocity string function between F5 and F4 may be followed to produce hydrocarbons at a higher rate without the need to remove the producing string.

Referring now to FIG. 5, an example of a hydrocarbon liquid, gas phase explanatory pressure versus temperature functional chart is shown. The chart shows pressure increasing upward along the vertical axis and temperature increasing to the right along the horizontal axis. The chart of FIG. 5 includes a bubble point curve 1 function of a more liquid fluid mixture (F6) and a bubble point curve 2 for a more gaseous fluid mixture (F7) intersecting a vertical line of constant temperature at point C. The bubble point curve 1 function (F6) shows that outside the bubble curve envelope, above the critical point, an all liquid fluid mixture exists and below the critical point, outside the bubble curve envelope, an all gas fluid mixture exists. However, within the bubble curve a liquid and gas fluid mixture exists. Functions F8, F9 and F10 show 25 percent, 50 percent and 75 percent liquid fluid mixtures, respectively.

During production, as pressure exerted on the reservoir is decreased from A1 to A2 by opening the valve (64 of FIG. 1) of a surface valve tree (10 of FIG. 1), the all liquid subterranean hydrocarbon fluid mixture transitions from liquid to a mixture of liquid and gas at point A2. If it was possible to maintain temperature during extraction through the cooler subterranean strata above a reservoir, the percentage of liquid would decrease to 75% at point B on function F10.

When hydrocarbons are passed through a surface separator the fluid mixture may, for example, separate to 75% liquid at point S2 pressure and temperature. If the temperature drop, as a result of production, can be minimized to point S1 of a higher pressure, using the process of subterranean separation that uses the heat of the subterranean strata, a higher flow rate can achieved for the same 75% liquid fluid mixture. For the more gaseous fluid mixture function bubble point curve 2, the increase in pressure from S4 to S3 is more pronounced, thus, resulting in relatively higher flow rates when subterranean fluid separation is used to retain temperature.

As described, since the produced flow rate is not only a function of pressure and temperature, but also reservoir depletion and the diameter of the producing string, the ability of the present embodiments to more selectively control flowing velocities, pressures and temperatures within the manifold string is usable to better manage flow rates over the life of a well, and includes better control of thermal factors affecting flow assurance when performing subterranean fluid processing.

Additionally, a manifold string member, usable to provide subterranean separation, can also be usable to control simultaneously flowing fluid streams by gas lifting a substantially liquid flow stream with a selectively controlled and substantially gaseous flow stream, using gas lift valves between the two flow streams to further aid production using subterranean processing.

In FIG. 5A, an example of a prior art hydrocarbon sandface pressure versus mass rate function chart is shown. The Figure shows increasing pressure upward on the vertical axis and increasing mass rate to the right on the horizontal axis. F11 represents the bubble point function with function F12, extending from point P5, representing the decrease in pressure exerted on the sandface of a reservoir by opening a valve tree and flowing at rate measured by the mass of the flowing mixture.

The flowing function F13 represents a theoretical example of hydrocarbon capable of stable flow at pressure and flow rate point P6, which becomes unstable at the pressure and flow rate point P7. Thereafter, the Figure shows that stable flow cannot be achieved until reaching pressure and flow rate point P8.

As is often found in practice, the pressure exerted at the sandface of a reservoir, by the opening of a well, is critical to stable production flow and various flow rates may work better than others. Hence a practical ability to selectively change the flow configuration of a hydrocarbon production string over its life span has a value as flow velocities, pressures and temperatures change with reservoir depletion.

Prior art production methods typically focus on combinations of apparatus for single flow streams and relatively static configurations for subterranean separation, ignoring the dynamic nature of a subterranean fluid mixture flow stream of varying velocities, pressures and temperatures over the life of a well, because safety and/or economic factors typically prevent changing a production string once it is installed.

By using a set of combinable member components, embodiments of the present invention manifold string can be usable to selectively control flow streams over the life of a well with flow controlling members, that are placed between the conduits of concentric strings and/or through the innermost passageway, accounting for theoretical production or injection functions for substantially water or substantially hydrocarbon wells, such as those described in FIGS. 4 and 5. Further, embodiments including manifold strings usable with flow controlling devices placed between the conduits of the concentric strings and/or through the innermost passageway, provide practicing artisans accessibility, through the innermost passageway, to place and/or remove further flow controlling members, that can selectively control the reality of a non-linear production function, like that described in FIG. 5A, over the life of a well, without incurring the same safety or economic impacts associated with replacement of a production string.

Referring now to FIGS. 6-7, 8-16, 17-20, 21 and 22-37, manifold string and crossover members usable for changing the effective diameter and, thus, the velocity for a given flow rate over the length of a manifold string is shown.

Manifold string members with, for example, the concentric conduit crossovers (23) of FIGS. 8-16 are engagable in series or in parallel above or below other manifold crossovers (23) of FIGS. 17-20. This engagement can be used separately or in combination with, for example, an adapted chamber junction (43) of FIG. 21, wherein various flow controlling members (61) of FIGS. 22-37 can be engagable with one or more receptacles (45), and can be further combinable with other members of a manifold string member set in any combination or arrangement with matching passageway members, to selectively control a plurality of simultaneously flowing substantially hydrocarbon and/or substantially water fluid-mixture flow streams.

FIGS. 6 and 7 depict elevation cross-section and process diagrammatic views, respectively, of a member (70A)

embodiment of a manifold string (70), usable as a selectively variable length velocity string. The Figure illustrates the inner concentric string (2) and outer concentric string (2A) engaged to a wellhead (7) and valve tree (10). A series of manifold crossovers (23, 23A, 23B of FIGS. 8-9, 23C of FIG. 10, and 23Y of FIG. 14) are usable to reduce the effective diameter forming a velocity string, as described in FIG. 4, by diverting at least a portion of a flowing fluid mixture, that is flowing into (32, 35) the innermost passageway (25) or into (33, 37) the adjacent concentric passageway (24), to effect the frictional equivalent of a velocity diameter along the length of a flow stream, by selectively placing flow controlling members. The upper most manifold crossover (23A) can remove the concentric passageway member (24) from use to allow valve (74) to control production. FIG. 7 shows a valve (74), such as a safety valve, operating with a control line (79) and a valve tree (10), to provide selective control of pressures in the well for controlled production from the well.

The velocity string manifold crossover (23A) can be formed from the manifold crossover of FIGS. 8-9, wherein a portion of the concentric annular passageway (24) is permanently blocked to divert the entire fluid mixture stream (38) into the innermost passageway (25). Alternatively, the equivalent of a manifold crossover member (23A) can be formed by covering only the orifices (59 of FIG. 13) below the receptacle (45 of FIG. 13) in the manifold crossover member (23C of FIG. 13).

Referring now to FIG. 8, a plan view with line A-A, associated with FIG. 9, of an embodiment (23B) of a manifold crossover member (23), wherein all of the innermost passageway (25) flow stream may be diverted through the radial passageway (75 of FIG. 9) to the concentric passageway member (24), if a blocking device is placed in the receptacle (45 of FIG. 9). However, only a portion of the concentric passageway (24) flow can be commingled with the innermost passageway, as through passageways are provided. These through passageway members are permanently blocked in the FIGS. 6-7 manifold crossover (23A).

A manifold crossover member (23B) of this configuration is usable, in a potentially inverted orientation to that shown in FIG. 9, at the lower end of a hydrocarbon fluid separation member space, for allowing heavier fluids to travel to the passageway member of least frictional resistance and larger effective diameter, while lighter and more gaseous fluid streams are more able to expand and travel through the higher frictional passageway member, forming two separate simultaneously flowing fluid mixture streams of varying velocities.

In FIG. 9, an elevation cross-section view along line A-A, showing the manifold crossover (23B) member of FIG. 8 is depicted. The Figure illustrates, portions of the concentric passageway (24) that are blocked by the wall (75A, shown in FIGS. 8 and 9) of the radial passageway (75), in fluid communication between the innermost passageway (25) and the concentric passageway (24), which is between the innermost string (2) and adjacent concentric string (2A) with ends (90) engagable to other conduits of a manifold string members. The crossover may be oriented as shown or rotated, wherein the radial passageway slopes downward and inward instead of upward and inward.

Fluid mixtures may be injected (31) or produced (34) through any passageway (24, 25), dependent on the engaged flow controlling member. If, for example, a straddle (22 of FIG. 93A) is engaged to the receptacle (45) to block the radial passageway (75) orifices (59), unidirectional or axially opposing flow orientations between passageway member flow streams can be usable to operate a well. If a choke controls the orifices (59) of the radial passageway (75) to commingle only a portion of a flow stream (32, 33) through either passageway (24, 25), then other various flow arrangements, including for example separation and/or gas lift, can be facilitated selectively by installing a plurality of manifold crossovers (23B), then selectively placing straddles and chokes to define flow of the fluid mixture stream configurations.

The manifold crossover (23B) is similar to the orifice manifold crossover (23) member at the lower end of the chamber junction crossover (21) of FIGS. 117 and 119-122, wherein the radial passageway wall (75A) is more suited for higher erosional velocities.

Referring now to FIGS. 10 and 12, plan views with lines B-B and C-C associated with FIGS. 11 and 13, respectively, of an embodiment (23C) of a manifold crossover member (23) are shown. The Figures illustrate a section line (B-B) through the concentric passageway (24) and another section line (C-C) through the radial passageway (75) wall (75A), contained between an inner concentric conduit (2) and outer concentric conduit (2A).

FIGS. 11 and 13, depict elevation cross-section views along lines B-B and C-C of FIGS. 10 and 12, respectively, showing a manifold crossover (23C). The Figures illustrate an embodiment where two flow streams can be separated, crossed-over or commingled, dependent upon the flow controlling member engaged to the receptacle (45). The injection (31) or extraction (34) of a fluid mixture may occur through either the innermost passageway (25) or the adjacent concentric passageway (24), between conduits (2, 2A) with ends (90) engagable to other conduits of manifold string members, wherein flow streams above and/or below the receptacle (45) may be crossed over through the radial passageway (75). Various flow arrangements, using various flow controlling members engaged within this manifold crossover (23C), are shown in FIGS. 22-29.

An exemplary arrangement of an engaged flow controlling member includes using a straddle to block the orifices (59) above or below the receptacle (45) for blocking the concentric passageway (24) below or above the receptacle (45), respectively, while commingling the contrary concentric passageway (24) with the innermost passageway (25). Other examples of arrangements of engaged flow controlling members includes blocking orifices (59), both above and below the receptacle (45), with a straddle to block the concentric passageway (24) while allowing the innermost passageway (25) flow stream to flow through the bore of the straddle, or by placing a blocking flow controlling member, engaged to the receptacle (45) within the innermost passageway, to cross over flow streams between the innermost (25) and concentric (24) passageway members, as described in FIGS. 22-25.

The manifold crossover (23C), of FIGS. 10-13, compliments the chamber junction crossover (21) member, of FIGS. 117 and 119-122, by providing the ability to block all or to divert part of a flow stream that can be communicated through the concentric passageway (24). The chamber junction crossover (21 of FIGS. 117 and 119-122) can only divert to the concentric passageway. Combining these two manifold crossover members (21 and 23C) in series provides the ability to selectively block both the innermost (25) and concentric (24) passageways or to divert one to the other.

The manifold crossover (23C) of FIGS. 10-13 also compliments the manifold crossover (23Y) of FIGS. 14-16, engaged axially above or axially below the depicted manifold crossover (23C) providing the ability to block all or to divert part of a flow stream communicated through the concentric passageway (24) to the innermost passageway (25). The manifold crossover (23Y of FIGS. 14-16) can be usable to block all or to divert part of a flow stream, communicated through the concentric passageway (24) to a different concentric passageway (24A) and/or the innermost passageway (25). Combining these two manifold crossover members (23C and 23Y) in series, with an additional conduit string member (2B) placed about 23C, provides the ability to selectively block or divert a plurality of concentric passageway members (24, 24A of FIG. 14).

Referring now to FIGS. 14 and 15, isometric and magnified views are shown with detail line D and within detail line D, respectively, and dashed lines show hidden surfaces in FIG. 15, of a manifold crossover member (23) or slurry passageway (58) embodiment (23Y) that can be associated with FIG. 16. The embodiments depicted in the Figures show a crossover similar to that of FIGS. 11 to 13, with a dashed line representing an additional concentric conduit (2B or 51) or the passageway through subterranean strata (52), with an additional concentric conduit passageway (24A) if the additional conduit (2B or 51) is present, or with the first annular passageway (55) if the additional conduit (2B, 51) represented by the dashed line is not present.

Radial passageway (75) orifice (59) members can be located within the innermost passageway (25, 53), formed by the inner conduit string (2, 50). The members can be arranged similar to the manifold crossover (23C) of FIGS. 10-13, except an additional wall (82) can be placed within every other radial passageway (75) wall (75A), with an associated orifice (59A) of the concentric conduit (2A). Every other radial passageway can fluidly communicate between the concentric passageway (24, 54) or the additional concentric passageway (24A, 55) and the innermost passageway (25, 53). The arrangement of radial passageways (75) between passageway members (24, 24A, 25, 53, 54, 55) and the innermost passageway (25, 53) is similar to the chamber junction (21) manifold crossovers of FIGS. 117 and 119-122 or a slurry passageway apparatus (58), in that a radial passageway (75) passes through an adjacent concentric passageway (24, 54) to connect the innermost passageway (25, 53) directly to a non-adjacent concentric passageway (24A, 55).

FIG. 16 depicts an isometric view associated with the manifold crossover (23Y) of FIGS. 11 to 15. The Figure illustrates the apparatus without the outer concentric strings (2A, 2B of FIG. 15) to show the arrangement of radial passageways, where every other passageway communicates between the innermost passageway (25, 53) and the adjacent passageway (24, 54 of FIGS. 14-15). The remaining radial passageways (75) can be diverted, by an additional wall (82) to an orifice (59A of FIGS. 14-15) in the adjacent outer wall (2A of FIGS. 14-15), to form a direct passageway between the innermost passageway (25, 53) and the first annular passageway (55 of FIGS. 14-15), or an additional concentric passageway (24A, 54 of FIGS. 14-15) with the outer wall of the receptacle (45) protruding into, but not blocking, the concentric passageway (24, 54 of FIGS. 14-15).

Figures 75, 76, 77, 79, 80, 81, 82:
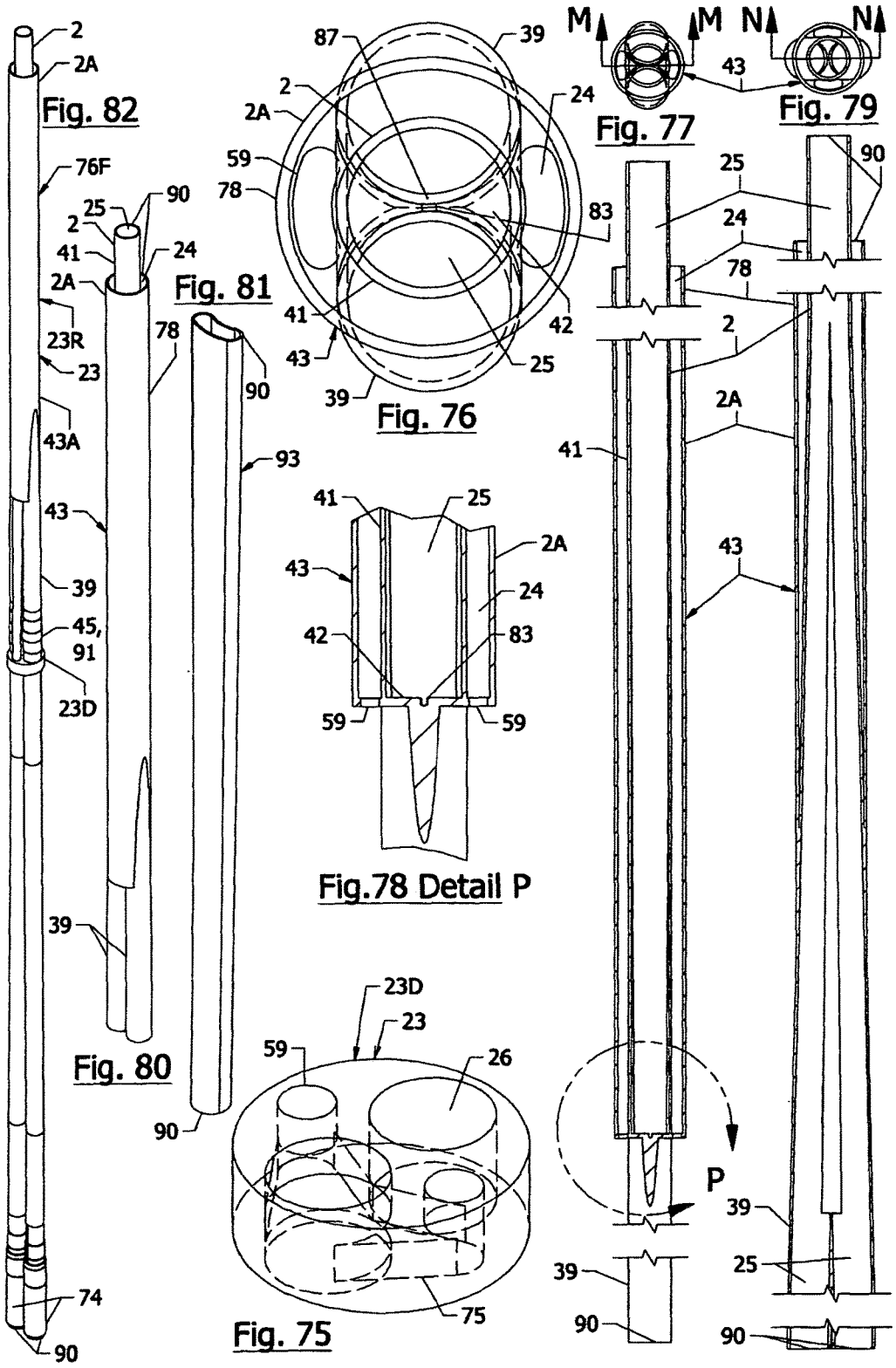

Referring now to FIGS. 17, 18 and 19: plan, elevation and isometric views, respectively, associated with FIG. 75, are shown, with dashed lines depicting hidden surfaces of an embodiment (23D) of a manifold crossover member (23). The manifold crossover member can be usable with the adapted chamber junction of FIGS. 20 and 21. The Figures show the innermost passageway connectors (26), engagable between, for example, exit bore conduits (39 of FIGS. 20-21) and conduits continuing the innermost passageway (25 of FIGS. 20-21) of each exit bore conduit. The Figures include two radial passageways (75), between the left innermost passageway connector (26), which can fluidly communicate with two orifices (59) of the manifold crossover (23D), engagable to the orifices (59B of FIG. 20) of the concentric passageway (24 of FIG. 20) located between the inner concentric conduit (2 of FIG. 20) and an outer concentric conduit (2A of FIG. 20). An example of an analogous arrangement is shown in FIG. 82.

Straddles may be placed across one or both of the radial passageways (75) to prevent radial flow. Alternatively, a plug may be placed within the left innermost passageway connector (26) to urge radial passageway flow. The orifices (59) can be engaged to the same concentric passageway (24 or 24A of FIGS. 15 and 20) or to different concentric passageways (24 and 24A of FIGS. 15 and 20) to allow simultaneous flow into (32, 35) the innermost passageway members (26 and 25 of FIGS. 19-21) or into (33, 37) a concentric passageway (24, 24A of FIGS. 15 and 20), for injection or production through either the innermost passageways or the concentric passageways.

FIGS. 20 and 21 depict plan and isometric views of an adapted chamber junction (43), usable to form a manifold crossover member (23) when combined, for example, with the manifold crossover (23D) of FIGS. 17 to 19. The Figures depict an inner concentric string member (2) within an outer concentric string member (2A), forming a chamber wall (41) and additional single main bore conduit (78) with orifices (59B) in the chamber junction bottom (42), for fluid communication of the concentric passageway (24). Other concentric conduits (2B shown as a dashed line) and other orifices (59C) can be added to fluidly communicate with one or more orifices (for example 59 of FIGS. 17-19) or concentric string members (for example 2, 2A and 2B of FIGS. 14 and 15) of a manifold crossover (23).

Referring now to FIGS. 22 and 24, plan views with lines B-B and C-C associated with FIGS. 23 and 25, respectively, of a manifold string member (70) embodiment (70J) are shown. The Figures depict the manifold string member (70) embodiment (70J) with a manifold crossover (23C of FIG. 10-13 or 23Y of FIGS. 14-16) and a flow controlling member (61), shown, for example, as a blocking plug (25A) installed within a receptacle (45 of FIGS. 23 and 25). The Figures illustrate the inner concentric string (2 of FIGS. 23 and 25) and outer concentric string (2A of FIGS. 23 and 25) forming a concentric passageway (24), that can be diverted by radial passageway walls (75A) to orifices in the innermost passageway member (25 of FIGS. 23 and 25).

FIGS. 23 and 25 depict elevation cross-section views along lines B-B and C-C of FIGS. 22 and 24, respectively. The Figures show a manifold string (70J), with a blocking or plug (25A) flow controlling member (61) engaged to a receptacle (45) via mandrels connectors (89) located within the manifold crossover (23C) of FIGS. 22 and 24. The ends (90) of the manifold string (70J) are engagable with other manifold string members. The plug (25A) can be placed through the innermost passageway (25) with a wireline rig (4A of FIG. 3) cable (11 of FIG. 3) and engaged to a connector (68) for hoisting (12 of FIG. 3) into, or out of, the passageway through subterranean strata (52 of FIGS. 1 and 2). After placing or removing the plug (25A), the cable engagement with the connector (68) may be disengaged.

The innermost passageway (25) of the inner concentric string (2) can be blocked by the plug (25A), forcing injection (31) or production (34) to cross from the innermost passageway (25) to (33) the concentric passageway (24) or from the adjacent concentric passageway to (32) the innermost passageway through the radial passageways (75).

Crossing over flow streams, between the innermost passageway and a concentric passageway, can be usable to, for example, form the preferred manifold crossover valve embodiment (23F) of FIGS. 42 and 44-45. In this embodiment, a subterranean valve (74 of FIGS. 42 and 44-45) can be placed on either end of the manifold crossover (23C) with a plug (25A) installed to provide selective control of each flow stream with the subterranean valves, while providing access through the innermost passageway (25) when the plug is removed. The subterranean valve can be controlled, independently, in applications were separate selective control is required or controlled together if, for example, the subterranean valve is a subsurface safety valve intended to fail safe shut.

Alternatively, the crossover over of flow streams with a flow controlling member (61) comprising, for example, a choke or a pressure-controlled valve or one way valve installed within the receptacle (45) instead of the plug (25A), can provide a space within the passageways for varying the velocity of flow streams and the associated pressures at varying subterranean depths. The temperature of the strata can be factored in when selectively reconfiguring a subterranean processing space to, for example, separate fluids and/or gas lift a substantially liquid flow stream by allowing a portion of a crossed over gas stream under the flow controlling member to enter a substantially liquid crossed-over flow stream, without the need to use conventional side pocket mandrels and gas lift valves that, in practice, are often more difficult to access than a valve placed in a nipple profile receptacle, across the innermost passageway member.

Alternatively, if the manifold string (70J) is adapted with the crossover (23Y) of FIGS. 14-16 is used instead of the manifold crossover (23C) shown in FIGS. 22-25, flow can be selectively directed into (35) the innermost passageway (25) from a non-adjacent concentric passageway (24A or 55 of FIGS. 14 and 16), or selectively directed into (37) a non-adjacent concentric passageway (24A or 55 of FIGS. 14 and 16) through the innermost passageway (25).

Referring now to FIGS. 26 to 39, apparatuses for performing rotary operations usable with other rotary cable apparatuses and methods within conduits of a manifold string (70 and 76 of FIG. 51) member over the life of a subterranean well, are shown. The Figures include a cable (11 of FIG. 3) engagable downhole motor and/or pump assembly (69) flow control device (61), that can be placeable, suspendable and retrievable via a cable hoisted with a wireline rig (4A of FIG. 3). The Figures further include an electric motor (111) or fluid motor, using, for example turbines, impellors or rotors and stators, with fluid inlets and outlets (59) associated with a radial passageway (75) located within a manifold crossover (23) for directing a first fluid mixture flow stream to act upon a fluid motor, that can be operable with differential fluid pressure or velocity of expanding or compressed gases for pumping a second fluid mixture flow stream.

As energy within any system is conserved, being neither created nor destroyed, using a manifold string to selectively place flow controlling apparatus within separate flow streams of varying velocity, can be usable to provide artisans of the art with a means to control how energy is distributed from a first simultaneously flowing fluid mixture stream to the second to, in use, better allocate available energy within the system.

Referring now to FIGS. 26 and 28, plan views with lines B-B and C-C associated with FIGS. 27 and 29, respectively, are depicted and show an embodiment (70K) of a manifold string member (70) with a manifold crossover (23C of FIGS. 10-13, 23Y of FIGS. 14-16) and concentric conduits (2, 2A) about an embodiment (69A) of a fluid motor and fluid pump (69 of FIGS. 27 and 29) flow controlling member (61 of FIGS. 27 and 29). The Figures illustrate an arrangement, usable to pump a fluid through a passageway, using the velocity and pressure of flowing fluids or gas expansion of a first flow stream to pump a second flow stream.

FIGS. 27 and 29 depict elevation cross-section views along lines B-B and C-C of FIGS. 26 and 28, respectively. The Figures show the manifold string (70K) arrangement with a motor and a fluid pump (69A) flow controlling member (61), that is engaged to a receptacle (45) with an engaging connection (89) to the manifold crossover (23C or 23Y). The Figure illustrates the inner concentric string (2) and outer concentric string (2A) forming the concentric passageway (24) and innermost passageway (25), usable to place and operate the flow controlling member (61), using the engagement (68) and a wireline rig (4A of FIG. 3) for placement. The ends (90) of the manifold string member can be engagable with other conduit members of the manifold string (70) arrangement to flow a first simultaneously flowing fluid mixture, which can be used for operating the fluid motor to pump a second simultaneously flowing fluid mixture of varying velocity.

Internal components of the fluid motor and fluid pump (69) are similar to that shown in FIGS. 36-37, with a shaft connecting two fluid rotatable devices (112), for example a turbine or an impellor that can be configured to be operated with the fluid and to pump the fluid from two separate simultaneously flowing fluid mixtures. For example, fluid injected (31) into (32 and 35) the innermost passageway (25), through a radial passageway (75) from a concentric passageway (24 and 24A of FIGS. 14-15, respectively) below the crossover (23C, 23Y), can operate a rotatable turbine (112) that is engaged with a shaft connected to another turbine (112), which can be usable to pump produced (34) fluid into (32 and 35) the innermost passageway (25), through a radial passageway (75), from a concentric passageway (24 and 24A of FIGS. 14-15, respectively) above the crossover (23C, 23Y). As an alternative example, fluid produced (34) through member passageways by natural expansion and/or subterranean pressure of a stored compressed gas or by gas entrained fluid to (33, 37) a concentric passageway (24A, 24) that flows through a radial passageway (75) from the innermost passageway (25) below the crossover (23C, 23Y), can operate the rotatable turbine (112). The rotatable turbine (112) can turn an engaged shaft connected to another turbine (112) and can be usable to pump, for example, a substantially liquid produced (34) fluid from a subterranean separation process or, for example, a substantially water fluid mixture injected (31) into a proximal region of the passageway through subterranean strata. The substantially water fluid can be used for solution mining or disposal between the innermost passageway (25) and a concentric passageway (24, 24A) through the radial passageway members (75).

Referring now to FIG. 30, a plan view with line F-F associated with FIG. 31 and detail line G associated with FIG. 35 is shown. The Figure depicts a manifold string embodiment (70G) with an embodiment (69B) of a motor and a fluid pump (69 of FIG. 31) flow controlling member (61 of FIG. 35) placed within a manifold crossover member (23) embodiment (23E of FIG. 31).

FIGS. 31 and 34 depict elevation cross-section and isometric views, respectively, along line F-F of FIG. 30. The detail lines H and I of FIG. 31 are associated with FIGS. 32 and 33, respectively, and the break line of FIG. 31 is associated with FIG. 34. FIG. 34 depicts an axial cross-section representing a portion of concentric conduits that are removed from a manifold string (70G), potentially extending to an engagement with a wellhead and/or valve tree at the upper ends (90) as shown in FIG. 31. FIGS. 31 and 34 show a motor and fluid pump (69B), placeable with the cable connector (68) and engaged within the manifold crossover (23E) receptacle (45 of FIG. 32) with engagement apparatus (89 of FIG. 32). The inner concentric string (2) and outer concentric string (2A) lower ends (90) are shown as engagable to other conduits within the passageway through subterranean strata (52 of FIGS. 42 and 44) to vertically separate subterranean proximal regions. This separation of the subterranean regions can be accomplished by using, for example a chamber junction crossover (21 of FIGS. 117 and 119-122) and/or laterally separated regions, using, for example, the chamber junction manifold crossover (23T of FIGS. 83-87) access through exit bore conduits (39 of FIGS. 83-87). This separation can be used when, for various reasons, it is desirable to keep simultaneously flowing fluid streams within the same passageway member, above and below the manifold crossover member (23E).

Within the manifold crossover (23E) embodiment, fluid mixtures of liquids, gases and/or solids may be injected (31) or produced (34) through member passageways (24, 25), wherein fluid is communicated through radial passageways (75) and orifices (59) out of a passageway (24, 25) to operate any rotatable device (112), and returning the flow stream to the originating innermost and concentric passageway members. Rotatable devices (112) are shown, for example, as a fluid motor and a fluid pump member (69B).

Referring now to FIG. 32, a magnified view of the portion of the motor and fluid pump (69B) receptacle engagement (45 and 89), within detail line H of FIG. 31, is shown. The Figure shows injection (31) and production (34) travelling through the radial passageway (75). Sealing (66) flow controlling members (61) are provided to contain the pressure of one fluid mixture stream from commingling with another.

FIG. 33 depicts a magnified view of the manifold crossover (23E). The Figure illustrates an innermost passageway, blocking, rotatable, shaft engagement member portion of the motor and fluid pump (69B) within detail line I of FIG. 31. The Figure includes a rotary connector (72) engaged in a receptacle (45A) member that is blocking (25A) the innermost passageway (25) to which a turbine (112) shaft (113 of FIG. 37) is engaged, and wherein injected (31) or extracted (34) fluid mixture, flowing within the innermost passageway, engages and operates the rotatable turbine (112), or is pumpable by the turbine, if the fluid mixture passing the associated turbine at the other end of the shaft drives the assembly. Sealing members (66 and 66 of FIG. 32) control the flow, within the innermost passageway, of the fluid mixture flowing (31, 34) above and below the plug (25A) and entering orifices (59) for flowing to the radial passageway (75) members on the right and left, to the engaging turbines (112 and 112 of FIG. 31) at opposite ends of the shaft, within the innermost passageway (25).

Other manifold string (70G of FIG. 30) conduit string members are engagable to the ends (90), wherein a plurality of concentric conduits (2, 2A) or a single conduit (2) can be usable with a concentric conduit passageway or the first annular passageway, respectively, below the manifold crossover (23E).

FIG. 35 depicts a magnified view of the portion of the manifold string (70G) motor and fluid pump arrangement (69B) within detail line G of FIG. 30. Dashed lines, showing hidden surfaces, illustrate the inner concentric string (2) and outer concentric siring (2A) between which, the flow-controlling member (61) manifold crossover (23E) alternating upper and lower orifices (59), leading to radial passageways (75), urge injection (31) and/or production (34) through the manifold crossover (23E). The flow through the manifold crossover can be used for operating a flow controlling member (61), shown in the Figure, for example, to be a fluid motor and fluid pump (69B) operated by simultaneously flowing fluid streams of various velocities and/or associated pressures.

Referring now to FIGS. 36 and 37, plan and elevation cross-section views with line J-J and along line J-J, respectively, of a flow controlling device (61), are depicted. The flow controlling device is shown comprising a motor and fluid pump (69) embodiment (69B), showing a rotatable fluid operable apparatus (112) engaged with a shaft to the apparatus (112), which can be usable to pump a fluid, shown for example, as a fluid turbine arranged to drive and be driven at the ends of a shaft (113) within a housing (114) by passing fluid. The Figures include connectors (89), engagable to associated receptacles (45 of FIG. 32), for anchoring the member flow controlling apparatus (61). In addition, blocking (25A) and/or sealing (66) apparatus members can be usable for controlling fluid within and between the innermost passageway and concentric passageway through the radial passageway members.

Any form of engagement or fluid operable components, for example a rotary connector (72) with seals (66) or bearings, races, slidable engagement components or mechanical features, such as a planetary gearing arrangements for differing upper and lower turbine or impeller rotational speeds, that is usable in a subterranean environment to operate the fluid operable motor or pump, can be usable with the present invention. The apparatus can be selectively placeable within a manifold string receptacle (45 of FIG. 32, 45A of FIG. 33), using a cable connector (68) and cable rig (4A of FIG. 3) or conduit connector and coiled tubing or drilling rig. Alternatively, the apparatus can be selectively placeable between conduits of conduit string members with such devices as a drawworks, during conventional installation. Other operable component alternatives, for example, can be formed when the innermost passageway member is fluidly communicated through the shaft with various other flow streams that can be communicated through various other concentric passageways and/or the first annular passageways, usable to operate the fluid motor and pump.

FIGS. 38 and 39 depict elevation cross-section views of alternative motor and pump arrangements for various motor and fluid pump (69) embodiments (69C, 69D, respectively). The Figures depict: a rotor (109) and stator (108) arrangement (69C), that can be operable with injection (31) or production (34) and usable to rotate a fluid pump comprising, for example, a turbine or a positive displacement rotor (109) and stator (108) pump, as shown in FIG. 38. FIG. 39 shows an electric motor (111) arrangement (69D), that can be usable with an electrical cable (110A) and fixed or sealed (66) wet connections (110), to operate any downhole fluid pump for producing (34) or injecting fluid, if the orientation is inverted. Fluid to either arrangement can be supplied by a manifold crossover through a radial passageway of a manifold string member.

As demonstrated in FIGS. 6 to 39, and later described in FIGS. 69-75 and 83-87, preferred manifold crossover (23) embodiments of the present invention provide systems and methods combinable in any configuration or orientation to selectively control separate flowing fluid streams of injection (31) and/or production (34) fluid mixtures (38) of liquid, gases and/or solids. This selective control can be achieved at varying velocities and associated pressures, selectively communicated through radial passageways (75) and orifices (59), either directly (32) or indirectly (35) into the innermost passageway members (25, 26) from another concentric passageway (24, 24A, 24B, 25, 26, 54, 55) member, and/or directly (33) or indirectly (37) into a concentric passageway (24, 24A, 24B, 55) member from the innermost passageways (25, 26) or other concentric passageways (24, 24A, 24B, 55) with selectively placed flow controlling members (61 of FIGS. 1-123) and/or flow controlling member embodiments (69A, 69B, 69C, 69D). The flow controlling members can be engaged between the conduits of an inner concentric string (2) and/or outer concentric string (2A), or conveyed, placed and/or retrieved through the innermost passageways (25, 26) and engaged to a receptacle (45, 45A). The combined manifold string (70, 76) embodiments can be usable to operate one or more substantially hydrocarbon and/or substantially water wells, from a single main bore and wellhead.

Referring now to FIGS. 40 and 41, elevation diagrammatic cross section views of prior art subterranean production and waste water disposal simultaneous flow stream application and a surface hydrocarbon fluid separation process, respectively, that together with wells described in FIGS. 1-2 and FIGS. 46-47 depict conventional processes improvable, combinable and/or replaceable with preferred embodiments of the present invention.

FIG. 40 shows a valve tree (10) engaged to a wellhead (7) with an annulus valve (81) controlling injection (31) through an annular passageway, between the intermediate (15) and final cemented casing (3) and into a fracture (18) below the casing shoe (16), which prevents upward flow within the annulus space outside the intermediate casing. The Figure shows that pressure can propagate (28) to the point of fracture propagation (30), allowing waste fluids to be disposed of within a subterranean feature. Fractures (18) may be allowed to close with stoppage of injection (31). Waste solids may act as proppants, in a similar manner to the single stage shale gas fracture stimulation at the lower end of the production tubing (2), where proppants (generally sand sized particles), are injected to hold fractures open. This opening of the fractures can maintain, for example, fluid communication throughout the fractures (18) for gas production (34), from relatively impermeable shale formations otherwise incapable of significant production. Production flow (34) controlled by a subsurface valve (74), may occur at the same time as waste injection (31) into the upper fracture (18). Alternatively, dedicated conventional waste disposal well injection (31) can occur through the valve tree (10) controlled by a surface valve (64) and the tubing (2) to the lower fracture (18) point of propagation (30) for substantially water injection wells.

FIG. 41 shows an above ground level (121) surface hydrocarbon separator (115) taking a fluid mixture (38) of liquids, gases and/or solids, which was produced (34) from the tubing conduit string (2) controlled by a subterranean valve (74), operated with a control line (79). A space of reduced pressure within the separator (115) allows a heavier specific gravity substantially water fluid stream to be pumped (116) to disposal processing. The lighter specific gravity substantially liquid hydrocarbon is shown floating (117) on the water flowing in an intermediate substantially liquid fluid flow stream (119) of hydrocarbons, with formerly compressed substantially lighter specific gravity gases expanding and exiting the upper fluid level (118), to be produced in an uppermost substantially gaseous fluid stream (120).

FIGS. 1-2, 6-7, 42-46, 48-52, 67-68 depict elevation diagrammatic cross section views of manifold string members (70, 76), wherein single well manifold string (70) arrangements are usable, individually, or in combination below a junction of wells (51A of FIG. 50). The combined manifold strings can be used to form a plurality of wells manifold string (76) members, which can be usable for subterranean processing and/or providing a plurality of fluid streams, wherein the combinable members are usable to replace one or more convention wells and/or supplement or replace conventional processing arrangements, for example those described in FIGS. 1-2, 40-41 and 46-47.

For the purposes of forming an off-the-shelf manifold string member set applicable to substantially hydrocarbon and/or substantially water wells and processing systems, members comprising, for example, conventional flow controlling members (61), that can be operable with other set members, can be usable for urging, measuring and/or selectively controlling fluid mixtures of liquid, gas and/or solids, for one or more substantially hydrocarbon wells, substantially water wells, or combinations thereof, such as combined solution mining and storage wells. Examples of such flow controlling members include: surface pumps (116), surface valves (64, 81), valve trees (10, 10A) and wellheads (7) that can be engagable to the upper end of a manifold string (70, 76) member and that are usable to control a single fluid mixture flow stream (31, 34) with a plurality of velocities and/or a plurality of fluid mixture flow streams (31, 34), with varying flow stream velocities. In addition, subterranean valves (63, 74, 84) can be used for controlling the flow of fluid mixtures in passageways (24, 24A, 25, 26, 55) members. Additional flow controlling members include downhole gauges, velocity switches, pressure activation mechanisms, acoustic or fluid-pulse signals for passing a fluid, control lines (79) and/or other selective measurement, activation and/or control means, including one way devices, surface or subterranean chokes (77), venturi (85), jet pumps (85), plugs (25A), casing shoes (16), packers (40), fracturing technologies, and/or, motor and fluid pumps (69).

FIGS. 42 and 43 depict elevation cross-section and process control diagrammatic views, respectively, of an embodiments (70B, 70L, respectively) of subterranean flowstream, separation, manifold string (70) members with a motor and fluid pump (69) flow controlling member (61), that can be used to pump separated liquids. The Figures show a manifold crossover embodiment (23F) flow controlling member (61) with a subsurface valve arrangement. The Figures include a fluid mixture (38), produced (34) through passageway members, that is separated into a plurality of simultaneous flowing fluid mixture streams controlled separately by a plurality of valves (74). For example, the subsurface fail safe shut safety valve (74) of FIG. 91, operated with a control line (79) connected in series or independently to each valve, and whereby, for example, the arrangement may be formed by engaging valves to the upper and lower ends (90) of the manifold crossover (23C or 23Y) member of FIGS. 22-25.

A check valve (84), located at the lower end of the well, controls one way flow of the fluid mixture (38) into a conduit string (2, 2A) at the lower end of the manifold string (70B, 70L), which can be produced (34) into various arrangements of passageway member spaces formed by concentric conduit string (2,2A, 2B of FIGS. 14-16, 20 and 43, 2C of FIGS. 43, 54 and 59) members, the first annular passageway (55 of FIG. 1) and/or salt cavern walls (1A of FIG. 1). A liquid interface (118) and/or water interface (117 of FIG. 43) can result from the pressure applied to, or released from, the passageway member space by a flow controlling member (61), such as the valve tree (10A), and a substantially gaseous naturally expanding flow stream (120) can be extracted (34) through a conduit (2, 2A) for urging a substantially liquid flow stream (119). Alternatively, the substantially liquid flow stream (119) can be urged by: natural subterranean pressure, a motor and fluid pump (69), a surface pump (116), an electrical submersible pump and/or other flow controlling members, through a conduit string (2, 2A, 2B) passageway or concentric passageway that can be formed between the conduit strings and/or the passageway through subterranean strata.

The depicted single well manifold string (70L), or a plurality of similar wells, stemming from, for example, the manifold string member (70F) of FIGS. 100-105, can be installable with a managed pressure conduit assembly (49) with inner (50) and outer (51) concentric conduit strings and slurry passageway fluid stream crossover tool (58) can be usable to, for example, provide larger conduit sizes than are generally practiced during well formation for subterranean separation purposes. Once engaged to the wellhead and/or tree, the managed pressure arrangement becomes a manifold string (70, 76) with concentric strings (2, 2A, 2B, 2C) and manifold crossovers (21, 23) members to perform injection or production functions, usable to configure one or more wells to separate fluid mixture streams (70L) for individual or junctions of wells (51A of FIGS. 50-52) applications similar to the manifold string (76L) of FIG. 123.

Manifold strings (70L, 76L) of FIGS. 43 and 123, respectively, are usable for separation of a fluid mixture into a plurality of simultaneously flowing fluid mixture streams from a single well, from one or more vertically and/or laterally separated subterranean regions, or from caverns where large suitable salt deposits are usable for solution mining a separation space, that can be usable for wells or a transportation pipeline. Larger separation spaces are formable with a managed pressure string of the present inventor or may be formed by various other methods, such as using subterranean separation to solution mine cavern walls (1A) with produced water or as described in methods of the present inventor, or using abundant available water sources such as the ocean. In instances where waste water is produced or readily available, the present invention can be usable to perform simultaneous production, solution mining, underground storage and/or separation of a plurality of fluid mixture streams, entering and/or leaving a subterranean space or proximal region accessed through a manifold string.

Referring now to FIGS. 44 and 45, elevation cross-section and process control diagrammatic views, respectively, of an embodiment (70C) of subterranean manifold string member (70), with selectable internal velocity string manifold crossovers (23), fracture propagation chamber junction manifold crossovers (21) and motor and fluid pump (69) flow controlling members (61) are shown. The Figures illustrate an inner concentric string (2) and outer concentric string (2A) extending downward from a wellhead (7) and valve tree (10A). During well construction, a chamber junction manifold crossover (21) can be usable to urge (28A) proppant into support fractures (18A), with, for example a shale gas or waste disposal well, through a perforated liner (19) that is cemented (20) within the strata bore (17) and engaged via a liner top packer to the final cemented casing (3), within which the manifold string (70C) is engaged with a packer (40). Later, in the well's life cycle, the manifold crossovers (23A) can be usable to reconfigure and form a velocity string to accelerate production velocity and to prevent water production from inhibiting, for example, associated hydrocarbon production.

The arrangement also can be usable to access a first annular passageway (55) through the manifold string (70C of FIGS. 44-45), to, for example, provide waste injection disposal, wherein the manifold crossover (23) that is adjacent to the shallow strata fracture (18) can be formable from various manifold crossover members, for example a chamber junction (21) and manifold crossover arrangement (23C and 23Y of FIGS. 22-25). A plug (25A of FIGS. 22-25) can be usable to crossover fluid communication of the passageways (24, 25), with the chamber junction crossover (21) usable to access the first annular passageway (55) from the inner passageway (25), whereby production from the velocity string manifold crossover (23A) flows through the concentric passageway (24) and axially upward, while waste water below a water interface (117), from surface separation (115) of the production, can be pumped (116) and injected (31) through the valve tree (10A) and chamber junction crossover (21) axially downward to operate a fluid motor and pump (69) urging production axially upward.

The manifold string (70B, 70L, 70C) arrangements of FIGS. 43-45 describe various possible arrangements for subterranean separation and subsequent waste disposal. For example, a substantially liquid flow stream (119) can be further processed and pumped (116) for disposal into an annulus shown as a dashed line in FIG. 42. Then, the flow stream (119) can be pumped through an annulus valve (81), within the annulus between the intermediate (15) and final cemented casing (3), that can be controlled by a casing shoe (16) for resisting fluid flow into an outer annulus, and injected (31) through the valve tree (10A), as shown in FIG. 44. The waste water can be disposed by pressure communicating (28) to the point of fracture propagation (30) within a subterranean strata feature. As shown in the Figures, extracted subterranean pressurized fluids, such as compressed gas, high pressure production or the injected waste fluid mixture (31 of FIG. 44), can be usable to operate the fluid motors and fluid pumps (69).

The manifold string (70L) arrangement of FIG. 43 can be usable with a chamber junction manifold crossover (21) to selectively communicate with a subterranean hydrocarbon interface (118) that is separated from a subterranean water interface (117). One or more submersible pumps (69) operated by, for example, electricity, expanding compressed gas from the separation process, or injected fluids (31 of FIG. 44), can be usable to assist selective removal of liquid hydrocarbon or water between the various interface layers. If motors and pumps are not desired, the gas stream may simply be closed in, to allow pressure to build within the well to u-tube the fluids through one or more passageway members.

Manifold string (70C) of FIGS. 44 and 45 can be usable with a chamber junction manifold crossover (21) to selectively communicate fracture propagation fluid and proppants during well formation. After which, the chamber junction manifold can be used for selective extraction from desired subterranean regions or water shut-off with, for example, gas expansion from a shale gas deposit usable to drive fluid motors and fluid pumps (69) for injecting waste fluids into the shallower strata feature shown. FIG. 44 shows a manifold valve crossover (23F) that can be adapted for use with a chamber junction and further manifold crossover (23) for selective control of fluid mixtures flow streams in the manifold string.

Figure 46:
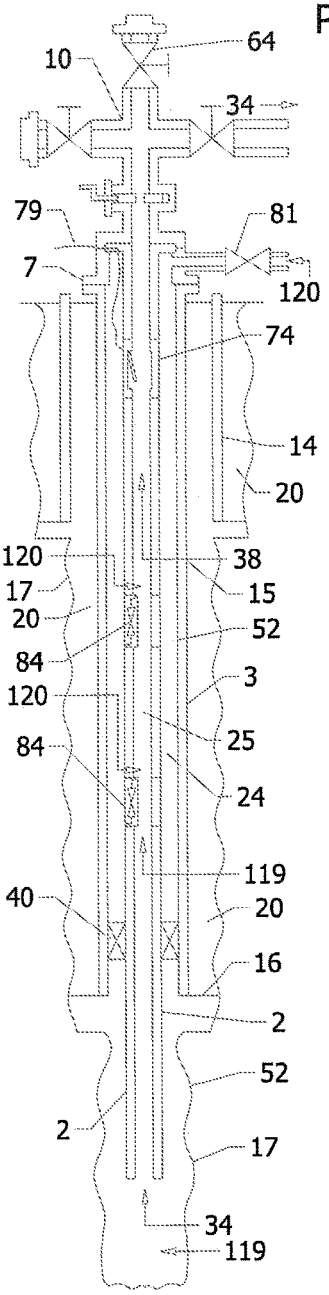
Fig. 46 Prior Art
Figure 47:
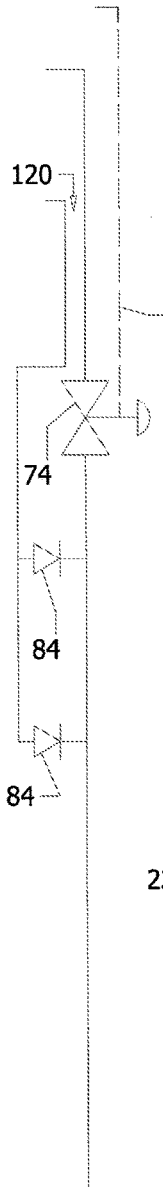
Fig. 47 Prior Art

FIGS. 46 and 47 depict elevation cross-section and process control diagrammatic views, respectively, of a prior art gas lift arrangement. The Figures show a wellhead (7) from which a fluid mixture (38) can be produced (34) through tubing (2) and a valve tree (10), wherein a substantially liquid fluid flow stream (119) can be lifted through the innermost concentric passageway (25) with the use of a substantially gas fluid stream (120). The lifting occurs by injecting the gas stream from the surface through an annulus valve (81) and into the concentric passageway (24), formed between the tubing (2) and casing (3) that is cemented (20) into the strata bore hole (17). The injection passes through the passageway through subterranean strata (52) to a gas lift valve (84), placeable through the innermost passageway (25), to create a fluid mixture of liquid and gas, thus increasing the fluid stream velocity and reducing the sandface pressure exerted on the producing formation to increase production (34) above what is possible using normal producing pressures. A subterranean fail-safe safety valve (74) can be operated with a control line (79), valve tree (10), one way gas lift valves (84) and annulus valve (81) to be usable to selectively contain subterranean pressures in the well and to urge production (34), provided surface processing and/or gas is available for lifting production.

Conventional gas lift arrangements are widespread, but require a surface supply of injectable gas that, together with the associated surface facilities, represent a significant economic and logistical hurdle for remote and/or environmentally sensitive developments. For many hydrocarbon developments, the present invention is usable to selectively control and re-inject subterranean separated gas at locations suited for extraction, wherein a surface supply of injection gas and associated surface facilities are not required.

Figure 48:
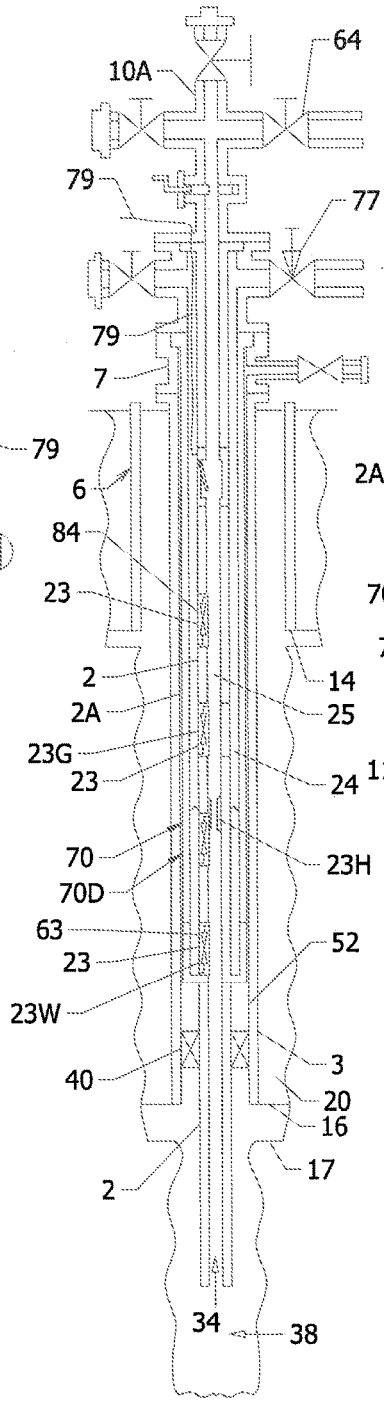
Figure 49:
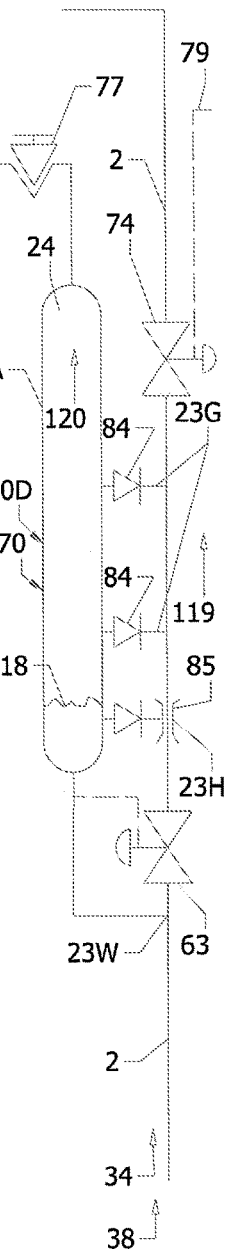

FIGS. 48 and 49 depict elevation cross-section and process control diagrammatic views, respectively, of an embodiment (70D) of a subterranean manifold string member (70), usable to separate a fluid mixture of liquid and compressed gas into substantially liquid and substantially gas fluid streams, The separated streams can be usable to selectively re-inject and to gas lift the substantially liquid flow stream, particularly where surface processing and gas injection are uneconomical and/or impractical. For example, the embodiments shown in FIGS. 48 and 49 can be used economically in remote subsea and marginal developments, that are lacking infrastructure.

A fluid mixture (38) can be produced (34) through a conduit (2), engaged by a packer (40), to the passageway through subterranean strata (52), comprising the production casing (3) cemented (20) into the strata bore (17) and conductor casing (14). The fluid mixture (38) can reach a pressure activated valve (63) that controls the radial passageway of a manifold crossover (23W) embodiment, usable with a one-way valve and venturi (85) manifold crossover (23H) embodiment to vacuum liquid from the gas lift separation space. Pressures within the concentric passageway (24) can be selectively controlled by a choke valve (77), located on the valve tree (10A), against a separated substantially gas fluid stream (120), that can be all or partially diverted through gas lift valve (84) manifold crossover (23G) embodiments to aid the lifting of a substantially liquid fluid stream (119) taken from the concentric passageway (24), below the liquid level (118) and through the venturi (85) manifold crossover (23H).

To maintain well integrity if the valve tree (10A) fails, a subterranean valve (74), operated with a control line (79), and the pressure activated valve (63) manifold crossover (23W) contain the ingress of subterranean pressurized fluid mixture (38), wherein similar to a conventional gas lifted well, only the limited inventory in the annular space is uncontained. The addition of an annular safety valve or an additional valve controlled manifold crossover (23F) usable to control both the innermost and concentric passageways can be usable to pressure contain the space, if required.

Referring now to FIGS. 50, 51 and 52, elevation diagrammatic views of various manifold string (76) plurality of wells embodiments (76A, 76B, 76C), usable with substantially hydrocarbon and substantially water wells, are shown as production/waste-fluid-injection, water-flood and solution mined/storage wells, respectively, using a junction of wells (51A) with a plurality of wells extending downward from a single main bore (6) and wellhead (7). The plurality of wells may access subterranean injection features (103), relatively horizontal or folded (94) reservoirs (95), and salt deposits (5) disposed between subterranean formations (106).

Manifold string (76A, 76B) member arrangements of hydrocarbon or geothermal wells, usable for water or produced water disposal and water floods, can inject water into a feature (103) or relatively horizontal water drive (104) reservoir, while producing from a folded (94), faulted, fractured and/or water driven reservoir using one or more of a plurality of wells to dispose of waste water and/or to increase reservoir pressure for production of hydrocarbons or steam from a geothermal reservoir.

Manifold string (76C) member arrangements can be usable for solution mining and selective access of gravity separated hydrocarbon products within the space of cavern walls (1A) of a salt deposit (5), that is sealed at its upper end by the final cemented casing (3) and casing shoe (16). Solution mining of a cavern space may use ocean, waste or produced water from various other embodiments. Substantially hydrocarbon fluid mixtures of liquids, gases, and/or solids from wells or pipelines can be separated, stored and/or selectively accessed within a cavern space with the use of manifold crossovers selectively flowing different fluid mixtures from between specific gravity separated fluid levels (105), using, for example, a chamber junction manifold crossovers (21). Substantially water fluids sinking to the lower level (104) are usable to simultaneously displace storage, increase cavern pressure and/or solution mine the space.

Referring now to FIGS. 53 to 59, wherein methods and apparatus shown in FIGS. 53 and 58 are adaptable with the manifold crossover (23J) of FIGS. 54-57 to form the manifold string (76K) of FIG. 59, to complete the subsea well of FIG. 53.

FIG. 53 depicts an elevation cross-section view of a subsea wellhead (7), positioned above the sea floor (122), that can be usable with manifold strings (70A, 70B, 70C) of FIGS. 50-52 and the adapted chamber junction manifold crossover of FIG. 59. The Figure shows subsea connectors (107), a wellhead (7) and a single main bore (6), that is located within a strata formation (106) and which comprises a chamber junction (43) engaged to the wellhead, with exit bores extending to the well's lower end. The ends (90) of the exit bore conduits (39) can be engaged to a plurality of wells.

Referring now to FIGS. 54 and 55, a plan above an elevation view is shown, with dashed lines showing hidden surfaces of a manifold crossover (23) embodiment (23J). Figure 54 depicts innermost passageway connectors (26), usable to connect the innermost passageway above and below the manifold crossover with the radial passageways (75), to fluidly communicate with orifices (59) that can be connected to a concentric passageway. As shown in the Figures, receptacles (45) can be used to selectively control the innermost passageway and/or radial passageway with a flow controlling member, for example, with as a straddle (22 of FIG. 93A) or plug (25A of FIG. 93) placed through the innermost passageway and engaged with the receptacle. A plurality of concentric conduits (2A, 2B, 2C of FIGS. 54 and 59) can be usable to form a plurality of concentric conduit passageways for connection to one or more of the orifices (59), from a radial passageway (75).

FIGS. 56 and 57 depict an isometric view with line K and a magnified view within line K, respectively, showing a cut-out section of the manifold crossover (23J) of FIG. 54. The Figures depict orifices (59) of the radial passageway (75) and receptacles (45), that can be usable for selective engagement of flow controlling members to control the flow of fluid mixture streams.

Referring now to FIGS. 54-57, concentric passageways (24, 24A, 24B, 25, 26, 53, 54, 55) can be formed between concentric conduits (2, 2A, 2B, 2C, 50, 51) and the passageway through subterranean strata (52 of FIG. 53), and each orifice can be configurable to individually access a different concentric passageway (24, 24A, 24B). Flow streams can flow into (32, 35) the innermost passageway, directly (32), from a first concentric passageway or, indirectly (35), from a first concentric passageway through another secondary concentric passageway. Alternatively, flow streams can flow into (33, 37) the concentric passageway through an orifice (59), either directly (33) or indirectly (37) from a first concentric passageway or from a first concentric passageway through a secondary concentric passageway. This allows any configuration or flow orientation between passageways with a plurality of manifold crossovers (23J), which can be engaged in series with the orientation of the radial passageway that can be changed, for example, by reversing or turning over one of the manifold crossovers. The orifices (59) can be connected to form fluid communication between the passageway members, and the orifices can be engagable to a plurality of concentric passageway members (25, 24, 24A, 24B, 55), within and between an innermost conduit (2) and a plurality of concentric conduit (2A, 2B, 2C) strings and the passageway through subterranean strata (52).

Referring now to FIGS. 58 and 59, isometric views of a chamber junction manifold (43A) and manifold string embodiment (76K), respectively, are shown. The chamber junction manifold (43A) comprises a chamber wall (41) with engaged (44) exit bore conduits (39), that can be controlled by valves (74) and seal stacks (66) that can be engagable to another chamber junction (43 of FIG. 54). The chamber junction shown in FIGS. 58 and 59 includes a landing plate (67) and indexing key (65). The chamber junction manifold (43A) can be adapted with a plurality of concentric strings (2, 2A, 2B, 2C) and a manifold crossover (23K) of FIG. 59 for replacing the valve (74) arrangement of FIG. 58. The manifold string (76K) shown in FIG. 59 and formed by the adaptation, can be usable to selectively control a plurality of simultaneously flowing fluid streams, when placed, for example, in the subsea well of FIG. 53.

Figures 60, 61, 62, 63, 64, 65:
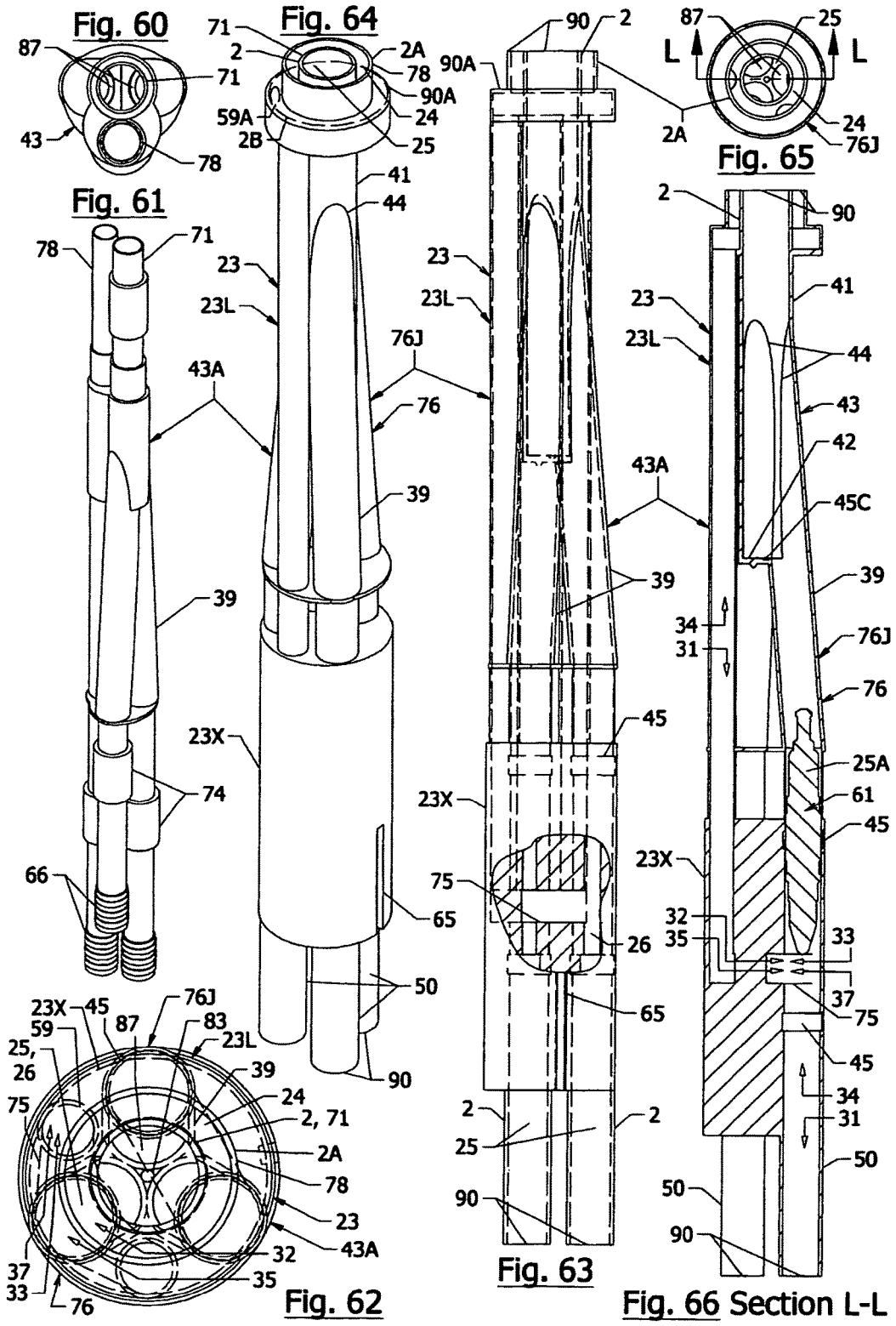

Referring now to FIGS. 60 to 66, which illustrate another chamber junction manifold adaptation that uses a plurality of manifold string set members of the present invention. The chamber junction manifold (43A) of FIGS. 60-61 is adaptable to form the manifold crossover (23L) embodiment of FIGS. 62-66, which can be used in combination with the manifold crossover (23X) embodiment to form a manifold string embodiment (76J), that can be usable to perform the same function with concentric conduits (2, 2A) of FIGS. 62-66 instead of parallel conduits (78 (also shown in FIG. 59) and 71 of FIGS. 60-61). Concentric conduits can be usable to improve flowing capacity within the passageway through subterranean strata for producing and injecting simultaneously flowing fluid mixture streams of various velocities, whereby a dual bore valve tree, necessary for the chamber junction manifold (43A) of FIGS. 60-61, can be replaced with a single bore valve tree, for the manifold string (76J) of FIGS. 62-66, for easier placement of flow controlling members within the innermost passageway, by, for example, removing the need for a plurality of wireline (4A of FIG. 3) rig-ups, which are needed for dual bore valve trees.

Chamber junction members can comprise a chamber bottom (42) with a receptacle (for example 45A shown in FIG. 33 if an exit bore extends axially downward or 45C of FIG. 66) for engagement of a bore selector (47 of FIG. 95-96) extension (48 of FIGS. 95-96), that can be used to complete the fluid and apparatus guiding surface (87) within the chamber junction. Chamber walls (41) can be engaged (44) to the exit bore conduits (39) and further engaged to upper end innermost passageway connectors of a manifold crossover (23X), with a receptacle (45) for engagement of flow controlling members (25A, 61) and a radial passageway (75) for fluid communication between passageways. As shown in the Figures, the assemblies ends (90) can be engagable to conduits (2, 2A, 71, 78) of a single main bore at the upper end and plurality of well conduits at the lower ends.

FIGS. 60 and 61 depict plan and isometric views, respectively, of a chamber junction manifold crossover (43A) usable for simultaneous injection and production flow streams. As shown in the Figures, the main bore first conduit (71) and main bore second conduit (78) are parallel and access segregated portions of the chamber with valves (74), below controlling exit bore conduits engagable, with seal stacks (66), to other chamber junctions (43 of FIG. 53). The chamber junctions of the present inventor shown in FIGS. 60 and 61 allow, for example, the simultaneous production from two wells and injection into one well, similar to the manifold string (76B) of FIG. 51.

Referring now to FIGS. 62 and 63, plan and elevation views, respectively, with dashed lines showing hidden surfaces of a manifold string (76J) and chamber junction manifold (43A), with a manifold crossover embodiment (23X) for adapting a chamber junction (43), are shown. The Figures illustrate an inner concentric string (2) and outer concentric string (2A) which are equivalent in function to a main bore first conduit (71) and a main bore second conduit (78), respectively, wherein simultaneous fluid mixture flows into (32, 35) one of the three innermost passageway members (25, 26), either directly (32) or indirectly (35) from a concentric conduit passageway (2B, 2C of FIGS. 54 and 59), or into (33, 37) the concentric passageway (24) through the orifice (59), either directly (33) or indirectly (37), and then through concentric passageways (24, 24A, 24B, 55), when additional concentric conduits are present (2B, 2C of FIGS. 54 and 59) at the upper end (90A).

A bore selector (47 of FIGS. 95-96) extension (48 of FIGS. 95-96) can be engagable with the chamber junction bottom receptacle (83), wherein the guiding surface (87) is completed across a single innermost passageway (25), blocking other innermost passageways to, for example, place a plug (25A of FIG. 66) to divert flow into (33, 37) the concentric passageway (24) or into (32, 35) the lower left innermost passageway (25).

FIG. 64 depicts an isometric view of the manifold string (76K) and manifold crossover (23X) of FIG. 62. FIG. 64 shows the inner concentric string (2, 71) and outer concentric string (2A, 78), with dashed lines showing an optional additional concentric conduit (2B) end location (90A) and associated optional orifice (59A), which can be usable with other manifold crossovers (23Y of FIGS. 14-16, for example) that are engaged to the upper end (90). The engagement can provide fluid communication between the lower left innermost passageway (25 of FIG. 62) to alternate passageway members using crossover members of the present invention.

Referring now to FIGS. 65 and 66, plan and elevation cross-section views with and along line L-L, respectively, of the manifold string (76K) and manifold crossover (23X) of FIG. 62 are shown. The Figures include a flow controlling member (61), that is shown, for example, as a plug (25A), installed through the innermost passageway of the inner concentric string (2) using a bore selector. As depicted in the Figures, the outer concentric string (2A) is placed in fluid communication through the chamber junction manifold (43A) and radial passageway (75) of the manifold crossover (23X). Alternatively, a straddle (22 of FIG. 93A) can be engaged to one or more of the receptacles (45) to cover the radial passageway and to selectively commingle fluid communication between all three innermost passageways (25) extending from the exit bore conduits (39) of the chamber junction (43). Various combinations of injection (31) and production (34) between the member passageways (25) can be usable to selectively control simultaneously flowing fluid mixture streams.

Figures 67, 67A, 68, 69, 70, 71, 72, 73, 74:
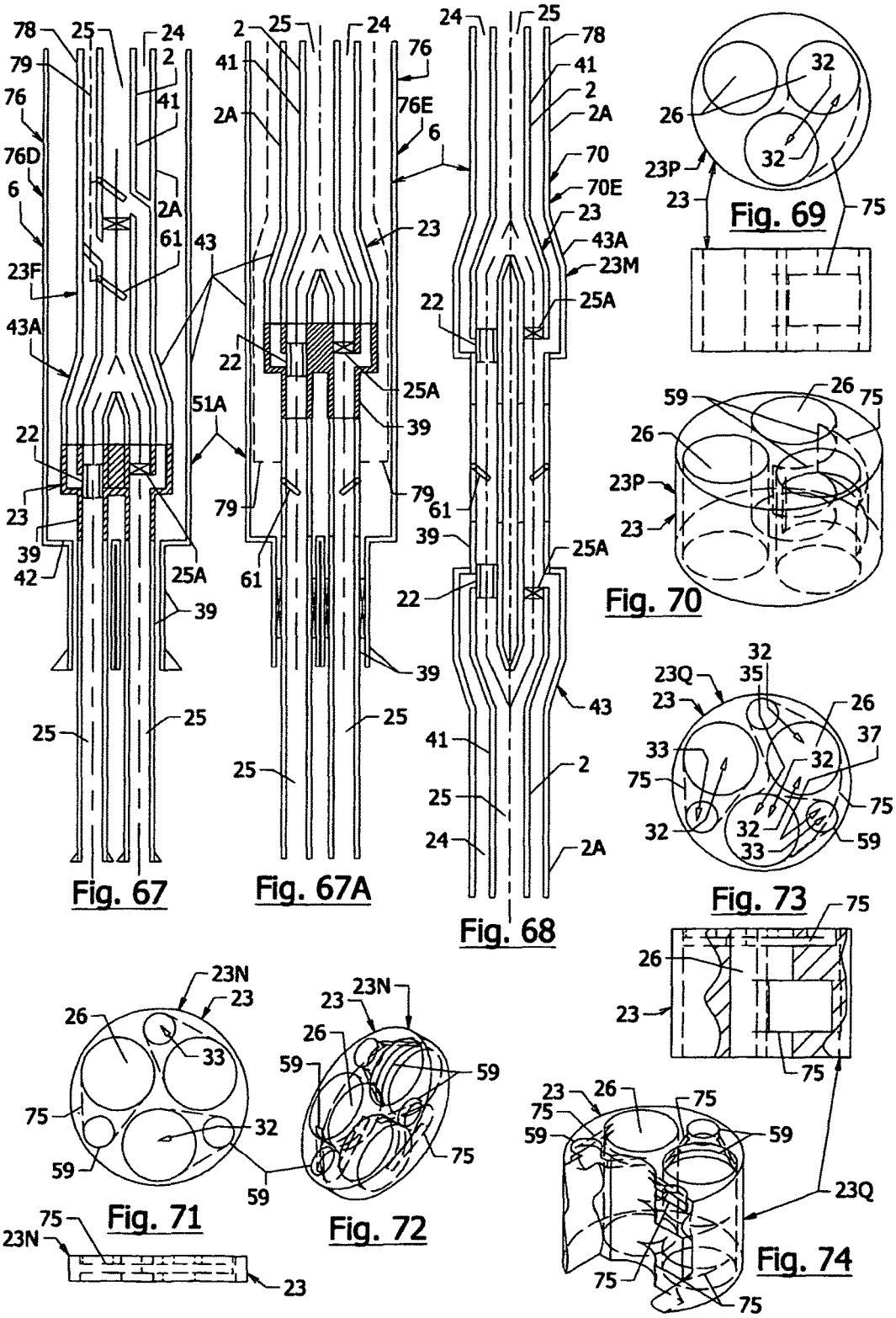

FIGS. 67, 67A and 68 show elevation diagrammatic views of various valve (74) flow control and manifold string (70, 76) embodiments (76D, 76E and 70E respectively). The Figures show valve flow controlling members (61) above, below, and between chambers junction (43) and manifold crossover (23) members to selectively control the innermost passageway (25) flow stream that is passing through the straddle (22) and concentric passageway (24), between the inner concentric string (2) and outer concentric string (2A), which is shown blocked from the innermost passageway and diverted through a radial passageway of the manifold crossover with a blocking plug (25A). FIG. 67 includes a manifold valve crossover (23F) that can be adapted with a chamber junction and, further, a manifold crossover (23) with a plug (25A) and straddle (22) for forming the manifold string embodiment (76D) of FIG. 67. FIG. 67A includes a chamber junction (43) and manifold crossover (23), with a plug (25A) and straddle (22) located above selectively controlled valve flow controlling members (61) engaged between conduits of each exit bore string. For forming the manifold string embodiment (76E) of FIG. 67A. FIG. 68 includes a manifold crossover (23M) embodiment with concentric conduits (2, 2A) at upper and lower ends, with intermediately selectively controlled valve flow controlling members (61) engaged to exit bore conduits (39), for forming the manifold string embodiment (70E) of FIG. 68.

Selectively controlled and/or fail-safe shut valve manifold strings (70E, 76D, 76E) are usable, for example, in hydrocarbon or geothermal wells where the unplanned release of flammable or superheated production is unacceptable, should other surface containment equipment fail to operate.

Referring now to FIGS. 69 to 74, the Figures illustrate manifold crossover embodiments (23N, 23P) combinable as building blocks through integral construction, or as members with intermediate conduits and member passageways, to form a new manifold crossover (23Q) embodiment. The new embodiment (23Q) includes an increased number of selectively controllable reconfigurations, which is more than either of the crossovers, and further demonstrates that various combinations of members may form new embodiments of the present invention.

Referring now to FIGS. 69 and 70, a plan view above an elevation view and an isometric view, respectively, of an embodiment of manifold crossover (23P) is shown, with dashed lines depicting hidden surfaces. The Figures illustrate flow orientations (32) through a radial passageway (75), between innermost passageway connectors (26). Blocking the orifices (59) with, for example, a straddle can prevent flow through the radial passageway or placement of, for example, a blocking plug, can divert flow through the radial passageway.

FIGS. 71 and 72 depict a plan view above an elevation view and an isometric view, respectively, of an embodiment of manifold crossover (23N), with dashed lines depicting hidden surfaces, showing flow orientations (32, 33) through a radial passageway (75), between innermost passageway connectors (26) and orifices (59), that are engagable with a concentric passageway. Passageway members can be blocked, when covered by a straddle, and diverted through when a blocking member is selectively placed. Intermediate flow diverting apparatus, using various flow controlling members, for example, fixed or variable chokes and pressure activated valves, can be usable to selectively control a portion of the flow through passageway members.

Referring now to FIGS. 73 and 74, a plan view above an elevation view and an isometric view, respectively, of a manifold crossover (23Q) embodiment is shown. The embodiment (23Q) is formed by combining other manifold crossovers (23P, 23N of FIGS. 69-72), with cut-out and dashed lines depicting hidden surfaces. The Figures illustrate selectively configurable flow streams, that flow directly (32) to the innermost passageway or indirectly (35) through the upper right intermediate commingled innermost passageway (26) or, alternatively, directly (33) into the concentric passageway or indirectly (37) through lower innermost passageway connector (26) intermediate commingled passageway. Orifices (59) are shown that can be engagable to one or more concentric passageways, between two or more conduits, wherein flow controlling members are selectively placeable and/or configurable across orifices of the radial passageways or other member passageways to selectively affect flowing fluid streams, passing through the manifold crossover (23Q).

FIG. 75 depicts an isometric view of the manifold crossover of FIGS. 17 to 19, which can be usable with the adapted chamber junction (43) of FIGS. 76 to 80 and the radial passageway (75) orifices (59), engaged to the connecting conduit (93) of FIG. 81, to form the manifold string (76F) of FIG. 82.

Referring now to FIG. 76, a plan view of an embodiment of an adapted chamber junction (43), with dashed lines showing hidden surfaces, is shown. The Figure illustrates the inner concentric string (2) communicating with innermost passageways (25) of the exit bore conduits (39) and outer concentric string (2A) for forming a concentric passageway (24), with orifices (59) engagable to a connecting conduit (93 of FIG. 81), to form the manifold string (76F) of FIG. 82.

FIGS. 77 and 79 depict plan views, with lines M-M and N-N above cross section elevation views and along lines M-M and N-N, respectively. The embodiments shown in the Figures are associated with the manifold crossover of FIG. 76, with detail line P of FIG. 77 associated with FIG. 78. Break lines, representing removed portions, show an adaptation of a chamber junction (43), usable with the flow controlling members of FIGS. 75 and 81 to form the manifold crossover (23R) of FIG. 82.

Referring now to FIGS. 78 and 80, a magnified view of the portion of the adapted chamber junction (43) within detail line P of FIG. 77 and an isometric view, respectively, are shown. The Figures depict the inner concentric string (2) and outer concentric string (2A) members forming a concentric passageway (24), with orifices (59) engagable to the upper end (90 of FIG. 81) of the connecting conduit (93 of FIG. 81), and with the lower end (90 of FIG. 81) engaged to the manifold crossover (23D of FIG. 75) orifices (59 of FIG. 75), to form the manifold string (76F) of FIG. 82. A receptacle (83) is shown in the chamber bottom (42) for the orientation and engagement of the bore selector (47 of FIG. 95-96), which can be usable to communicate between the innermost passageways (25) above the chamber (41) and the innermost passageways of the exit bore conduits (39), to provide selectable control.

Referring now to FIG. 81, an isometric view of a connecting conduit (93), usable between the kidney-shaped chamber junction orifices (59 of FIG. 76) and small diameter orifices (59 of the FIG. 75) of the manifold crossover (23D of FIG. 75), is shown, which can be usable to form the manifold string (76F) of FIG. 82.

FIG. 82, an isometric view of an embodiment (76F) of a manifold string (76) associated with FIGS. 106-116, is shown. The embodiment (76F) is assembled from the associated manifold crossover member parts of FIGS. 75, 80 and 81 with flow controlling members (74 and 91 of FIGS. 91 and 94, respectively). The Figure depicts a manifold crossover embodiment (23R) formed by the combination of members comprising a chamber junction, a nipple (91 of FIG. 94) or selected nipple receptacle (45 of FIG. 94), connecting conduit (93 of FIG. 81), and a manifold crossover (23D of FIG. 75).

As fluid mixtures of liquid and/or gas may contain abrasive solids, fluid mixtures flowing at varying velocities may erode paperwork functional variations of manifold crossovers with longer more gradual flow path deviations are needed for various applications, such as solution mining and high pressure hydrocarbon fluid mixtures with high velocities.

Referring now to FIGS. 83 to 87, the Figures depict a manifold crossover embodiment (23T) usable to minimize frictional resistance to flow in high velocity or high erosion environments. As such long sweeping embodiments are more difficult to comprehend than shorter versions with right angles, various embodiments of manifold crossovers have been described with emphasis. However it should be understood that within the scope of the appended claims, that previously described manifold crossovers embodiments are constructible from chamber junctions (21, 43) of the present invention to minimize frictional resistance in high velocity and high erosion environments similar to 23T of FIGS. 83 to 87 for plurality of well applications or 23Z and 47A of FIGS. 117 to 122 for single well applications. More than two exit bores and/or more than one radial passageway blisters and/or segregated concentric passageways can be usable with two chamber junction manifold crossovers (23T) having exit bore ends engaged, similar to the crossover 23M of FIG. 68, for concentric conduit applications. For example, straddles, blocking plugs, and pressure controlled, acoustically controlled, fluid pulse controlled, and/or choking flow control devices can be placed within exit bore receptacles to selectively control member passageways.

Figures 83, 84, 85, 86, 87, 93A:
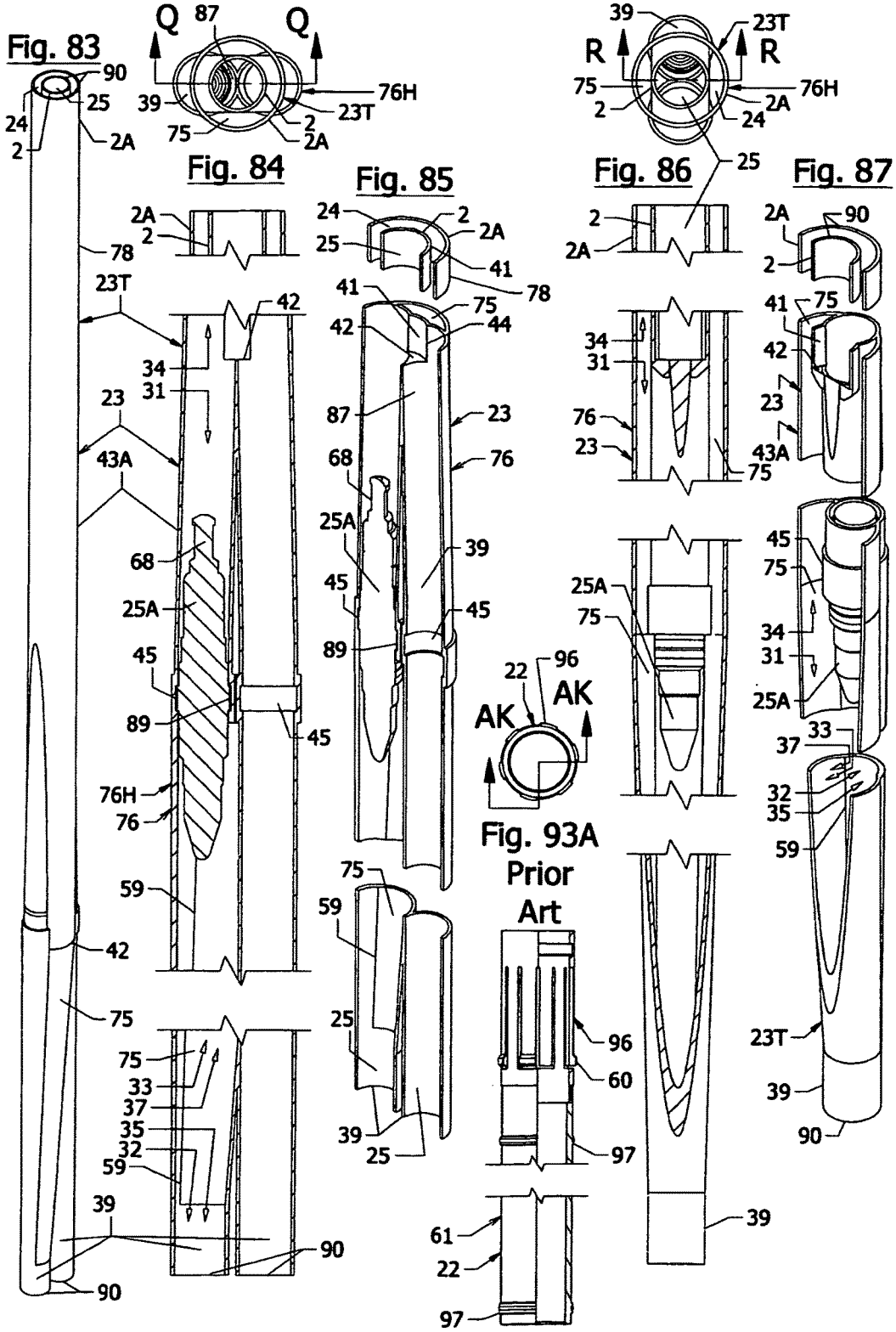
Fig. 93A Prior Art
FIGS. 83 to 87 show an embodiment of a manifold member, of a chamber junction manifold crossover, adapted to form lower frictional flow stream member passageways with a blocking and diversional flow controlling member engaged within an associated receptacle.
FIG. 91, FIG. 92, FIG. 93, FIG. 93A and FIG. 94, depict prior art valve, packer, plug, straddle and nipple flow controlling members, respectively.

Referring now to FIG. 83, an isometric view of an embodiment of adapted chamber junction manifold crossover (23), associated with FIGS. 84 to 87, is shown. The Figure illustrates an inner concentric string (2), outer concentric string (2A) or second main bore conduit (78) with ends (90), that can be engagable to conduit strings of a single main bore above a chamber junction (43), for forming a manifold (43A) with the addition of receptacles and a radial passageway (75) blister, between the exit bore conduits (39) and the chamber junction bottom (42).

FIGS. 84 and 86 depict plan views above elevation cross-sectional views with, and along, lines Q-Q and R-R, respectively, with break lines removing portions of the assembly associated with cross sections in FIGS. 85 and 87 isometric views, showing the manifold crossover (23T) of FIG. 83. The Figures illustrate the placement of a flow controlling member, shown as a cable (11 of FIG. 3) placeable and retrievable blocking plug (25A), that can be placeable through the inner concentric string (2) innermost passageway (25) with a bore selector (47 of FIG. 96), usable to complete the innermost passageway guiding surface (87) and excluding other exit bore plug flow controlling members engaged with a selected nipple profile receptacle (45) for blocking fluid communication within one exit bore conduit (39) innermost passageway (25). The concentric passageway (24) flow stream may communicate from below the plug, directly (32, 33), with the exit bore conduit passageway or, indirectly (35, 37), with various other manifold crossovers (21, 23) engagable to the upper end (90) of the chamber junction, through the radial passageway (75) blister. Commingled flow within the chamber junction manifold (43A), from both exit bores, can be operable by placing a straddle (22 if FIG. 93A) across the orifice (59) of the radial passageway (75).

Referring now to FIGS. 85 and 87, the Figures show projected isometric views, with cross sections associated with FIGS. 84 and 86 and break lines of the manifold crossover (23T) of FIG. 83. The Figures show isometric views from different orientation perspectives of the radial passageway (75) blister flow passageway member and the flow controlling member (61), shown as a blocking device (25A). Other flow controlling members, such a pressure activated one-way valve, can be usable to feed a substantially lighter, specific-gravity, fluid-stream, first well into a heavier flow-stream, second well to reduce hydrostatic pressure on the second well and, thus, increase flowing velocity.

Chamber junction crossovers, of similar construction, with radial passageway blisters (75) and discontinuous exit bore conduits with receptacles (24) can be usable to replace connecting conduits (93 of FIG. 81) and manifold crossover (23D of FIG. 75) or to replace the manifold crossover (23R of FIG. 82) in the manifold string of FIGS. 88-116 when, for example, erosion or flow cutting of an assembly from flow streams of higher velocity is of concern. For example, such concerns include during solution mining in substantially water wells, or proppant fracture propagation operations in shale gas or low permeability sandstone reservoirs, in substantially hydrocarbon wells.

Figures 88, 89, 90, 91, 92, 93, 94, 95, 96:
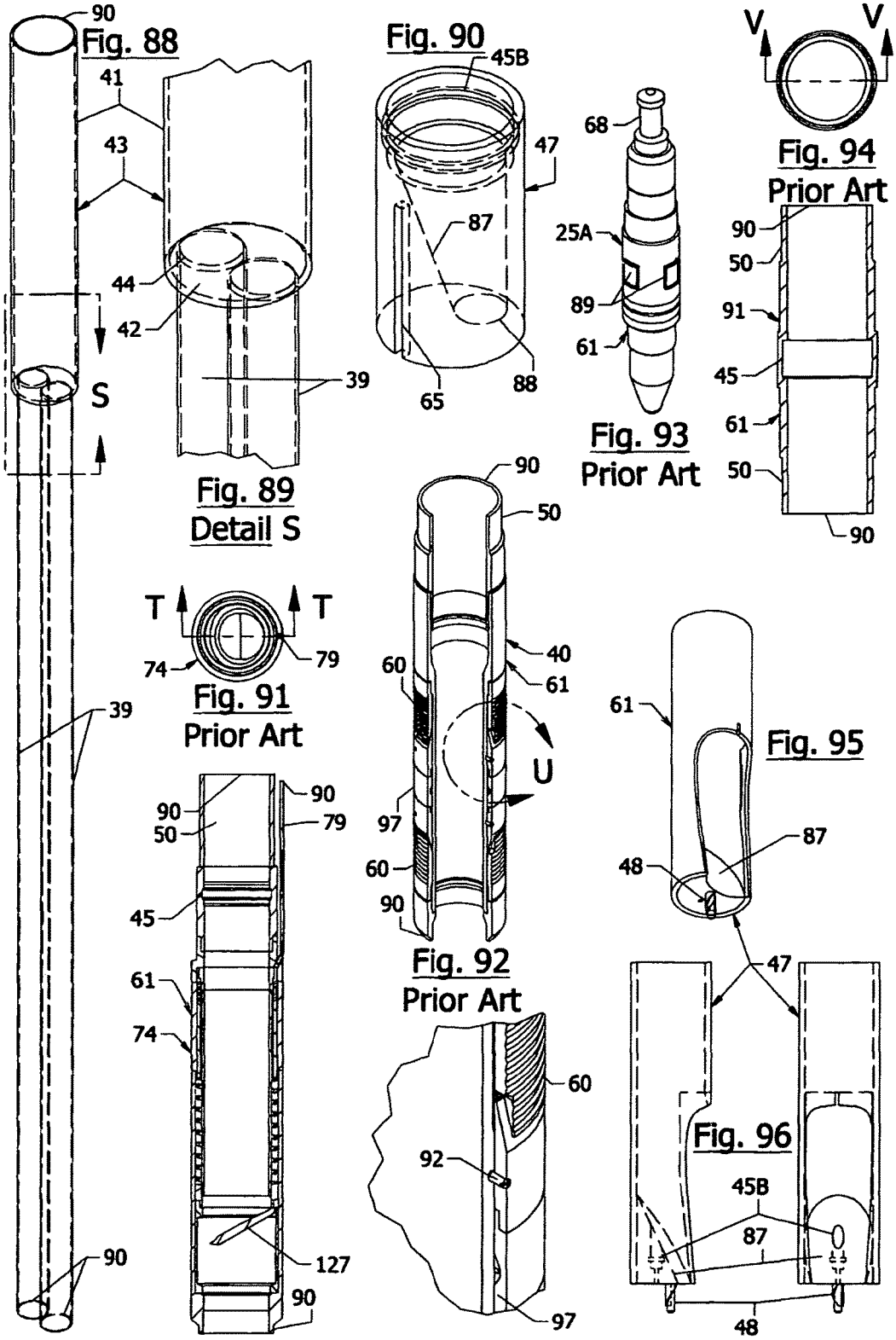
Fig. 91 Prior Art
Fig. 92 Prior Art
Fig. 93 Prior Art
Fig. 94 Prior Art
FIGS. 88 to 89 and FIG. 90 illustrate chamber junction and bore selector members, respectively, usable with embodiments of the present invention.
FIGS. 95 to 96, show a bore selector member usable with adapted chamber junction embodiments of the present invention.

Referring now to 75-82 and 88-116, the Figures show member embodiments usable to construct and complete a well with a manifold string (76F) member, that can be usable within a chamber junction member (43 of FIG. 88-89 adaptable into a managed pressure conduit assembly (49) manifold string 70F during installation) and various flow controlling members to form an adapted manifold string (76G of FIGS. 106-116) member.

FIGS. 88 and 89 depict isometric and magnified views with and within detail line S, respectively, of a chamber junction (43), with dashed lines showing hidden surfaces. The embodiments shown in the Figures can be usable within a managed pressure string (49 of FIGS. 97-105) or as a member of a junction of wells (51A of FIGS. 51-54 and 106-116). The Figures include a chamber (41), chamber bottom (42), and exit bores usable with a bore selector (47 of FIG. 90).

Referring now to FIG. 90, an isometric view of a bore selector (47), that can be usable with the chamber junction of FIGS. 88 and 89, is shown with dashed lines, illustrating hidden surfaces, depicting the guiding surface (87) for communicating fluids and the apparatus through its lower orifice (88), wherein a receptacle (45B) is usable to place, rotate and remove the bore selector (47).

FIGS. 91, 92, 93, 93A and 94 show examples of valve, packer, plug, straddle and nipple prior art flow controlling members, which can be usable with the present invention, respectively. FIG. 91 depicts a plan view, with section line T-T above an elevation view along section line T-T of a subterranean valve (74) of flapper (127) type, which comprises a flow controlling member (61). FIG. 92 depicts an isometric view, with a quarter section removed and detail line U above the magnified portion within line U, of a production packer (40) flow-controlling member (61) with engaging connectors (60) and sealing engagement (97), that can be activated by pressure shearing pins (92). FIG. 93 depicts an isometric view of a plug (25A) flow controlling member. FIG. 93A depicts a plan view, with line AK-AK above an elevation cross section along line AK-AK, of a straddle (22) flow-controlling member (61), with sealing apparatus (97) and snap-in (96) engaging connectors (60). FIG. 94 is a plan view, with section line V-V above an elevation cross section along line V-V, showing a nipple profile (91) flow-controlling member (61) with a receptacle (45) for engagement of various other flow controlling members. The upper and lower ends of the flow controlling members of FIGS. 91-94 can be engagable between conduits of concentric conduit strings of the present invention.

Referring now to FIGS. 95 and 96, the Figures depict an isometric view and a right adjacent to a front view, respectively, of a bore selector (47), with dashed lines illustrating hidden surfaces. The bore selectors shown FIGS. 95 and 96 include engagement receptacles (45B) and bore selector extensions (48), and the bore selectors can be usable with various adapted chamber junction crossover embodiments of the present invention for example, the embodiments shown in FIGS. 106 to 116.

Figures 97, 98, 99, 100, 101, 102, 103, 104, 105:
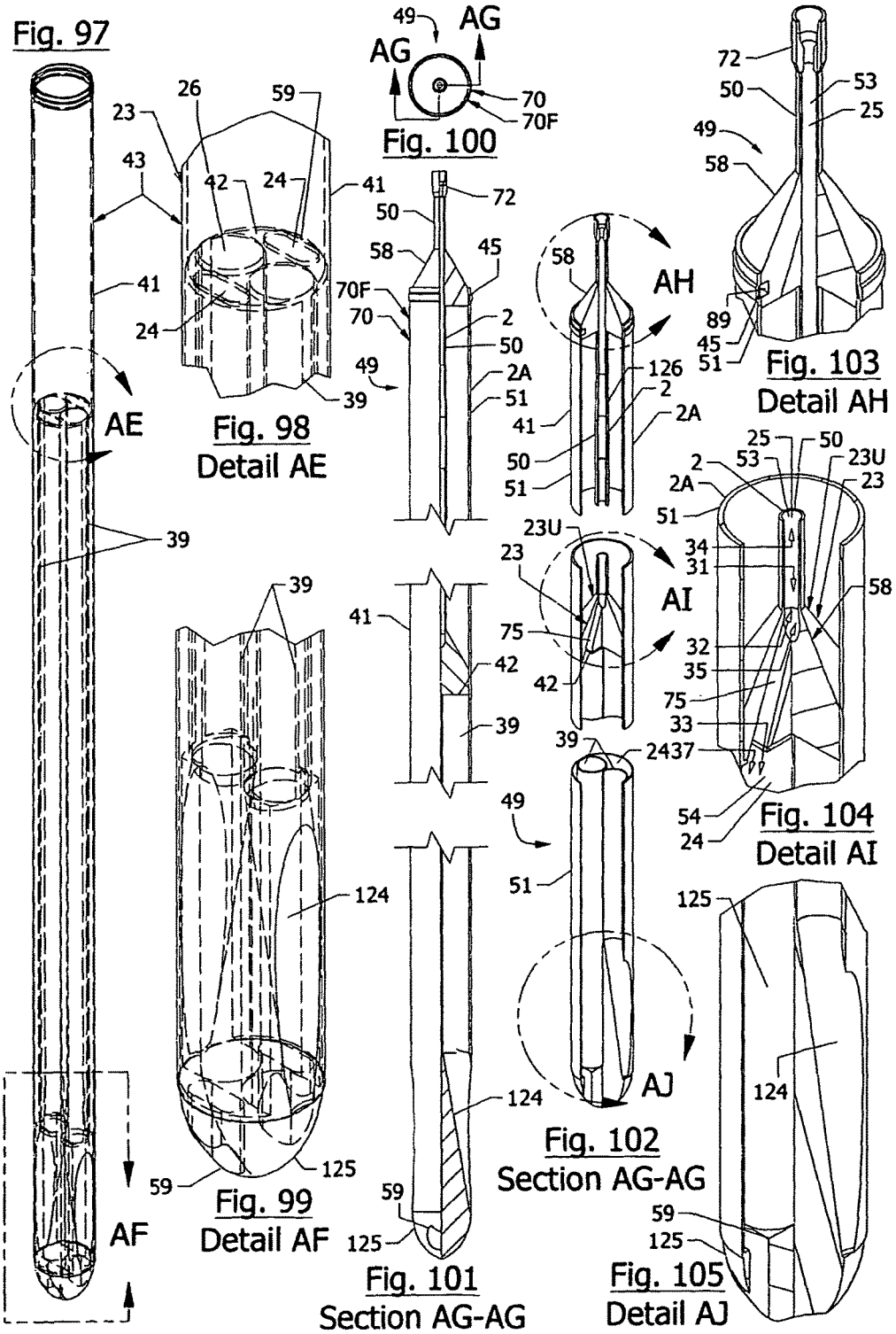
FIGS. 97 to 99 and 100 to 105 show an adapted chamber junction and manifold string member embodiment, respectively formed from a managed pressure conduit string assembly.

Referring now to FIG. 97, an isometric view with detail lines AE and AF associated with FIGS. 98 and 99, respectively, of an adapted chamber junction is shown. The chamber junction shown in FIG. 97 can be usable to form a managed pressure conduit assembly (49 of FIGS. 100-105) and manifold string member embodiment (70F of FIGS. 100-105). The Figure includes dashed lines showing hidden surfaces.

FIGS. 98 and 99 depict magnified views of a portion of the chamber junction (43) within detail lines AE and AF of FIG. 97, with dashed lines showing hidden surfaces. The Figures illustrate a chamber junction (43 of FIGS. 88-89) adapted with whipstocks (124) extending from exit bore conduits (39), that can be usable to laterally separate bored strata passageways, forming innermost passageway connectors (26) of a manifold crossover (23), which can be usable for boring with a casing bit (125). Circulation of a fluid slurry can occur through bit orifices (59) during well construction. The chamber bottom (42) orifices (59) can be usable for engaging a radial passageway (75 of FIGS. 102 and 104) of a slurry passageway apparatus (58 of FIGS. 100-104), whereby the assembly member can be usable to form a manifold crossover (23U of FIGS. 102-104).

Referring now to FIG. 100, the Figure shows a plan view with line AG-AG associated with FIG. 101, of an adapted slurry passageway tool (58). The Figures includes the adapted chamber junction of FIG. 97 forming a managed pressure conduit (49) member embodiment (70F) of a manifold string (70), which can be usable to form a plurality of well passageways through subterranean strata, usable to form further embodiments (for example 76G of FIGS. 106-116).

FIG. 101 depicts an elevation cross-section view along line AG-AG, associated with FIG. 102 of the manifold string (70F) of FIG. 100, with break lines indicating missing portions. The Figure shows an inner concentric string (50), outer concentric string (51), rotary connector (72) and slurry passageway apparatus (58) for placing and securing the member (70F) with, for example, simultaneously circulated, separate, cement and drilling slurry fluid-mixture flow streams of varying velocities, within the passageway through subterranean strata.

Referring now to FIG. 102, the Figure shows a projected isometric view of FIG. 101 with cross-sections at associated break lines of FIG. 101, and with detail lines AH, AI and AJ associated with FIGS. 103, 104 and 105, respectively, of the manifold string (70F) of FIG. 100. The Figure illustrates an adapted slurry passageway apparatus (58) usable as a manifold crossover member (23U) with a slip joint (126) flow controlling member used to facilitate spaceout of the concentric conduits of the assembly.

FIGS. 103, 104 and 105 depict magnified views of the portion of manifold string (70F) of FIG. 102, within detail lines AH, AI and AJ, respectively. The Figures show an innermost passageway (2, 53) within an inner concentric conduit (50), with an upper end rotary connector (72), engagable to a drill string, that can be engaged at its lower end to the slurry passageway tool (58) engaged with mandrels (89) to a receptacle (45) in the outer concentric conduit (2A, 51). Direct (32, 33) or indirect (35, 37) flow streams, between the innermost passageway (25, 53) and concentric passageway (24, 54), can be usable within the inner (2, 50) and outer (2A, 51) concentric conduits for selectively controlling flow streams. The slurry passageway member (58) can be placeable and removable from the chamber junction (43). Whipstocks (124) can be usable to laterally separate more than one passageway through subterranean strata from a single main bore (6 of FIGS. 50-53 and 106-116). The remaining portion of the managed pressure conduit assembly (49) can be usable as an outer member of a junction of wells (51A of FIGS. 50-53 and 106-116).

Referring now to FIGS. 106-116, the Figures depict a manifold string (70) member embodiment (76G) comprising a manifold crossover (23R of FIG. 82) member that can be engaged, with a packer (40 of FIG. 92) member, to a chamber junction member (43 of FIGS. 88-89) forming a junction of wells (51A) member. The Figures show the manifold crossover (23R) can be formed from a chamber junction manifold (43A) member that can be formed from a chamber junction (43 of FIG. 80), with nipple (91 of FIG. 94) members providing receptacles (45) engaged to the manifold crossover (23D of FIG. 75) member, which can be engaged to valves (74 of FIG. 91) usable to divert flow from one well of the junction of wells (51A) through the radial passageway (75) of the manifold crossover (23D). The left well flow stream can be diverted through a radial passageway (75) to the concentric passageway (24) by using a plug (25A of FIG. 93) member, engagable to the receptacle (45) and conveyable through the innermost passageway (25), while the flow stream of the right well can be urged through the innermost passageway (25), with both wells controlled by subsurface safety valves (74), between conduits of the innermost string (2) members and production packers (40) in the annular spaces (24A) at the lower end of the well.

A valve tree and/or wellhead can be usable when engaged to the upper ends (90) of the single main bore (6) from which the two wells extend axially downward, at the junction of wells (51), to laterally and/or vertically separated subterranean regions, thereby providing the pressure integrity of two conventional wells through the single wellhead and main bore.

Referring now to FIG. 106, the Figures shows a plan view with line X-X associated with FIGS. 107 to 111, with detail line W associated with FIG. 112, of a plurality of wells manifold string (76) embodiment (76G).

FIGS. 107 to 111 show elevation cross-sectional views along line X-X of the manifold crossover of FIG. 106, with FIGS. 108, 109, 110 and 111 having lines Y, Z, AA and AB, respectively, associated with FIGS. 113 to 116 magnified views. The Figures illustrate the combination of manifold string members (23R, 76F of FIG. 82 and 43 of FIG. 88-89) with various flow controlling members (61) forming a junction of wells (51), with upper ends (90) engagable to conduits of a single main bore and/or wellhead. After construction, concentric conduits (50, 51) and associated passageways (53, 54, 55) can become production and/or injection conduits (2 or 71, 2A or 78, 51) with associated passageways (24, 24A, 25, 55), respectively. The chained dashed line, between upper and lower ends, represents a continuation of the apparatus across FIGS. 107-111, and the close lateral proximity of the two wells below the junction of wells (51A) is for illustration purposes, as wells below a junction of wells and single main bore have, generally, significant lateral separation to access both significantly vertically and laterally separated subterranean regions.

Referring now to FIG. 112, a magnified view of the portion of manifold string (76G) within detail line W of FIG. 106, showing an inner concentric string (2), outer concentric string (2A), forming inner (25) and concentric (24) passageways with a chamber junction (43) about a chamber junction manifold (43A) for forming a junction of wells (51A). Various flow controlling members can be placed through the innermost passageway (25) using a cable (11 of FIG. 3) and wireline rig (4A of FIG. 3), with a bore selector (47 of FIGS. 95-96) that can be engagable with the receptacle (83) to selectively block one innermost passageway and to communicate with the other to convey apparatus for placement within. Alternatively, the bore selector (47 of FIGS. 95-96) engagable with the receptacle (83) can be used to simultaneously flow fluid mixture streams into (32, 35) the innermost passageway, or to communicate fluid into (33, 37) the concentric passageway (24), dependent on the other engagable manifold crossover members used.

Figures 107, 108, 109, 110, 111:
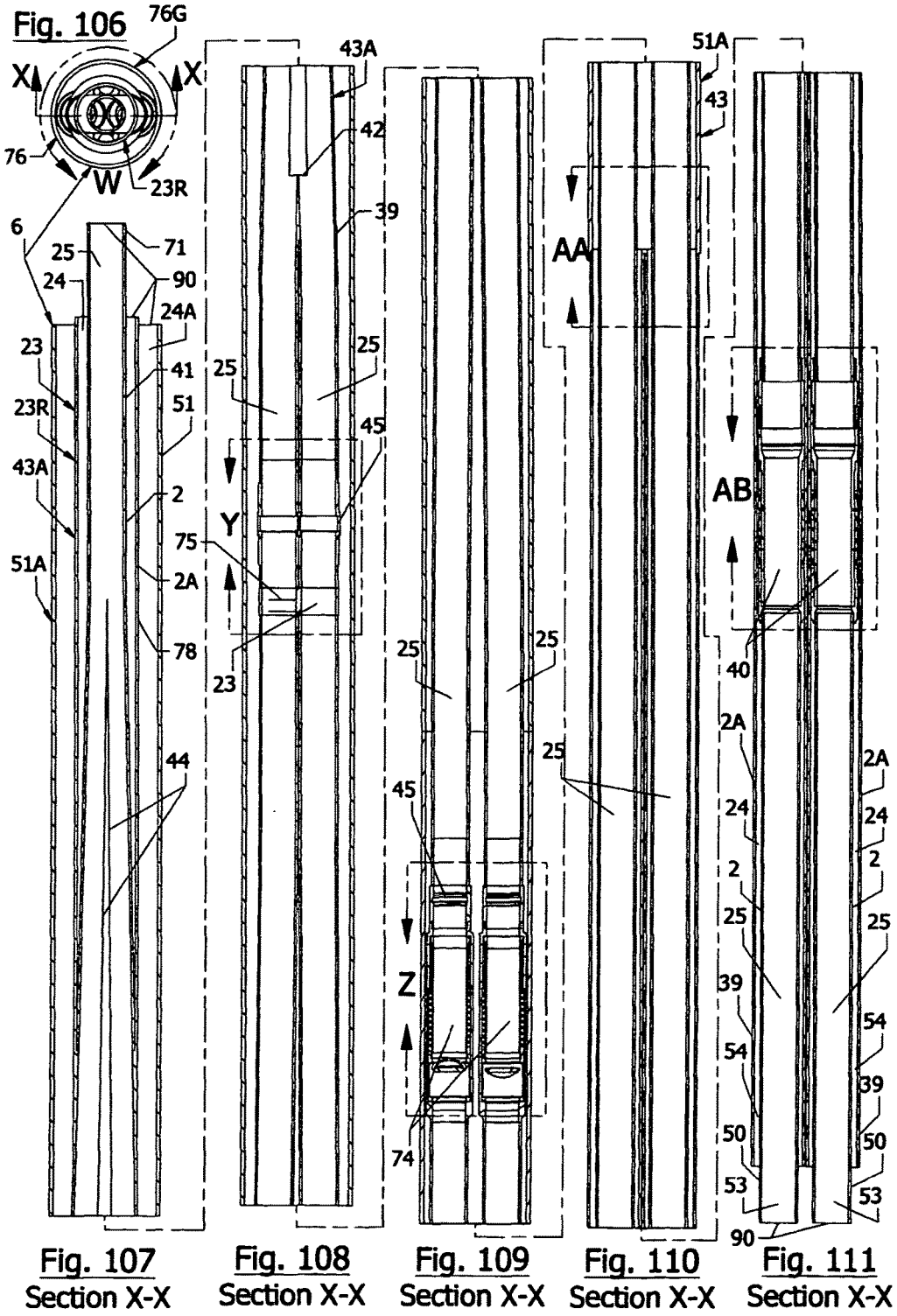

Referring now to FIG. 113, a magnified view of the portion of the manifold string (76G) within detail line Y of FIG. 108, is shown. The Figure illustrates the manifold crossover (23D) with a radial passageway (75) and nipple profile receptacle (45) between exit bore conduits (39) and inner concentric conduit strings (2).

FIG. 114 depicts a magnified view of the portion of the manifold string (76G) within detail line Z of FIG. 109. The Figure shows subterranean valve (74) flow controlling members (61), that can be usable for selectively controlling the innermost passageway (25). For example, the Figure shows the subterranean valve (74) controlling members flapper (127) valve, with associated receptacles for isolating the flapper or setting other flow controlling members.

Referring now to FIG. 115, the Figure depicts a magnified view of the portion of the manifold string (76G) within detail line AA of FIG. 110, showing inner concentric strings (2) passing through a chamber junction (43) bottom (42) with chamber walls (41) and associated exit bore conduits (39) functioning as a concentric conduit for a common concentric passageway (24). The common concentric passageway can be usable for injection (31) and circulated returns (34), prior to setting of the packer (40 of FIG. 116) and two innermost concentric passageways (25), also usable for injection (31) or production (34) to laterally and/or vertically separated subterranean regions.

FIG. 116 depicts a magnified view of the portion of the manifold string (76G) within detail line AB of FIG. 111. The Figure shows exit bore conduits (39) engaged to the upper end of production packer (40) flow controlling members, which are shown engaged to concentric conduits (2A) with engagement devices (60) or gripping slips segments. The concentric passageway (24A) is shown blocked by the packer (40), and the innermost passageways (25) of the two wells extending from the chamber junction of wells (51 of FIG. 107) can be separatable to vertically and/or laterally separated subterranean regions.

Referring now to FIG. 117, a plan view, with line AK-AK above an elevation view along line AK-AK, of a manifold crossover (23) is shown. The embodiment (23Z) of the manifold crossover (23) is shown comprising a chamber junction manifold crossover (21) member, depicting an adapted chamber junction (43) member with ends (90) engagable to other member conduit strings, comprising at least an outer (2A) and inner concentric conduit string (2) with an innermost bore (25) and upper end first receptacle (45) above a chamber junction bottom (42), that can be usable as an engagable second receptacle. The axial lower exit bore (39) can be isolated from the lateral sloping exit bore (39) by engaging a straddle or conduit across the first and second receptacles for sealing across the exit bore connection (44), to function as a bore selector for the axial aligned exit bore. Extending a straddle or sealing conduit from the first receptacle (45) to the third lower end receptacle (45) can separate the innermost (25) passageway from the concentric passageway (24), by sealing across the flow stream crossover orifices (59). Alternatively, a blocking flow-controlling member or bore selector can be engaged in the second receptacle (42) to cross flow streams from the innermost passageway, through the concentric passageway members (24, 24A), to the surrounding passageway member, which can include, for example, the first annular passageway. Flow below the blocking or bore selector can be diverable to the concentric passageway (24) through orifice crossover members, below the chamber junction crossover (21) bottom receptacle (42). The angular orientation of exit bores can be usable with high velocity or erosion prone fluid mixtures to prevent flow cutting of the manifold crossover (23Z).

The chamber junction crossover (21) can be adaptable with an additional concentric conduit string member (2B), shown as a dashed line, forming an additional concentric passageway (24A) to which an exit bore (39) may communicate with or pass through moving the truncation (46) of the exit bore conduit (39) to the outermost conduit (2B). A plurality of exit bore conduits can selectively communicate with a plurality of additional concentric conduits using an exit bore conduit and bore selector to pass through intermediate passageway members to form new manifold crossover (23Z) member embodiments, that can be usable to communicate from the innermost bore (25) to any concentric passageway member. A plurality of manifold crossover members (23Z) can be combinable to form new manifold crossover members for fluidly communicating between a plurality of different concentric passageway members, through the innermost bore between the plurality of manifold crossovers (23Z).

FIG. 118 depicts a plan view, with line AQ-AQ above an elevation view along line AQ-AQ with break lines indicating removed portions, of an adapted bore selector (47A) member embodiment, that can be usable in the manifold string members of FIGS. 119-122. The Figure illustrates a plurality of guiding surfaces (87) for an associated plurality of additional exit bore orifices (59 of FIGS. 119-122), usable to urge the bore selector within the innermost passageway using the pressure of a flowing fluid stream. An optional flow controlling member (61) shown, for example, as a one-way ball valve (84) can provide flow through the bore selector as it is pumped through the innermost passageway for alignment with an exit bore of the manifold string (70G of FIGS. 119-120).

The adapted bore selector (47A) member embodiments can be combinable with other flow controlling members (61), for example, engagements (60) for receptacles (45 of FIGS. 119-122), conduit straddles (22) for blocking chamber junction exit bore passageways and/or blocking orifices (59) between member passageways, internal one way valves (84), or an engagement receptacle (45B) for a cable, jointed conduit work strings or coiled tubing operational tooling. The fluid circulated between the innermost passageway (25) and concentric passageway (24 of FIG. 119-122) can be usable to aid movement of the bore selector member within the innermost passageway to, for example, perform one or more stage fracture propagation operations within a shale gas deposit.

Bore selector member embodiments may be pumped through the innermost passageway to engage orifices within the innermost passageway. Alternatively, the pumped bore selector embodiments can be suspended, for example, from a cable (11 of FIG. 3) and wireline rig (4A of FIG. 3) or a jointed conduit work string or coiled tubing rig, wherein the lifting capacity of a supporting rig can be supplemented by the ability to selectively control circulation of the bore selector, with simultaneously flowing fluid streams of varying velocity to remove or to place a fluid mixture. For example, fluid mixtures of liquids, gases and/or solids can be removed or placed during such operations as a proppant fracture operation for waste disposal, shale gas production, or the gravel packing of an unconsolidated reservoir.

Referring now to FIGS. 119 and 120, a plan view, with line AP-AP above an elevation cross-sectional view along line AP-AP and an isometric view showing cross-sections along FIG. 119 elevation view break lines, respectively, of a manifold string (70G) member embodiment is shown. The Figures show a bore selector (47A) member with an engagement profile (60), engaged within a receptacle (45) of a chamber junction manifold crossover (21) member, with three exit bore orifices (59) aligned with the bore selector of FIG. 118. The Figures show an associated straddle that can be usable to crossover orifices, wherein fluid below the bore selector can be usable to circulate to (33) the concentric passageway (24), through the lowest manifold crossover (23) orifices, to aid placement of the bore selector, so that a fluid mixture of liquids, gases and/or solids can be communicated through the innermost passageway to (33) the first annular passageway, using the guiding surface (87) and exit bore conduit (39) forming a radial passageway (75) member.

Placement of the bore selector within the innermost passageway for subsequent operations may occur, for example, using a wireline rig (4A of FIG. 3) and a cable (11 of FIG. 3) to selectively place the bore selector adjacent to exit bore conduits. Straddles (22) can be usable to cover orifices within the wall of the innermost conduit to form a circulated flow path within the manifold string passageway members (24, 25) for injection and/or extraction, for example, when propagating (28B of FIG. 123) subterranean fractures (18B of FIG. 123) through injection of proppant, followed by extraction of screened out proppants and subsequent selective flow of production and/or water shut-off.

Alternatively, for example, urging a bore selector into alignment with an exit bore of a chamber junction crossover (21) member of a manifold string (70G), with, for example, coiled tubing or jointed conduit work strings, aided by pumping between passageway members (24, 25) through orifices in the inner concentric conduit (2), can be usable to place a fluid mixture of liquids and solid proppants that can be pumped through the coiled tubing and exit bore to propagate fractures. After which, fluid injected through the concentric passageway (24) passing through the check valve can be usable to flow fluid through the bore selector (47A) member, and into the innermost passageway member (25), to lift screened out proppants from the bottom up. In comparison, conventional practice requires the top downward venturi removal of screened out proppants. After the fluid flow has passed through the bore selector, the bore selector can be repositioned for directly circulating out proppants, as described in FIGS. 121-122. In this manner, multiple fracture propagation stages can be carried out without the need to remove the coiled tubing or jointed tubing conduit work strings from the well.

FIGS. 121 and 122 depict a plan view, with line AN-AN above an elevation view along line AN-AN with dashed lines showing hidden surfaces, and an isometric view, showing cross-sections along break lines of the FIG. 121 elevation view, respectively, of a manifold string (70H) embodiment, that can be usable for removing solids from the innermost passageway. After aligning the bore selector (47A of FIGS. 119-120) and injecting or extracting a fluid mixture through an exit bore conduit (39) radial passageway (75), as described in FIGS. 119-120, the bore selector (47A) can be realigned with the orifices (59) in the innermost conduit (2) to provide a higher circulating flow rate between the passageway members (24, 25), while using a straddle wall (22) to block the exit bore conduit (39) radial passageway (75) initially used to place, for example, proppants.

If, for example, a proppant frac job is carried out in a shale gas deposit with a bore selector first placed at the lower end of the manifold string (70G of FIGS. 119-120), after screen out of the proppants, fluid circulation may be injected through the concentric passageway and returned through a bore selector one-way valve (84) to lift the proppants and to allow downward movement of the bore selector with, for example, coiled tubing, until aligning the guiding surface (87) of the bore selector (47A) with the orifices (59) just below the radial passageway (75), to allow a larger volume of circulated fluid between member passageways (24, 25) to clear the proppant screened out. After which, the bore selector (47A) can be aligned with the next radial passageway and the process can be repeated. One possible arrangement is a bottom up-staged operation of circulating through coiled tubing, that can be engaged to the bore selector receptacles (45B of FIG. 118), with a fluid that is injected down the concentric passageway (24), turning at the first open orifices in the innermost passageway (25) below the coiled tubing string sealing engagement with the bore selector receptacle (45B). Other possible arrangements include, for example, jointed tubing which can be used with pressure control at the surface, comprising, for example, a rotating head.

Referring now to FIG. 123, a diagrammatic elevation cross-sectional view of a manifold string (76L) embodiment, usable for a plurality of wells and well types, is shown. The Figure depicts a single conduit string member (51), on the right, placed with a managed pressure string to form a single injection and/or production concentric conduit (2) string member within the passageway through subterranean strata, engaged to a junction of wells (51A) and further engagable to a manifold string (70) member with chamber junction crossovers (21), straddles (22) and plugs (25A) for forming the manifold string (76L) fluidly communicating between the subterranean proximal regions (below 1Y, 1W, 1V, 1U, 1T) and a wellhead (not shown), at the upper end of the single main bore (6). Concentric conduit string members (50, 51) can be installed with a managed pressure conduit assembly member, for becoming the inner (2) and (2A) outer concentric conduits, respectively, after forming the well, dependent upon the application and removal of the inner string (50).

Applicable well types can include substantially hydrocarbon and/or substantially water wells, for example, a right-hand produced hydrocarbon well can crossover to (33) the concentric passageway (24) of the left well, wherein produced (34) fluids are injected (31) downward in the left well to exit the end or enter a chamber junction crossover (21), with plugs (25A) above and below for directing flow into the first annular space (55), contained by a cavern wall (1A) or a passageway through subterranean strata (52) of strata. The hydrocarbon fluid mixture can be separated into gas, liquid hydrocarbon, water and/or solids. If water is produced, it can be used to solution mine the cavern walls (1A), wherein the straddles (22) and plugs (25A) can be rearranged to remove the resulting brine. The manifold string can be usable for production (34), taken through the concentric passageway (24) by an exit bore conduit from the first annular passageway (55) into (35) the innermost bore where it is produced upward. A substantially gas fluid mixture may be taken from the uppermost chamber junction manifold crossover (21), or varying specific gravity fluids of substantially gas or liquid hydrocarbon and/or water may be taken from other chamber junction manifold crossovers (21), between proximal regions (1T, 1U, 1V, 1W, 1Y) through rearrangement of flow controlling device members (22, 25A).

Still other applicable well types include, for example, substantially hydrocarbon wells where chamber junction manifold crossover members (21) can be usable to perform multi-stage fracture propagation operations to create fractures (18A) within proximal regions (1T, 1U, 1V, 1W, 1Y), wherein pressures can be transmitted (28A) to the point of fracture propagation, and wherein proppants can be used to keep fractures open to flow, for example, gas from shale gas deposits or a fluid mixture from low permeability sandstone reservoirs, and whereby the right well may access other deposits, reservoirs or act as a disposal well for produced water.

Other applicable well types include, for example, substantially water geothermal or waste disposal wells, for example, removing the plug (25A) from the junction of wells (51A) and installing a straddle to: allow injection of water into the right well produced through a geothermal reservoir fracture (18A) of the left well that can be selectively controlled by chamber junction manifold crossover (21) members which are accessing select proximal regions (1T, 1U, 1V, 1W, 1Y) or injection of waste fluids produced from the right well into vertically separated proximal regions (1T, 1U, 1V, 1W, 1Y) of the left Well.

Still other applicable well types include, for example, combinations of substantially hydrocarbon and substantially water wells producing high-temperature and pressure water from the right well or feeding water to a geothermal reservoir on the right well and producing steam, further directed to heat tar sands or cold viscous arctic reservoirs on the left side, which can be selectively accessed through chamber junction manifold crossover (21) members to place the heated water in one or more of the proximal regions (1T, 1U, 1V, 1W, 1Y) to produce heated hydrocarbons from one or more of the remaining proximal regions.

Embodiments of the present invention, thereby, provide a member set of combinable systems, apparatus and methods that enable any configuration or orientation of selectively controlled separate simultaneously flowing fluid mixture streams, of varying velocities, within one or more subterranean wells, that can extend from a single main bore and wellhead, to urge substantially hydrocarbon or substantially water fluid mixtures of liquids, gases, solids, or combinations thereof, to or from at least one proximal region, of at least one passageway through subterranean strata, to at least one more proximal region or to said wellhead, at the upper-end of said subterranean well, wherein fluid mixture flow streams may be injected or extracted.

While various embodiments of the present invention have been described with emphasis, it should be understood that within the scope of the appended claims, the present invention might be practiced other than as specifically described herein.

The invention claimed is:

1. A method of using a set of subterranean manifold string (49, 70, 76) members for selectively controlling separate injected and extracted continuous, simultaneously flowing fluid mixture (38) streams (31-37) of varying velocities within one or more subterranean wells during drilling and production operations, extending from a single main bore (6) and wellhead (7), comprising the steps of:

providing, at an upper end of said one or more subterranean wells, a subterranean disposed manifold string (49, 70, 76) member with a plurality of member conduit strings (2, 2A, 2B, 2C, 39, 50, 51, 71, 78), wherein said manifold string member is rotatably installed and engagable with a concentric bore wellhead (7);

providing at least one manifold crossover (23) member with at least one radial passageway (75) member in fluid communication with at least one passageway (24, 24A, 24B, 25, 26, 53, 54, 55) member into communication with at least one of the plurality of member conduit strings extending axially downward from said at least one manifold crossover member to at least one proximal region of said one or more subterranean wells; and selectively controlling said separate simultaneously flowing fluid streams of varying velocities between said concentric bore wellhead and said at least one proximal region using one or more flow controlling members (61) engaged between said plurality of member conduit strings, or placeable through innermost passageway (25) members or innermost passageway member connectors (26) of said at least one manifold crossover member, and engagable to at least one receptacle member placed between said plurality of member conduit strings or within said at least one manifold crossover member, thereby urging substantially subterranean hydrocarbon or substantially water fluid mixtures of liquids, gases, solids, or combinations thereof, to or from said at least one proximal region.

2. The method of claim 1, wherein a first flow controlling member comprising a concentric bore valve tree (10, 10A) is engaged to an upper end of said concentric bore wellhead for selectively controlling injected or extracted flow streams usable for communicating with at least a second subterranean disposed flow controlling member and measuring or controlling at least a portion of fluid communicated through said at least one passageway member.

3. The method of claim 1, wherein said one or more flow controlling members comprise a subterranean placeable apparatus (61) for blocking all or part of said at least one passageway member during or after subterranean installation of said manifold string.

4. The method of claim 3, further comprising the step of selectively diverting at least a portion of a flow stream (31-38) through a smaller effective diameter passageway member to form a proximal length of velocity string or venturi arrangement (85) with a smaller effective diameter passageway member relative to the volume of flow.

5. The method of claim 3, further comprising the step of selectively separating a fluid mixture flow stream within a space of said at least one passageway member into at least two separate streams (31-37) of varying velocities comprising substantially liquid, substantially gas, or substantially water, by selectively affecting the velocity and containing pressure exerted on at least one of said separate streams.

6. The method of claim 5, further comprising the step of providing a gas lift arrangement (70, 70D, 76) and injecting a separate substantially gaseous flow stream into a substantially liquid flow stream through at least one additional flow controlling gas lift valve (84) member engaged between said plurality of member conduit strings or in said at least one receptacle comprising a side pocket mandrel.

7. The method of claim 1, further comprising the step of using an adapted managed pressure conduit assembly (49) member and an adapted slurry passageway apparatus member (58) to place other manifold string members between said concentric bore wellhead and said at least one proximal region to form said one or more subterranean wells below the single main bore.

8. The method of claim 1, further comprising the step of providing said one or more flow controlling members (61) using cable conveyed rotary operations apparatus selectively placeable within the innermost passageway members or engagable to said at least one receptacle (45, 45A) via cable conveyance during or after subterranean installation of said manifold string, wherein a submersible electrical motor, fluid motor driven pump, or piston with a fluid inlet and a fluid outlet communicates with regions of said separate simultaneously flowing fluid streams of varying velocities and pressures, whereby said fluid motor driven pump or piston is operable by differential fluid pressure between said separate simultaneously flowing fluid streams of varying velocities provided by said at least one passageway member.

9. The method of claim 8, further comprising the step of engaging the submersible electric motor (111) or fluid motor driven pump (69) to said at least one receptacle (45, 45A) or between said plurality of member conduit strings, to electrically rotate the submersible electric motor, or use said differential fluid pressure in conjunction with the fluid motor drive pump, to rotate a turbine motor, a positive displacement motor, or combinations thereof, to operate a fluid impellor (112) pump, a positive displacement (108, 109) pump, or combinations thereof to urge fluid mixture flow within said at least one passageway member.

10. The method of claim 1, wherein the step of providing a manifold crossover member (23) further comprises communicating fluid from at least one first innermost passageway member (25, 26) through at least a second passageway member (24, 24A, 24B, 53, 54, 55) to at least a third passageway member (24, 24A, 24B, 53, 54, 55), wherein a bore selector (47) or other flow controlling member, placed through said at least one first innermost passageway member (25, 26) extending from said concentric bore wellhead (7), enables fluid communication between said at least one innermost passageway member and said at least a third passageway member.

11. The method of claim 1, further comprising the step of utilizing a first flow stream (31-38) or subsurface thermal sink to thermally affect a second flow stream (31-38).

12. A subterranean flow controlling member apparatus of a manifold string (49, 70, 76) that is engagable with a concentric bore wellhead (7), wherein said manifold string is usable for selectively controlling separate injected and extracted continuous, simultaneously flowing fluid mixture streams (31-37) of varying velocities within one or more subterranean wells during drilling and production operations, extending from a single main bore (6) and wellhead (7), comprising:

a flow controlling member (21, 23, 43, 43A, 47, 47A, 49, 51A, 58, 69, 70, 76, 7, 10, 16, 22, 25A, 63, 64, 66, 74, 77, 84, 85, 91, 96, 97, 108-112, 115, 116, 123) engagable between conduits of conduit member strings (2, 2A, 2B, 2C, 39, 50, 51, 71, 78) or placeable through innermost passageway members (25, 26, 53) of said conduit member strings and engagable to at least one receptacle (45, 45A), wherein the flow controlling member is positioned between said concentric bore wellhead at an upper end of said one or more subterranean wells and at least one proximal region of said one or more subterranean wells, and wherein the flow controlling member comprises at least one radial passageway (75) member for providing fluid communication between a first and a second passageway member of the plurality of conduit member strings and the one or more subterranean wells; and wherein said flow controlling member is rotatably installed, and engagable to said concentric bore wellhead or placeable between said concentric bore wellhead and said at least one proximal region to selectively control at least one flowing fluid mixture stream (31-38) communicated through said passageway members (24, 24A, 24B, 25, 26, 53, 54, 55) to urge said at least one flowing fluid mixture stream to or from said at least one proximal region and at least one more proximal region or to said concentric bore wellhead.

13. The flow controlling member apparatus of claim 12, further comprising a placeable and removable motor and fluid pump (69), engagable between said conduit member strings or within said passageway members or said at least one receptacle with a cable (11) or a connector (68) through said innermost passageway members of said one or more subterranean wells, usable to pump at least one fluid mixture stream (31-38) within at least one of said passageway members during construction, operation of a substantially subterranean hydrocarbon or substantially water well, or combinations thereof.

14. The flow controlling member apparatus of claim 13, wherein a first of said separate simultaneously flowing fluid mixture streams rotates at least one fluid turbine (112) motor, a positive displacement (108, 109) motor, or combinations thereof, wherein said at least one fluid turbine (112) motor, said positive displacement (108,109) motor, or combinations thereof are engaged to a shaft, wherein the shaft is usable to rotate at least one associated fluid impellor (112) pump, positive displacement (108, 109) pump, or combinations thereof, to urge said at least one fluid mixture stream using the velocity or pressure of at least a second fluid mixture stream within at least a second passageway member.

15. The flow controlling member apparatus of claim 13, further comprising a submersible electric motor (111) for rotating at least one fluid impellor (112) pump, positive displacement (108, 109) pump, or combinations thereof, to urge said at least one fluid mixture stream within at least one of said passageway members, wherein connections (110) for said submersible electric motor are disposed within said conduit member strings, engagable to said submersible electrical motor, and wherein said submersible electric motor is placeable between said conduit member strings or through said passageway members.

16. The flow controlling member apparatus of claim 12, further comprising a fluid mixture flow stream blocking device engagable to at least one other manifold string member to control fluid communication of at least one passageway member affecting at least one of said separate simultaneously flowing fluid streams of varying velocities during construction, operation of a substantially hydrocarbon or substantially water well, or combinations thereof.

17. The flow controlling member apparatus of claim 12, further comprising a flow stream fixed choke or variable opening fluid communication device engagable to at least one other manifold string member to control the velocity or pressure of at least one of said separate simultaneously flowing fluid streams of varying velocities.

18. The flow controlling member apparatus of claim 12, further comprising measurement devices, controlling devices, signal devices, or combinations thereof, for measuring a pressure, velocity or temperature with mechanical or fluid linkages, pulses or control cables engaged to or placeable through a member to said at least one proximal region to selectively control at least a second flow controlling member apparatus usable to control said separate simultaneously flowing fluid mixture streams of varying velocities.

19. The flow controlling member apparatus of claim 12, further comprising a bore selector member (47) for controlling fluid communication within one or more passageway members extending from a chamber junction, wherein placement of the bore selector member is aided by at least one of said separate simultaneously flowing fluid streams exerting pressure on a guide surface (87), to selectively communicate fluid mixtures between passageway members disposed axially along said manifold string.

20. The flow controlling member apparatus of claim 19, wherein the bore selector member comprises at least a second flow controlling member to further aid bore selector placement, fluid mixture communication, or combinations thereof.

* * * * *